US007512994B2

(12) United States Patent
Kato

(10) Patent No.: US 7,512,994 B2
(45) Date of Patent: Apr. 7, 2009

(54) SHIRTS HAVING NECK SIZE ADJUSTING FUNCTION

(75) Inventor: Koji Kato, 189, Takehana-cho, Hashima-shi, Gifu-ken, 501-6241 (JP)

(73) Assignee: Koji Kato, Gifu-Ken (JP)

( * ) Notice: Subject to any disclaimer, the term of this patent is extended or adjusted under 35 U.S.C. 154(b) by 247 days.

(21) Appl. No.: 10/979,820

(22) Filed: Nov. 3, 2004

(65) Prior Publication Data

US 2005/0125876 A1 Jun. 16, 2005

(30) Foreign Application Priority Data

| | | |
|---|---|---|
| Nov. 4, 2003 | (JP) | 2003-374174 |
| Nov. 11, 2003 | (JP) | 2003-381648 |
| Jan. 15, 2004 | (JP) | 2004-007829 |
| Apr. 27, 2004 | (JP) | 2004-130611 |
| May 11, 2004 | (JP) | 2004-140826 |
| Oct. 5, 2004 | (JP) | 2004-292584 |

(51) Int. Cl.
*A41B 3/02* (2006.01)

(52) U.S. Cl. ..... 2/141.2; 2/129

(58) Field of Classification Search ..... 2/128, 2/129, 139, 140, 141.1, 141.2
See application file for complete search history.

(56) References Cited

U.S. PATENT DOCUMENTS 1,569,988 A 1/1926 Land
1,603,482 A 10/1926 Marquisee
(Continued)

FOREIGN PATENT DOCUMENTS

DE 240 147 C 10/1910
(Continued)

OTHER PUBLICATIONS

Tawain Office Action dated Dec. 6, 2005.
(Continued)

*Primary Examiner*—Alissa L Hoey
(74) *Attorney, Agent, or Firm*—Westerman, Hattori, Daniels & Adrian, LLP.

(57) ABSTRACT

A second buttonhole 6 is provided on a front cloth 3*a* of an inner fold of a neckband 3 of a dress shirt 1. A left end of a rubber tape 8 is stitched on a rear cloth 3*b*. A left end of a padding 7*a* is stitched on a right end thereof. A lining cloth 7*b* is stitched on a right end of the padding 7*a*. A right end of the lining cloth 7*b* is stitched inside the rear cloth 3*b* of the neckband 3. A vertical tape 9 has an upper end and a lower end stitched on the rear cloth 3*b* under the padding 7*a*. A horizontal tape 10 is passed therebetween and has its opposite ends stitched on rear sides of the padding 7*a* and the lining cloth 7*b*, respectively. Thus, there is provided a structure that a vertical tape 9 is held between a moving cloth, which is made of the padding 7*a* and the lining cloth 7*b*, and the horizontal tape 10. When an uppermost button 4 is hooked on the second buttonhole 6 of the front cloth 3*a* and moved rightward against a tensile force of the rubber tape 8, it can move smoothly. Moreover, a neckline can be adjusted to a desired length without a conspicuous action.

15 Claims, 25 Drawing Sheets

U.S. PATENT DOCUMENTS

| | | | | | |
|---|---|---|---|---|---|
| 1,616,258 | A | | 2/1927 | Hamilton | |
| 1,789,422 | A | | 1/1931 | Askey et al. | |
| 1,814,760 | A | | 7/1931 | Miller, Jr. | |
| 1,963,004 | A | * | 6/1934 | Tucker | 2/127 |
| 2,025,485 | A | * | 12/1935 | Tucker | 2/127 |
| 2,713,684 | A | * | 7/1955 | Yeboles | 2/116 |
| 3,142,843 | A | | 8/1964 | Berger | |
| 5,898,941 | A | * | 5/1999 | Groshens | 2/129 |
| 6,081,926 | A | * | 7/2000 | Krause et al. | 2/129 |
| 6,339,848 | B1 | * | 1/2002 | Mayhood et al. | 2/338 |
| 6,715,155 | B2 | * | 4/2004 | Duflos | 2/237 |
| 6,986,165 | B2 | * | 1/2006 | Neff et al. | 2/141.2 |
| 2002/0120974 | A1 | * | 9/2002 | Krause et al. | 2/129 |
| 2004/0181845 | A1 | * | 9/2004 | Droppo et al. | 2/141.2 |
| 2005/0125876 | A1 | * | 6/2005 | Kato | 2/129 |
| 2005/0210561 | A1 | * | 9/2005 | Robinson | 2/129 |
| 2005/0251891 | A1 | * | 11/2005 | Keeter | 2/129 |

FOREIGN PATENT DOCUMENTS

| | | | |
|---|---|---|---|
| DE | 114 484 | C | 8/1926 |
| DE | 489 320 | C | 1/1930 |
| DE | 549 832 | C | 5/1932 |
| DE | 82 18 346 | U | 9/1985 |
| DE | 200 07 322 | U | 10/2000 |
| GB | 24459 | A | 6/1911 |
| GB | 387 708 | A | 2/1933 |
| GB | 468 299 | A | 7/1937 |
| GB | 854 589 | | 11/1960 |
| JP | 05-302201 | | 11/1993 |

OTHER PUBLICATIONS

Office Action dated May 18, 2007, issued in corresponding European Application No. 04026628.9.

Office Action issued from the Canadian Patent Office dated Nov. 2, 2006 in the corresponding Canadian Patent Application No. 2,486,749.

* cited by examiner

SHIRTS HAVING NECK SIZE ADJUSTING FUNCTION

BACKGROUND OF THE INVENTION

1. Field of the Invention

This invention relates to a shirt or a blouse or the like that has a buttoned neck portion including a dress shirt that is worn under an outer wear with a tie knotted thereon, and particularly to a shirt having neck size adjusting function that has a neckline worn easily and comfortably without spoiling appearance.

2. Description of the Related Art

A dress shirt worn under an outer wear such as a suit or a dress suit is designed on condition that a tie is knotted around a neckline. Thus, the dress shirt is buttoned up to an uppermost part of the neckline. Retailers prepare dress shirts having different neck measurements and sleeve lengths (exactly a sleeve length plus half a width across shoulders) at one-centimeter variation. Then, a user is allowed to choose the most suitable one. Still, many people feel it tight to keep a state for a long time that he or she wears a dress shirt having a size exactly adjusted to his or her neck measurement while having a knotted tie thereon.

Then, Japanese Laid Open Patent Publication No. 5-302201 shows an invention of a formal shirt or a dress shirt that can adjust a neck size and that has a structure giving no uncomfortable feeling even if the tie is knotted loosely to a certain degree. In the invention related to this publication, a slide fastener having a stopper is used in place of buttonholes. Alternatively, hooks or clasps used for a tabi (Japanese split-toe socks) are attached in place of buttons, while plural eyes or eyes for the clasps are attached in place of the buttonholes. Alternatively, an uppermost part of the formal shirt is fastened by a hook and loop fastener. Consequently, the neck measurement of the shirt is made adjustable. Then, a collar is provided such that opposite end portions of the collar are overlapped when the neck size of the formal shirt is set to the smallest one. Thus, when the neck size of the formal shirt is set longer, the opposite end portions of the collar become closed so as to give people no impression that the neckline is loose.

However, with the technique of the publication No. 5-302201, in case the neckline of the formal shirt is fastened tightly to a certain degree at the beginning and then becomes too tight and should be set longer, the tie must be largely loosened. Then, the slide fastener must be slid, the hook or the clasp must again be fixed on another position or the hook and loop fastener must be separated once and then stuck together again adequately. Such an action is conspicuous. Therefore, it is impossible to do the action particularly in ceremonial occasions such as a marriage ceremony or a wedding reception, a wake and a funeral, since it is ill-mannered.

Moreover, in this technique, a stiff part such as the slide fastener, the hook and loop fastener, the eye or clasp eye is fixed on a front surface of a neckband corresponding to a lower side of the collar on which the uppermost button and buttonhole are provided, respectively. Therefore, it is possible that imprint or fading effect is generated even if the part is covered by the collar or that the part is seen when the collar goes up when something or other happens. In such case, the appearance is damaged.

BRIEF SUMMARY OF THE INVENTION

An object of the present invention is to provide a shirt having a neck size adjusting function that enables a user to adjust a neck measurement of a shirt including a dress shirt to a desired length without conspicuous action, while preventing imprint or fading effect generated on a collar due to an adjusting part or the like or preventing a trouble that the collar goes up so that the adjusting part or the like is seen from outside, thereby enabling the user to wear the shirt comfortably for a long time.

According to a first aspect of the invention, there is provided a shirt having a neck size adjusting function in which an uppermost button of the shirt is attached to a moving cloth at an inside of a second buttonhole provided on a neckband, which is a part of a neckline hidden under a collar in case of a shirt having a collar and which is a part of a neckline hidden under a neck in case of a shirt having a neck, so that the uppermost button is movable to a desired position in the second buttonhole in a neckline direction. Accordingly, the neck can be adjusted to a desired tightened state with only an action of picking and pulling the neck of the shirt a little with fingers of one hand, while the uppermost button being hooked on a normal buttonhole, from a state in which the neckline is most tightened where the button is located at a position most away from the normal buttonhole in the second buttonhole to a state in which the neckline is most loosened where the button is located at a position nearest the side of the normal buttonhole in the second buttonhole.

Thus, the neckline of the shirt including the dress shirt can be adjusted to a desired length without a conspicuous action. There is no imprint or fading effect generated on the neck by a fitting part or the like. No fitting part or the like goes up and is seen from outside. The neck can be closed when it is cold. The neck can be opened when it is hot. Therefore, the shirt can quickly deal with a temperature change of circumstances. The shirt can quickly switch from a rough state in which front ends of the collar are widely opened to a state in which the front ends of the collar are just fitted. Consequently, the neck-size-adjustable shirt can be worn comfortably for a long time.

According to a second aspect of the invention, there is provided a shirt having a neck size adjusting function in which the uppermost button is attached directly to an elastic material being capable of expanding and contracting or is attached to the moving cloth by stitching the moving cloth on a leading end of the elastic material, and an other end of the elastic material is stitched on the rear cloth of the neckband.

A rubber plate, a rubber tape, a net rubber tape or the like can be used as the "elastic material". Thus, in case the uppermost button is urged by the elastic material in such a direction as the neckline is tightened while the uppermost button is hooked on the normal buttonhole and in case a member having a strong tensile force is used such as the rubber plate or the rubber tape, even if opposite ends of the neck are picked and released with both hands so as to let the air enter into the neckline, it returns to an original tight position by an urging force of the elastic material when a wearer releases his or her hold.

Moreover, in case of using a member having a weak tensile force such as a net rubber tape, if the wearer feels the neckline becoming tight and if he or she picks the opposite ends of the neck by both hands so as to move the uppermost button to a desired position and loosen the neckline, the uppermost button does not return to its original position due to a friction with a buttonholed portion of the second buttonhole since the urging force of the elastic material is weak. The uppermost button returns to the original position while taking time and in a motion as if it does not move. Therefore, the wearer can keep the neckline comfortable for a while. Thus, even in case the wearer must stay in one position for a long time in attending a funeral or the like, the wearer can keep the neckline comfortable without conspicuous action.

Thus, the neckline of the shirt including the dress shirt can be adjusted to a desired length without a conspicuous action. The neckline can be returned immediately to its original tight position or keep a state of being loose for a while by selecting the urging force of the elastic material. There is no imprint or fading effect generated on the neck by a fitting part or the like. No fitting part or the like goes up and is seen from outside. Consequently, the neck-size-adjustable shirt can be worn comfortably for a long time.

According to a third aspect of the invention, there is provided a shirt having a neck size adjusting function in which a vertical tape is attached to the rear cloth of the neckband and a horizontal tape sewed on a rear side of the elastic material or the moving cloth while being passed under the vertical tape so as to move horizontally, thereby regulating a sway in a vertical direction of the elastic material or the moving cloth. Thereby, the elastic material or the moving cloth does not sway up and down but can move smoothly when it moves along the neckline. Accordingly, the neckline can be loosened at once and there is no fear that somebody notices such action.

Thus, the neckline of the shirt including the dress shirt can be adjusted to a desired length without a conspicuous action. Consequently, the neck-size-adjustable shirt can be worn comfortably for a long time.

As a structure for regulating the elastic material or the moving cloth from swaying up and down, a horizontal tape may have opposite ends, which are spaced at an interval corresponding to a length of the second buttonhole, stitched on the rear cloth of the neckband under the elastic material or the moving cloth at positions corresponding to the second buttonhole, and the vertical tape may have an upper end and a lower end sewn on a rear side of the elastic material or the moving cloth while being passed through a spaced part defined between the opposite ends of the horizontal tape. Thereby, the elastic material or the moving cloth does not sway up and down but can move smoothly when it moves along the neckline. Accordingly, the neckline can be loosened at once and there is no fear that somebody notices such action.

Thus, the neckline of the shirt including the dress shirt can be adjusted to a desired length without a conspicuous action. Consequently, the neck-size-adjustable shirt can be worn comfortably for a long time.

A horizontal oblong tape may have a left end sewn on the rear cloth of the neckband under the elastic material or the moving cloth at a position corresponding to the second buttonhole, the vertical oblong tape may have an upper end and a lower end sewn on a rear side of the elastic material or the moving cloth while being passed through a spaced part defined between the opposite ends of the horizontal tape, the vertical tape may be attached to the rear cloth of the neckband at a position corresponding to a right end of the second buttonhole, and the right end of the horizontal oblong tape may be sewn on the rear side of the elastic material or the moving cloth. Thereby, a moving range of the uppermost button is restricted at the right and left ends, so that there is no fear that an excessive force is applied to the elastic material. Moreover, the uppermost button can be moved smoothly in the second buttonhole.

Thus, the neckline of the shirt including the dress shirt can be adjusted to a desired length without a conspicuous action. Consequently, the neck-size-adjustable shirt can be worn comfortably for a long time.

According to a fourth aspect of the invention, there is provided a shirt having a neck size adjusting function in which a tape bent into an angle shape is sewn on the elastic material or the moving cloth at a bent line, opposite ends of the tape being sewn on the rear cloth of the neckband, and right and left parts of the tape located at the sewn bent line being folded into tucks. Thereby, when the uppermost button is pulled in the second buttonhole in such a direction as to loosen the neckline, the tucks at the center of the tape are separated up and down. Therefore, its play is lessened. Accordingly, even if the uppermost button is pulled forcibly toward an outside of the second buttonhole, there hardly takes place a so-called "breaking-out" that part of the moving cloth or the elastic material to which the uppermost button is fitted goes out the second buttonhole following such action. Moreover, since the center part of the tape is folded into the tucks, a returning action improves when the tensile force of the elastic material is strong.

Thus, the neckline of the shirt including the dress shirt can be adjusted to a desired length without a conspicuous action. Moreover, the breaking-out is hard to take place. Consequently, the neck-size-adjustable shirt can be worn comfortably for a long time.

A back fabric may be sewn on an inside of the rear cloth of the neckband, and the vertical tape and/or the horizontal oblong tape or the angle shaped tape may be sewn only on the back fabric. Thereby, a stitching thread for these members is never exposed to a front surface of the rear cloth of the neckband. It is only a thread for stitching the other end of the elastic material that is exposed. The elastic material cannot be durable only by being stitched on the lining cloth alone. Therefore, the appearance improves.

Thus, the neckline of the shirt including the dress shirt can be adjusted to a desired length without a conspicuous action. Consequently, the neck-size-adjustable shirt can be worn comfortably for a long time.

According to a fifth aspect of the invention, there is provided a shirt having a neck size adjusting function in which a relatively stiff padding is stuck on an inside of the neckband so as to surround the second buttonhole, the relatively stiff padding has a slot opened at a portion corresponding to the second buttonhole, the moving cloth is provided at the inside of the neckband so as to move separately from the neckband, and the uppermost button is stitched on the moving cloth with a suitable length of a thread base or a base-winding so as to be taken out of the second buttonhole.

A Vilene padding (a non-woven cloth padding made of polyester, nylon or the like and having various thicknesses), an inver padding (also called as a belt padding or simply a padding made of a fabric padding polyester, for example, and having various textures from soft to hard) or the like can be used as the "relatively stiff padding".

Thereby, since there is a relatively stiff padding stuck around the second buttonhole, the second buttonhole cannot move freely, so that the "breaking-out" can be prevented effectively.

Thus, the neckline of the shirt including the dress shirt can be adjusted to a desired length without a conspicuous action. The breaking-out is hard to take place. Consequently, the neck-size-adjustable shirt can be worn comfortably for a long time.

The moving cloth may include a padding and a fabric covering the padding, the fabric being a same fabric as the shirt or other kind of a fabric. A Vilene padding, an inver padding or the like as described above may be used as the "padding". The padding has large irregularities on the front surface and the irregularities on the front surface of the fabric are small. Then, in case of using the one covering the padding with the fabric as the moving cloth, specially in case of sticking a relatively stiff padding, which has a slot opened at a portion of the second buttonhole, on around the second buttonhole from inside, an appropriate friction is generated between the fabric having the small irregularities on the front surface of the moving cloth and the large irregularities on the front surface of the relatively stiff padding. Therefore, the moving cloth can be stopped at or moved to a proper position of the second buttonhole.

Thus, the neckline of the shirt including the dress shirt can be adjusted to a desired length without a conspicuous action. The breaking-out is hard to take place. Consequently, the neck-size-adjustable shirt can be worn comfortably for a long time.

The moving cloth may be made by joining a fabric to a relatively stiff padding and cutting them into a shape of the moving cloth by a laser cutting or a heat cutting. Thereby, a circumference of the moving cloth is hardened by heat of the laser cutting or the heat cutting, so that it is never frayed. There are obtained advantages that a step of sewing machine stitching for making the moving cloth can be omitted and that a thickness of the moving cloth can be thin.

Thus, the neckline of the shirt including the dress shirt can be adjusted to a desired length without a conspicuous action. Moreover, fabrication is easy and the neck-size-adjustable shirt can be worn comfortably for a long time.

According to a sixth aspect of the invention, there is provided a shirt having a neck size adjusting function in which the moving cloth made of a padding alone that is provided at the inside of the neckband so as to move separately from the neckband, the uppermost button being stitched on the moving cloth with a suitable length of a thread base or a base-winding; a relatively large and stiff padding is attached around the second buttonhole from an inside of the front cloth of the neckband or a relatively small and stiff padding is attached at a portion where the second buttonhole is formed from above the relatively large and stiff padding, while the relatively small and stiff padding being cut into a length corresponding to a length of the second buttonhole; a fabric of a same fabric as the shirt or other fabric is stuck or sewn on the relatively large and stiff padding, while the fabric having such a dimension as to cover the relatively large and stiff padding as a whole, or the fabric is stuck or sewn on a portion where the second buttonhole is formed, while the fabric having a dimension corresponding to the length of the second buttonhole; or the fabric is stuck or sewn on the relatively small and stiff padding, while the fabric having such a dimension as to cover the relatively large and stiff padding as a whole or such a dimension as to cover the relatively small and stiff padding as a whole, the second button hole is formed thereafter; and the uppermost button is taken out of the second buttonhole.

That is, to the contrary, the circumference of the second buttonhole is made of the front surface of the fabric, while the moving cloth is made of the padding, by use of a good compatibility of the above-mentioned padding and the fabric. Thereby, an appropriate friction is generated between the fabric having the small irregularities on the front surface of the fabric around the second buttonhole and the large irregularities on the front surface of the padding constituting the moving cloth. Therefore, the moving cloth can be stopped at or moved to a proper position of the second buttonhole. It is determined so as to generate the most suitable friction force according to a material or the like of the shirt whether to attach a relatively small stiff padding additionally on the relatively large stiff padding attached inside the front cloth of the neckband.

Thus, the neckline of the shirt including the dress shirt can be adjusted to a desired length without a conspicuous action. The breaking-out is hard to take place. Consequently, the neck-size-adjustable shirt can be worn comfortably for a long time.

According to a seventh aspect of the invention, there is provided a shirt having a neck size adjusting function in which a relatively stiff padding is stuck on an side of the second buttonhole as a whole of a leading end portion of the neckband, the relatively stiff padding having a slot opened at a portion corresponding to the second buttonhole. Thereby, the leading end portion of the neckband is reinforce by the relatively stiff padding entirely at the second buttonhole side. Therefore, the second buttonhole cannot be deformed freely, so that the breaking-out is harder to take place. Moreover, the leading end portion of the neckband is give a tension so as to increase the friction with the moving cloth, so that the uppermost button can be stopped at a desired position of the second buttonhole. If necessary, it can be picked and tightened by fingertips. Moreover, there are no wrinkles or bends generated on a moving area of the moving cloth, so that the moving cloth can be moved smoothly.

Thus, the neckline of the shirt including the dress shirt can be adjusted to a desired length without a conspicuous action. Moreover, the breaking-out is harder to take place. The neck can be tightened when it is cold and widened when it is hot, thereby responding quickly to temperature change of circumstance. The shirt can switch from a rough state in which the leading ends of the collar are widely opened to a formal state in which the leading ends of the collar are just matched. Consequently, the neck-size-adjustable shirt can be worn comfortably for a long time.

A relatively stiff padding may be sewn on a rear side of the moving cloth. Thereby, an overall stiffness of the moving cloth increases, so that the breaking-out is still harder to take place. Moreover, since the moving cloth can move smoothly inside the leading end portions of the neckband, the neckline can be adjusted with a slight force by picking it with fingertips.

Thus, the neckline of the shirt including the dress shirt can be adjusted to a desired length without a conspicuous action. The breaking-out is still harder to take place. Consequently, the neck-size-adjustable shirt can be worn comfortably for a long time.

A thin heat-resistant plastic plate may be used instead of the relatively stiff padding. The heat-resistant plastic means a plastic material that is not softened up to about 200° C. in a narrow sense. Such material can be used instead of the relatively stiff padding for a dress shirt or the like made of a cotton, which has the highest ironing temperature (about 200° C.). In a broad sense, it includes a plastic material that has a lower softening temperature (about 100° C. to about 180° C.). An ironing temperature of a dress shirt or the like made of a polyester is low such as about 160° C. to 180° C. Moreover, the heat-resistant plastic is not directly ironed but indirectly heated via a cloth therebetween. Then, a temperature of the heat-resistant plastic is thought to be so much lower than expected.

Thus, the neckline of the shirt including the dress shirt can be adjusted to a desired length without a conspicuous action. The breaking-out is still harder to take place. Consequently, the neck-size-adjustable shirt can be worn comfortably for a long time.

A thin heat-resistant plastic plate may be used instead of the moving cloth, and the uppermost button is stitched and taken out of the second buttonhole via a suitable length of a thread base or a base-winding.

The heat-resistant plastic means a plastic material that is not softened up to about 200° C. in a narrow sense, as described above. Specifically, it includes a polyvinylidene chloride, a copolymer of the polyvinylidene chloride and a polyvinyl chloride (PVC), a polyethylene terephthalate (PET) used for a PET bottle. In a broad sense, it includes a plastic material that has a lower softening temperature (about 100° C. to about 180° C.). An ironing temperature of a dress shirt or the like made of a polyester is low such as about 160° C. to 180° C. Moreover, the heat-resistant plastic is not directly ironed but indirectly heated via a cloth therebetween. Then, a temperature of the heat-resistant plastic is thought to be so much lower than expected. Accordingly, the polyvinyl chloride (PVC) can be used depending on a kind or thickness of the cloth of the shirt.

These heat-resistant plastic plates can be sewn by a sewing machine if they are not so much thick. Therefore, the uppermost button can be stitched thereon by a hand sewing needle or a button sewing machine. These plastic plates have a moderate stiffness, so that the breaking-out never takes place without using a vertical tape or a horizontal tape or the like for preventing the breaking-out.

Thus, the neckline of the shirt including the dress shirt can be adjusted to a desired length without a conspicuous action. The breaking-out is still harder to take place. Consequently, the neck-size-adjustable shirt can be worn comfortably for a long time.

According to an eighth aspect of the invention, there is provided a shirt having a neck size adjusting function in which a cloth tape is sewn on the heat-resistant plastic plate used instead of the moving cloth, and the uppermost button is stitched on the cloth tape alone or on both of the cloth tape and the heat-resistant plastic plate and taken out of the second buttonhole via a suitable length of a thread base or a base-winding. The heat-resistant plastic plate can be sewn by a sewing machine if they are not so much thick. Therefore, the uppermost button can be stitched thereon by a hand sewing needle or a button sewing machine. It has a moderate stiffness, so that it has an advantage that the breaking-out never takes place without using a vertical tape or a horizontal tape or the like for preventing the breaking-out. However, if the uppermost button is taken off, it is hard for a consumer to reattach. Then, the cloth tape is sewn on the heat-resistant plastic plate, so that even the consumer can reattach easily the uppermost button when it is taken off.

The cloth tape may have only the opposite ends stitched on the heat-resistant plastic plate used instead of the moving cloth, while the center being spaced or floated from the heat-resistant plastic plate, so that the uppermost button is stitched on the cloth tape alone. Alternatively, the circumference of the cloth tape may be stitched on the heat-resistant plastic plate so as to be in close contact with the heat-resistant plastic plate, while the uppermost button is stitched via a thread penetrating the cloth tape and the heat-resistant plastic plate. In the former case, it is easy for the consumer to reattach the uppermost button on the cloth tape alone when the uppermost button is taken off. However, there is a disadvantage that a breaking-out is possibly generated by a space or floating of the cloth tape. On the other hand, in the latter case, since the cloth tape is in close contact with the heat-resistant plastic plate, it seems that it is hard for the consumer to reattach the uppermost button on the cloth tape alone. However, a needle-point slides on the heat-resistant plastic plate, so that he or she can reattach the uppermost button on the cloth tape alone more easily than expected.

Moreover, a long cloth tape is sewn so as to be protruded from one end of the heat-resistant plastic plate, so that the protruded portion functions as a stopper. Consequently, a number of parts decreases, thereby leading to shortening the steps and cost reduction.

Thus, the neckline of the shirt including the dress shirt can be adjusted to a desired length without a conspicuous action. Moreover, even if the uppermost button is taken off, it can be reattached easily. At the same time, the stopper can be attached. Consequently, the neck-size-adjustable shirt can be worn comfortably for a long time.

According to a ninth aspect of the invention, there is provided a shirt having a neck size adjusting function in which an elastic material that is capable of expanding and contracting is sewn on one of the moving cloth, the moving cloth with the relatively stiff padding sewn on the rear side, the moving cloth with the heat-resistant plastic plate sewn on the rear side and the heat-resistant plastic plate, and an other end of the elastic material is sewn on the rear cloth of the neckband.

A rubber plate, a rubber tape, a net rubber tape or the like can be used as the "elastic material". Thus, in case the uppermost button is urged by the elastic material in such a direction as the neckline is tightened while the uppermost button is hooked on the normal buttonhole and in case of using a member having a strong tensile force is used such as the rubber plate or the rubber tape, even if opposite ends of the neck are picked and released with both hands so as to let the air enter into the neckline, it returns to an original tight position by an urging force of the elastic material when a wearer releases his or her hold.

Moreover, in case of using a member having a weak tensile force such as a net rubber tape, if the wearer feels the neckline becoming tight and if he or she picks the opposite ends of the neck by both hands so as to move the uppermost button to a desired position and loosen the neckline, the uppermost button does not return to its original position due to a friction with a buttonholed portion of the second buttonhole since the urging force of the elastic material is weak. The uppermost button returns to the original position while taking time and in a motion as if it does not move. Therefore, the wearer can keep the neckline comfortable for a while. Thus, even in case the wearer must stay in one position for a long time in attending a funeral or the like, the wearer can keep the neckline comfortable without conspicuous action.

Furthermore, in case of using a member having a weak tensile force such as a net rubber tape, if the neckline is switched from a state in which it is most tightened to a state in which it is loosened to a desired position, the uppermost button can be stopped at such position by a friction between a buttonholed portion of the second buttonhole and a thick one such as the moving cloth or the like, particularly the moving cloth with the relatively stiff padding sewn on the rear side or the moving cloth with the heat-resistant plastic plate sewn on the rear side. Then, if necessary, the leading ends of the collar and the neckband can be closed only by picking them by the fingertips.

Thus, the neckline of the shirt including the dress shirt can be adjusted to a desired length without a conspicuous action. The breaking-out is still harder to take place. Consequently, the neck-size-adjustable shirt can be worn comfortably for a long time.

According to a tenth aspect of the invention, there is provided a shirt having a neck size adjusting function in which an elastic material that is capable of expanding and contracting is sewn on one of one end of the moving cloth, one end of the moving cloth with the relatively stiff padding sewn on the rear side, one end of the moving cloth with the heat-resistant plastic plate sewn on the rear side and one end of the heat-resistant plastic plate, an other end of the elastic material is sewn on the rear cloth of the neckband, a stopper made of a non-stretch cloth is sewn on one of an other end of the moving cloth, an other end of the moving cloth with the relatively stiff padding sewn on the rear side, an other end of the moving cloth with the heat-resistant plastic plate sewn on the rear side and an other end of the heat-resistant plastic plate, and an other end of the stopper is sewn on the rear cloth of the neckband so as to regulate a movement of the uppermost button in a direction as to tighten the neckline.

Thereby, even in case of using the member having a strong tensile force such as a rubber plate or a rubber tape as the elastic material, the uppermost button is not too much pulled and can be maintained at a balanced position. In case of using a member having a weak tensile force such as a net rubber tape, if the neckline is switched from a position that is regulated most by the stopper in which it is most tightened to a state in which it is loosened to a desired position, the uppermost button can be stopped at such position by a friction between a buttonholed portion of the second buttonhole and a thick one such as the moving cloth or the like, particularly the moving cloth with the relatively stiff padding sewn on the rear side or the moving cloth with the heat-resistant plastic plate sewn on the rear side. Consequently, a desired tightening state can be obtained. Moreover, the breaking-out becomes still harder to take place by the stopper. Then, if necessary, the leading ends of the collar and the neckband can be closed only by picking them by the fingertips.

Thus, the neckline of the shirt including the dress shirt can be adjusted to a desired length without a conspicuous action. The breaking-out is still harder to take place. Consequently, the neck-size-adjustable shirt can be worn comfortably for a long time.

One of the moving cloth, the moving cloth with the relatively stiff padding sewn on the rear side, the moving cloth with the heat-resistant plastic plate sewn on the rear side and the heat-resistant plastic plate may be sewn on a long elastic material that is capable of expanding and contracting, and opposite ends of the elastic material may be sewn respectively on the rear cloth of the neckband. Thereby, one of the elastic materials serves similarly as the stopper, so that there are obtained the same functions and effects as the stopper is sewn thereon with a resultant easy sewing.

Thus, the neckline of the shirt including the dress shirt can be adjusted to a desired length without a conspicuous action. The breaking-out is still harder to take place. Consequently, the neck-size-adjustable shirt can be worn comfortably for a long time.

An end portion of the elastic material may be sewn on a padding material without being sewn directly on the rear cloth of the neckband, the padding material may be joined by adhesion to the rear cloth of the neckband, and an upper end and a lower end of the padding material may be both sewn at the time when the rear cloth and the front cloth of the neckband are sewn together. A Vilene padding (a non-woven cloth padding made of polyester, nylon or the like and having various thicknesses), an inver padding (also called as a belt padding or simply a padding made of a fabric padding polyester, for example, and having various textures from soft to hard) or the like can be used as the "padding material". The Vilene padding has a soft padding and a hard padding. However, in general, the soft padding and the hard padding mean a soft padding and a hard padding of the Inver padding.

Thereby, a stitching thread at the end portion of the elastic material is prevented from being seen from outside, so that the same seam as the normal shirt is seen from outside. Moreover, if the upper and lower ends of the padding material are sewn at the time when the rear cloth and the front cloth of the neckband are sewn, it is never taken off even if an adhered surface is peeled off through a repeated washing or the like.

Thus, the neckline of the shirt including the dress shirt can be adjusted to a desired length without a conspicuous action. An unnecessary seam is not seen from outside, thereby improving its appearance. Consequently, the neck-size-adjustable shirt can be worn comfortably for a long time.

A padding material of the neckband may be joined by adhesion to an inside of the rear cloth of the neckband after an end portion of the elastic material is sewn on the padding material of the neckband. The "neckband padding" is a padding material adhered to an inside of an overall circumference of the rear cloth of the neckband. If the end portion of the elastic material is sewn on a predetermined position before the neckband padding is adhered to the inside of the rear cloth of the neckband, the stitching thread of the end portion of the neckband is not seen from the outside. Then, the same seam as the normal shirt is seen from the outside.

Thus, the neckline of the shirt including the dress shirt can be adjusted to a desired length without a conspicuous action. An unnecessary seam is not seen from outside, thereby improving its appearance. Consequently, the neck-size-adjustable shirt can be worn comfortably for a long time.

The heat-resistant plastic plate may be covered with a fabric. Thereby, even if the heat-resistant plastic plate is thin, it becomes hard to bend. Moreover, even in case the heat-resistant plastic plate portion is seen from the second buttonhole, it is covered with the fabric, so that the light is reflected on the surface of the plastic plate. Consequently, there is no fear of giving an unpleasant feeling.

Thus, the neckline of the shirt including the dress shirt can be adjusted to a desired length without a conspicuous action. The breaking-out is still harder to take place. Consequently, the neck-size-adjustable shirt can be worn comfortably for a long time.

The heat-resistant plastic plate may have minute irregularities on a front surface thereof. Thereby, even if case the heat-resistant plastic plate portion is seen from the second buttonhole and even if it is not covered with a fabric, the light is not reflected on the surface of the plastic plate. Consequently, there is no fear of giving an unpleasant feeling.

Thus, the neckline of the shirt including the dress shirt can be adjusted to a desired length without a conspicuous action. The breaking-out is still harder to take place. Consequently, the neck-size-adjustable shirt can be worn comfortably for a long time.

According to an eleventh aspect of the invention, there is provided a shirt having a neck size adjusting function in which the uppermost button is stitched on the elastic material or the moving cloth via a suitable length of a thread base or a base-winding and taken out of the second buttonhole, the second buttonhole is impregnated with a thermosetting resin and heat-cured. The thermosetting resin includes an epoxy resin, a melamine resin, a phenol resin, an urethane resin or the like. However, since a thread stitching the uppermost button is in friction with the second buttonhole many times, there is a fear that the thread is broken. Therefore, a resin that has an elasticity after hot-curing is preferable. As described above, the second buttonhole is hardened, so that the breaking-out is hard to take place.

Thus, the neckline of the shirt including the dress shirt can be adjusted to a desired length without a conspicuous action. The breaking-out is hard to take place. Consequently, the neck-size-adjustable shirt can be worn comfortably for a long time.

The uppermost button may be stitched on the elastic material or the moving cloth via a suitable length of a thread base or a base-winding, and the uppermost button may be taken out of the second buttonhole that has been buttonholed with a thread made of a synthetic resin.

In recent years, a synthetic resin thread that has a moderate tension and that is strong for heat has begun to be used. The second buttonhole buttonholed by such synthetic resin thread is hard to be deformed. Accordingly, the breaking-out is hard to take place.

Thus, the neckline of the shirt including the dress shirt can be adjusted to a desired length without a conspicuous action. The breaking-out is hard to take place. Consequently, the neck-size-adjustable shirt can be worn comfortably for a long time.

According to a twelfth aspect of the invention, there is provided a shirt having a neck size adjusting in which an expansion-preventing material is sewn on opposite ends of the elastic material so as to regulate an expansion of the elastic material. Thereby, even if a large tensile force is applied to the elastic material by some reason, the elastic material is expanded only up to a length of the expansion-preventing material. Consequently, an excessive stress is never applied, thereby never shortening the life of the elastic material unnecessarily.

Thus, the neckline of the shirt including the dress shirt can be adjusted to a desired length without a conspicuous action. The elastic material can be long lasting. Consequently, the neck-size-adjustable shirt can be worn comfortably for a long time.

A horizontal tape may be extended at a position of the second buttonhole inside the neckband in a length larger than the second buttonhole, two vertical oblong tapes may be sewn near an upper end and a lower end of the horizontal tape so as to hold a hollow portion of the horizontal tape therebetween and so as to be move along the horizontal tape, and a button may be stitched on one of the two vertical oblong tapes that is located at a front side and taken out of the second button hole. Thereby, the friction increases between the two vertical oblong tapes and the horizontal tape, so that the uppermost button becomes hard to be displaced from a position where it is moved once. Moreover, since no elastic material is used, the structure becomes simple with a resultant cost reduction.

Thus, the neckline of the shirt including the dress shirt can be adjusted to a desired length without a conspicuous action. The structure is simple with a resultant cost reduction. Consequently, the neck-size-adjustable shirt can be worn comfortably for a long time.

The horizontal tapes may be provided in two in number, and the two horizontal oblong tapes may be sewn near the upper ends and the lower ends of the two horizontal tapes so as to move along the two horizontal tapes. Thereby, the friction increases between the two vertical oblong tapes and the two horizontal oblong tapes, so that the uppermost button becomes harder to be displaced from a position where it is moved once. Moreover, if necessary, the leading ends of the collar and the neckband can be closed just by picking them with the fingertips.

Thus, the neckline of the shirt including the dress shirt can be adjusted to a desired length without a conspicuous action. The structure is simple with a resultant cost reduction. Consequently, the neck-size-adjustable shirt can be worn comfortably for a long time.

The horizontal tape may be sewn only on a lining cloth that is sewn on an inside of the rear cloth of the neckband. Thereby, stitching threads at the opposite ends of the horizontal tape are not exposed on the front surface of the rear cloth of the neckband. Moreover, since no elastic material is used, any stitching thread is not exposed to the front surface of the rear cloth of the neckband in any way, so that the shirt has the same appearance as the normal shirt. Consequently, the appearance improves very much.

Thus, the neckline of the shirt including the dress shirt can be adjusted to a desired length without a conspicuous action. The structure is simple with a resultant cost reduction. Consequently, the neck-size-adjustable shirt can be worn comfortably for a long time.

According to a thirteenth aspect of the invention, there is provided a shirt having a neck size adjusting function in which a stopper is sewn on one end of the moving cloth or the heat-resistant plastic plate so as not to regulate normally a movement of the moving cloth or the heat-resistant plastic plate, and an other end of the stopper is sewn on an end of the neckband. The moving cloth or the heat-resistant plastic plate is normally regulated from moving in the second buttonhole by the stitched uppermost button. However, if the uppermost button is taken off, it can move freely in the neckband, so that it becomes difficult to return it to an original position. Still, with such stopper attached thereto, the moving cloth or the heat-resistant plastic plate can be returned to the original position by drawing or pulling the stopper, so that the uppermost button can be reattached.

Thus, with the neck-size-adjustable shirt, the neckline of the shirt including the dress shirt can be adjusted to a desired length without a conspicuous action. Moreover, it is easy to reattach the uppermost button if it is taken off.

According to a fourteenth aspect of the invention, there is provided a shirt having a neck size adjusting function in which a through hole that is prevented from fraying is provided on the rear cloth at a rear side of the neckband and at a position of the uppermost button in a state in which no force is applied to the moving cloth or its substitute. The through hole is provided in case of the uppermost button being taken off. If a consumer reattaches the uppermost button to the moving cloth or the substitute thereof, he or she widens the second buttonhole provided on the front cloth of the inner fold of the neckband. Then, he or she scoops with a needle having a stitching thread a position where the uppermost button is to be located in a state in which no force is applied to the moving cloth or the substitute thereof. At this time, if he or she scoops deeply, the needle scoops even the rear cloth of the inner fold of the neckband. Consequently, there is a fear that the uppermost button is sewn on the rear cloth of the inner fold of the neckband.

Then, the through hole that is not frayed is provided on the rear cloth at the rear side of the neckband. Thereby, the consumer passes the needle through the through hole and checks it without scooping action from the beginning so as not to scoop the rear cloth. The consumer repeats such action several times so as to stitch the uppermost button on the moving cloth or the substitute thereof. Thus, the consumer can reattach the uppermost button easily without fail. A buttonholed hole in a shape of a chrysanthemum, a ring hole of a metal or a plastic or the like may be used as the non-frayed through hole.

Thus, with the neck-size-adjustable shirt, the consumer can easily and surely reattach the uppermost button if it is taken off. The neckline of the shirt including the dress shirt can be adjusted to a desired length without a conspicuous action.

One or all of the uppermost button or a substitute thereof, the moving cloth or a substitute thereof and the thread base, the base-winding or a substitute thereof connecting both the uppermost button or the substitute thereof and the moving cloth or the substitute thereof may be made of a plastic, an elastomer, a rubber, a wood, a ceramic or a glass.

For example, the uppermost button or the substitute thereof may be made of a metal. The substitute of the thread base or the base-winding may be a string-like material made of a rubber. If the uppermost button, the moving cloth and the part connecting the both are made of an integrally molded plastic, a mass-production is possible, thereby leading to a large cost reduction. Moreover, if the uppermost button or the substitute thereof and the substitute of the thread base or the base-winding are made of the metal, the wood, the ceramic, the glass or the like, the shirt become beautiful in appearance and excellent in ornament.

Thus, with the neck-size-adjustable shirt, the neckline of the shirt including the dress shirt can be adjusted to a desired length without a conspicuous action, and the mass-production is made possible. Moreover, the shirt can be excellent in ornament and can be worn comfortably for a long time.

According to a fifteenth aspect of the invention, there is provided a shirt having a neck size adjusting function in which an uppermost button is attached to a short bar-shaped elastomer, the short bar-shaped elastomer is passed through a second buttonhole provided on a neckband, a lower end of the short bar-shaped elastomer is expanded and adhered to a plastic plate, an elastomer plate is adhered to a circumference of the plastic plate, and the elastomer plate is stitched on a rear cloth of the neckband. With such structure, the uppermost button can be moved in the second buttonhole in a neckline direction by a deforming force of the elastomer plate. If a force is stopped to apply, the uppermost button returns to its original position by an elastic force of the elastomer plate.

Thus, with the neck-size-adjustable shirt, the neckline of the shirt including the dress shirt can be loosened without a conspicuous action and returns to its original tight position.

An uppermost button may be attached to a short bar-shaped elastomer. The short bar-shaped elastomer may be passed through a second buttonhole provided on a neckband, and a lower end of the short bar-shaped elastomer may be expanded and adhered to a plastic plate. An elastic material may be adhered to one end of the plastic plate. The elastic material may be stitched on a rear cloth of the neckband. With such structure, the uppermost button can be moved in the second buttonhole in a neckline direction by a stretching force of the elastic material. If a force is stopped to apply, the uppermost button returns to its original position by a stretchy force of the elastomer plate.

Thus, with the neck-size-adjustable shirt, the neckline of the shirt including the dress shirt can be loosened without a conspicuous action and returns to its original tight position.

An uppermost button may be attached to a short bar-shaped elastomer. The short bar-shaped elastomer may be passed through a second buttonhole provided on a neckband, and a lower end of the short bar-shaped elastomer may be adhered to a thin plastic plate. A guide plate having a slot-shaped groove and a rectangular groove may cover the small thin plastic plate so that a lower portion of the short-bar-shaped elastomer slides along the slot-shaped groove of the guide plate and that the small thin plastic plate slides along the rectangular groove of the guide plate. A thin plastic plate or a relatively stiff padding material may block off a rear side of the guide plate. Accordingly, if the uppermost button is attached inside the neckband so that a sliding direction is conformed to a longitudinal direction of the second buttonhole, the uppermost button can slide in the second buttonhole and can be stopped at a desired position by a friction between the lower end portion of the short bar-shaped elastomer and the slot-shaped groove. Then, if necessary, a front space between the leading ends of the collar or the neckband can be closed only by picking them with fingertips.

Thus, with the neck-size-adjustable shirt, the neckline of the shirt including the dress shirt can be adjusted to a desired length without a conspicuous action and the wearer can wear it comfortably for a long time.

According to a sixteenth aspect of the invention, there is provided a shirt having a neck size adjusting function in which the second buttonhole is inclined with an inner end side of the neckband slightly lower.

The uppermost button is stopped at a desired position in the second buttonhole, for example, by sticking the relatively stiff padding around the second buttonhole so as to adjust the friction with the uppermost button and adjust the elastic force of the elastic material. However, if he second buttonhole is provided horizontally, the uppermost buttonhole does not return well to the inside of the neckband. Then, the inventor devoted himself to experiments and study and found that, if the second buttonhole is inclined with the inside located lower, the uppermost button returns well to the inside of the neckband. Thereby, the inventor has made the present invention based on such knowledge. Specifically, the length of the second buttonhole is about 1.2 cm to 2.0 cm. Then, if the inner end of the second buttonhole is about 2 mm lower, the uppermost button returns to the inside of the neckband well. Thereby, the front space between the leading ends of the collar can be closed only by picking them with the fingertips if necessary.

Thus, with the neck-size-adjustable shirt, the neckline of the shirt including the dress shirt can be adjusted to a desired length without a conspicuous action and the wearer can wear it comfortably for a long time.

According to a seventeenth aspect of the invention, there is provided a shirt having a neck size adjusting function in which the second buttonhole is provided such that an inner end of the second buttonhole is located away from the neckband toward an outside of the neckband from a position just under a base end portion of the neckband and a collar joined together. Even if the inner end of the second buttonhole is located just under the base end portion of the neckband and the collar, the front space between the leading ends of the collar can be opened by moving the uppermost button toward the outer end of the second buttonhole and hooking it on the outer end of the normal buttonhole. Accordingly, the front space between the leading ends of the collar can be opened more widely by prolonging the length of the second buttonhole. However, if the second buttonhole is elongated too much, the appearance becomes worse. Moreover, the second buttonhole is easy to be opened and the breaking-out tends to take place. In contrast, if the second buttonhole is shifted outward so as to enlarge the largest opening width, the length of the second buttonhole is kept short as it is. Moreover, the appearance is kept good and no breaking-out takes place.

According to an eighteenth aspect of the invention, there is provided a shirt having a neck size adjusting function in which an uppermost button of the shirt is stitched on a retainer while a suitable length of a thread base or a base-winding thereof being passed through a second buttonhole provided on a front cloth of an inner fold of a neckband so that the uppermost button is capable of moving to a desired position in the second buttonhole in a neckline direction. If the thread base or the base-winding is made into the suitable length, the uppermost button can be stopped at a desired position in the second buttonhole by use of a friction between the front cloth of he inner fold of the neckband and the stopper. Moreover, it has a simple structure that does not use any stopper or elastic material, so that it can be manufactured easily and at low costs.

Thus, with the neck-size-adjustable shirt, the neckline of the shirt including the dress shirt can be adjusted to a desired length without a conspicuous action. It can be manufactured easily at low costs. Moreover, the wearer can wear it comfortably for a long time.

An uppermost button or a substitute thereof and a retainer may be connected via a leg portion passing through a second buttonhole provided on a front cloth of an inner fold of a neckband so that the uppermost button or the substitute thereof is capable of moving to a desired position in the second buttonhole in a neckline direction. The uppermost button gets out of sight if a tie is knotted in the neck-size-adjustable shirt. Thus, a member other than a button may be used. Even if the tie is not knotted, in case a bright member such as a metal or a ceramic is used instead of the uppermost button, the shirt becomes excellent in ornament. A member connecting the uppermost button or the substitute thereof with the retainer is not limited to the thread base or the base-winding. As long as it has a suitable length and strength, any member may be used. Moreover, it has a simple structure that does not use any stopper or elastic material, so that it can be manufactured easily and at low costs.

Thus, with the neck-size-adjustable shirt, the neckline of the shirt including the dress shirt can be adjusted to a desired length without a conspicuous action. It can be manufactured easily at low costs. Moreover, the wearer can wear it comfortably for a long time.

According to a nineteenth aspect of the invention, there is provided a shirt having a neck size adjusting function in which an uppermost button of the shirt is stitched on a retainer while a suitable length of a thread base or a base-winding thereof being passed through a neckband-penetrating buttonhole provided on an inner fold of a neckband so that the uppermost button is capable of moving to a desired position in the neckband-penetrating buttonhole in a neckline direction. Each of the second buttonholes described heretofore is provided on the front cloth of the inner fold of the neckband and does not pass through the rear cloth of the inner fold of the neckband. Therefore, a work inside the inner fold of the neckband is necessary, so that it is hard for a consumer to change an internal structure easily.

However, with the neck-size-adjustable shirt according to the invention, the neckband-penetrating buttonhole is provided so as to pass through the inner fold of the neckband. The uppermost button and the retainer are connected with the thread base or the base-winding that passes through the neckband-penetrating buttonhole. Accordingly, no work inside the inner fold of the neckband is necessary, so that the manufacture is made easier with a resultant cost reduction. Moreover, the uppermost button or the retainer can be changed easily to another member in accordance with a taste of a consumer.

Thus, with the neck-size-adjustable shirt, the neckline of the shirt including the dress shirt can be adjusted to a desired length without a conspicuous action. It can be manufactured easily at low costs. Moreover, the wearer can wear it comfortably for a long time.

An uppermost button or a substitute thereof and a retainer may be connected via a leg portion passing through a neckband-penetrating buttonhole provided on an inner fold of a neckband so that the uppermost button or the substitute thereof is capable of moving to a desired position in the neckband-penetrating buttonhole in a neckline direction. The uppermost button gets out of sight if a tie is knotted in the neck-size-adjustable shirt. Thus, a member other than a button may be used. Even if the tie is not knotted, in case a bright member such as a metal or a ceramic is used instead of the uppermost button, the shirt becomes excellent in ornament. Any member may be used as the leg portion connecting the uppermost button or the substitute thereof with the retainer may be is not limited to the thread base or the base-winding, as long as it has a suitable length and strength. Moreover, it has a simple structure that does not use any stopper or elastic material, so that it can be manufactured easily and at low costs.

Thus, with the neck-size-adjustable shirt, the neckline of the shirt including the dress shirt can be adjusted to a desired length without a conspicuous action. It can be manufactured easily at low costs, while being made excellent in terms of ornament. Moreover, the wearer can wear it comfortably for a long time.

The retainer may be a button larger than the uppermost button. If the button is used as the retainer, it can be connected easily with the uppermost button with a thread base or a base-winding. If a button larger than the uppermost button is used, there is no fear that it slips through the second buttonhole or the neckband-penetrating buttonhole thereby to be taken off. Moreover, since the button is easy to slide on the cloth of the shirt, it can be moved smoothly in the second buttonhole or the neckband-penetrating buttonhole.

Thus, with the neck-size-adjustable shirt, the neckline of the shirt including the dress shirt can be adjusted to a desired length without a conspicuous action. It can be manufactured easily at low costs. Moreover, the wearer can wear it comfortably for a long time.

One or all of the substitute of the uppermost button, the retainer and the leg portion is made of a metal, a plastic, an elastomer, a rubber, a wood, a ceramic or a glass.

For example, the uppermost button or the substitute thereof may be made of a metal. The leg portion may be a string-like material made of a rubber or a hard plastic. If the substitute portion of the uppermost button, the leg portion and the retainer portion are made of an integrally molded plastic, a mass-production is possible, thereby leading to a large cost reduction. Moreover, if the substitute of the uppermost button and the leg portion are made of the metal, the wood, the ceramic, the glass or the like, the shirt become beautiful in appearance and excellent in ornament. If the leg portion is made of the elastomer or the rubber, it is capable of expanding and contracting.

Thus, with the neck-size-adjustable shirt, the neckline of the shirt including the dress shirt can be adjusted to a desired length without a conspicuous action. It can be manufactured easily at low costs, while being made excellent in terms of ornament. Moreover, the shirt can be excellent in ornament and can be worn comfortably for a long time.

According to a twentieth aspect of the invention, there is provided a shirt having a neck size adjusting function in which a loop made of an elastic material is attached to an outer fold end of a neckband of the shirt, and an engaging member is attached to such a position of the inner fold of the neckband as the loop is engaged with the engaging member with a suitable urging force when the shirt is worn. Thereby, if the uppermost button is hooked on the normal buttonhole of the outer fold of the neckband and the loop made of the elastic material is hooked on the engaging member of the inner fold of the neckband, in case the neck part is opened within a length of the normal buttonhole and in case the elastic force of the loop is set strong, the neck part returns in itself to a tight position when the wearer releases his or her hold. If a friction force between the normal buttonhole and the uppermost button is made stronger by shortening the thread base or the base-winding than the elastic force of the loop, the neck part is restrained at a desired position when the neck part is opened within a length of the normal buttonhole. Then, the neck part returns to a tight position by picking it with the fingertips.

Since the loop made of the elastic material and the engaging member of the inner fold of the neckband are hidden under the collar, they never deteriorate the appearance. Moreover, a rubber, a rubber cord, a shirred rubber or the like may be used as the "elastic material". A button, a hook or a snap or the like may be used as the "engaging member".

Thus, with the neck-size-adjustable shirt, the neckline of the shirt including the dress shirt can be adjusted to a desired length without a conspicuous action even if no second buttonhole or neckband-penetrating buttonhole is provided. Moreover, the shirt can be excellent in ornament and can be worn comfortably for a long time.

A loop made of an elastic material may be attached to an end of the inner fold of the neckband, and an engaging member may be attached to such a position at a rear side of the outer fold of the neckband as the loop is engaged with the engaging member with a suitable urging force when the shirt is worn. Thereby, if the uppermost button is hooked on the normal buttonhole of the outer fold of the neckband and the loop made of the elastic material is hooked on the engaging member at the rear side of the outer fold of the neckband, in case the neck part is opened within a length of the normal buttonhole and in case the elastic force of the loop is set strong, the neck part returns in itself to a tight position when the wearer releases his or her hold. If a friction force between the normal buttonhole and the uppermost button is made stronger by shortening the thread base or the base-winding than the elastic force of the loop, the neck part is restrained at a desired position when the neck part is opened within a length of the normal buttonhole. Then, the neck part returns to a tight position by picking it with the fingertips.

Since the loop made of the elastic material and the engaging member at the rear side of the outer fold of the neckband are hidden at the rear side of the outer fold of the neckband, they never deteriorate the appearance.

Thus, with the neck-size-adjustable shirt, the neckline of the shirt including the dress shirt can be adjusted to a desired length without a conspicuous action even if no second buttonhole or neckband-penetrating buttonhole is provided. Moreover, the shirt can be excellent in ornament and can be worn comfortably for a long time.

Further objects and advantages of the invention will be apparent from the following description, reference being had to the accompanying drawings, wherein preferred embodiments of the invention are clearly shown.

DETAILED DESCRIPTION OF THE INVENTION

Figure 1A:
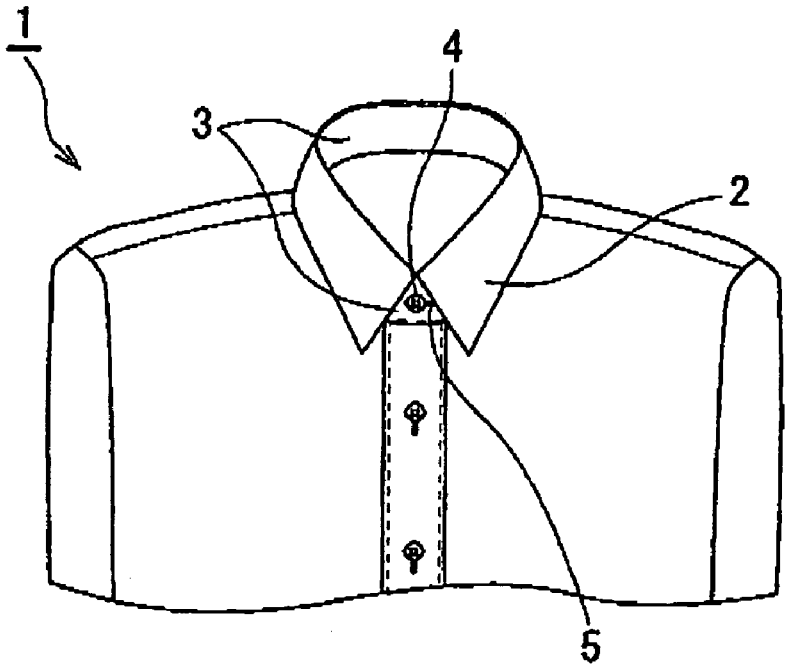
FIG. 1*a* is a front view of an upper part of a shirt having neck size adjusting function, while an uppermost button is fastened, according to a first embodiment of the invention.

Several embodiments of the invention are described hereunder referring to the attached drawings. Each of embodiments of the invention described hereafter exemplifies a case in which a shirt having neck size adjusting function of the invention is applied mainly to a dress shirt. The same reference character is used to show the same element throughout the several embodiments.

First Embodiment

Figure 1B:
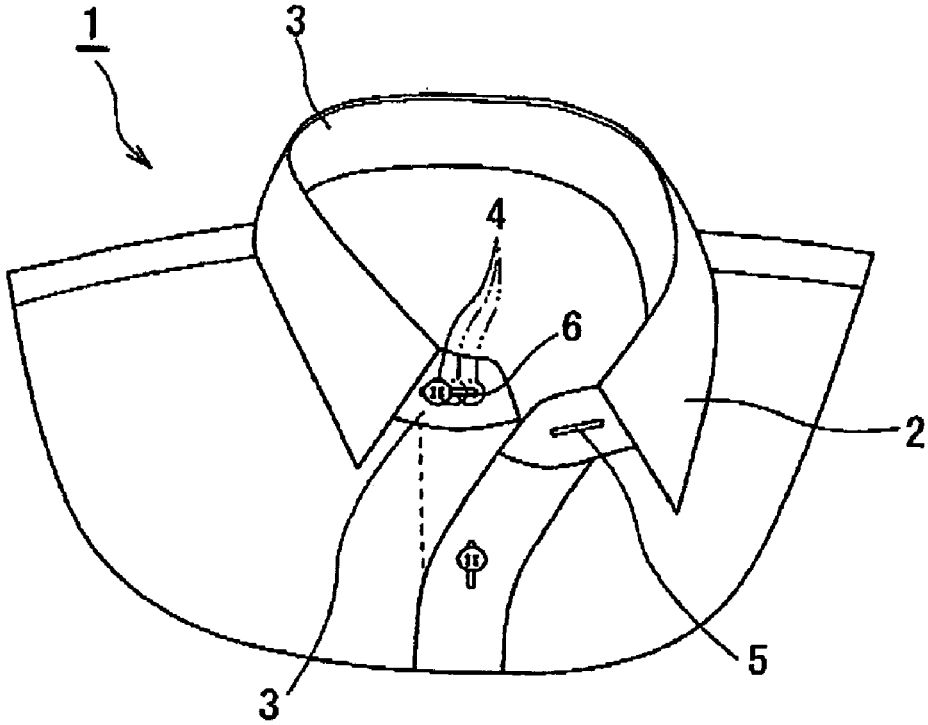
FIG. 1*b* is a drawing showing the shirt having neck size adjusting function, while the uppermost button is unfastened from a normal buttonhole so that a second buttonhole provided on a neckband is seen from outside.
Figure 2A:
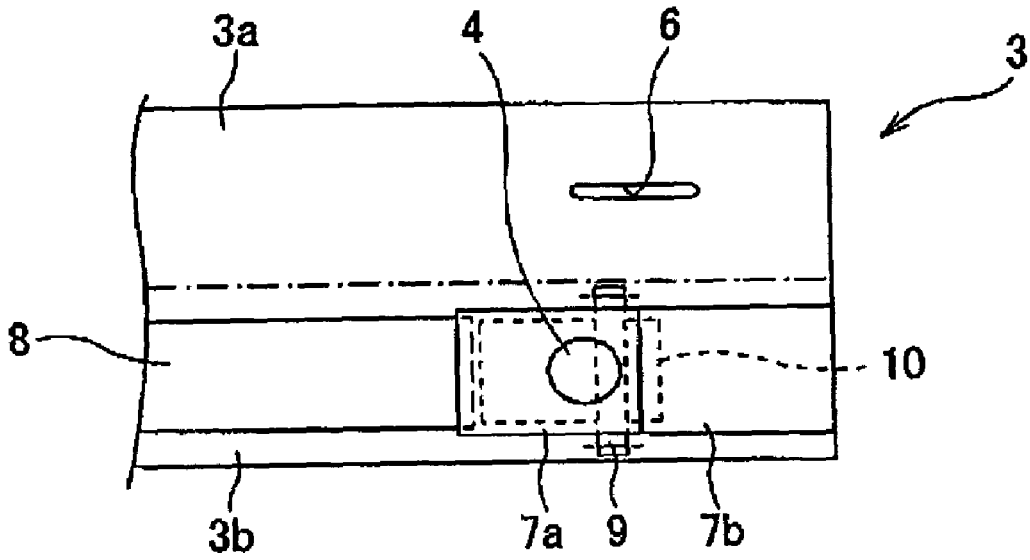
FIG. 2*a* is a drawing showing the neckband opened in a vertical direction, at which the uppermost button is attached, of the shirt having neck size adjusting function according to the first embodiment of the invention, while an elastic material is contracted.
Figure 2B:
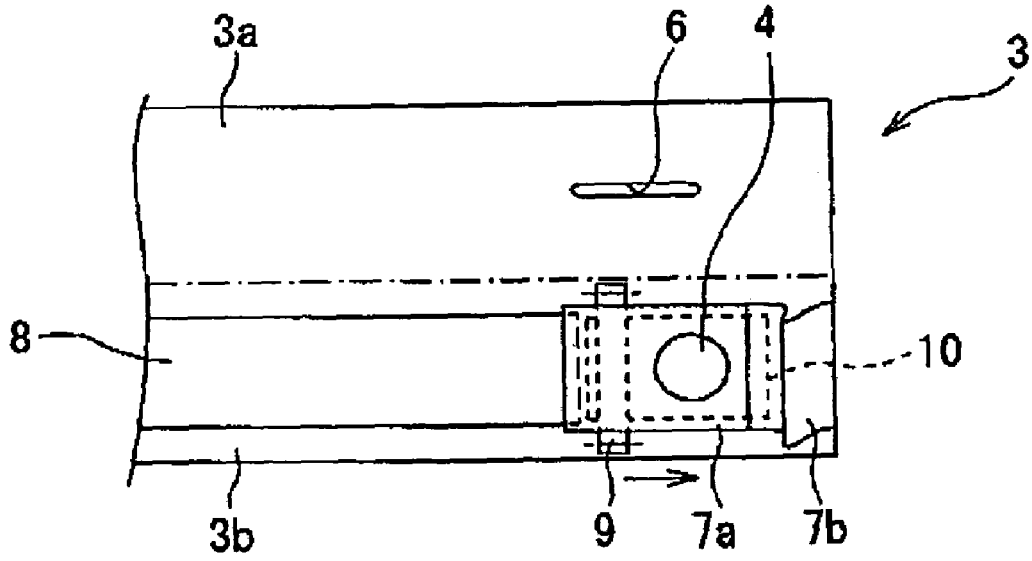
FIG. 2*b* is a drawing showing the neckband opened in the vertical direction, at which the uppermost button is attached, of the shirt having neck size adjusting function according to the first embodiment of the invention, while the elastic material is stretched and elongated.
Figure 3:
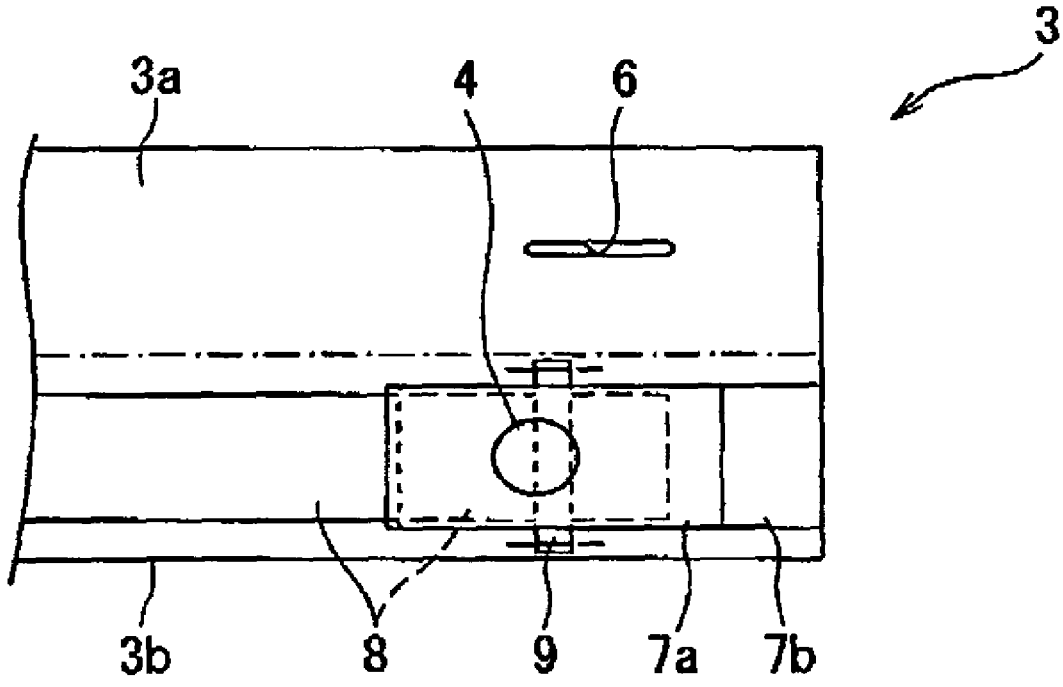
FIG. 3 is a drawing showing a neckband opened in a vertical direction, at which an uppermost button is attached, of a shirt having neck size adjusting function according to a modified example of the first embodiment of the invention.

FIG. 1*a* is a front view of an upper part of a shirt having neck size adjusting function, while an uppermost button is fastened, according to a first embodiment of the invention. FIG. 1*b* is a drawing showing the shirt having neck size adjusting function, while the uppermost button is unfastened from a normal buttonhole so that a second buttonhole provided on a neckband is seen from outside. FIG. 2*a* is a drawing showing the neckband opened in a vertical direction, at which the uppermost button is attached, of the shirt having neck size adjusting function according to the first embodiment of the invention, while an elastic material is contracted. FIG. 2*b* is a drawing showing the neckband opened in the vertical direction, at which the uppermost button is attached, of the shirt having neck size adjusting function according to the first embodiment of the invention, while the elastic material is stretched and elongated. FIG. 3 is a drawing showing a neckband opened in a vertical direction, at which an uppermost button is attached, of a shirt having neck size adjusting function according to a modified example of the first embodiment of the invention. The same or corresponding reference character is used to show the same or corresponding member or portion throughout each of embodiments or examples.

Referring to FIG. 1*a*, the first embodiment of the shirt having neck size adjusting function (referred to as "neck-size-adjustable shirt") 1 has an appearance of a normal long-sleeved dress shirt having a collar 2 that is worn under a suit or the like. An uppermost button 4 is stitched on a right-hand side (left side in FIG. 1) of a neckband 3. A normal buttonhole 5 is provided on a left-hand side (right side in FIG. 1) of the neckband 3. The uppermost button 4 is inserted and fastened in the buttonhole 5. As shown in FIG. 1*b*, if the uppermost button 4 is unfastened from the normal buttonhole 4, a second buttonhole 6 comes into sight. The uppermost button 4 is movable in the second buttonhole 6 along a neckline as depicted by an imaginary line. Thus, the neckline of the neck-size-adjustable shirt 1 is capable of becoming loose or tight by moving the uppermost button 4 in the second buttonhole 6.

Next described referring to FIG. 2*a* and FIG. 2*b* is a mechanism for moving the uppermost button 4 in the second buttonhole 6. For simplifying the description, the drawings from FIG. 2*a* and above omit illustration of four or two buttonholes and threads passing through these buttonholes of the uppermost button 4. As shown in FIG. 2*a*, when a leading end portion of the right-hand side of the neckband 3 is opened vertically, the second buttonhole 6 comes into sight and is provided on a front cloth 3*a* of the neckband 3. A rubber tape 8 as an elastic material has a left end (not shown) stitched on a rear cloth 3*b* of the neckband 3. An interlining or a padding is stuck on an entire surface of the front cloth 3*a* and the rear cloth 3*b* for the purpose of reinforcement. Such structure is provided in the same manner in all the embodiments described hereafter. On the other hand, a left end of a padding 7*a* as a moving cloth is stitched on a right end of the rubber tape 8. A lining cloth 7*b* as a stopper is stitched on a right end of the padding 7*a*. A right end of the lining cloth 7*b* is stitched inside the rear cloth 3*b* of the neckband 3. The uppermost button 4 is firmly stitched on the padding 7*a* with a suitable length of a base-winding (called "nemaki" in Japanese) that is firmly wound and fixed around a thread base of the button.

In the first embodiment, while the button 4 is stitched with the base-winding, it may be stitched with a thread base of a suitable length. Particularly, since the button of the shirt is often stitched by a machine, the button 4 may often be stitched only with the thread base. The padding 7*a* as the moving cloth has a rectangular shape in FIG. 2*a* and FIG. 2*b*, since the neckband 3 has leading ends of a rectangular shape. However, the leading end of the neckband 3 often has a streamline shape. In such case, the padding 7*a* as the moving cloth is made into a round shape in accordance with the shape of the leading end of the neckband 3.

In the first embodiment, the padding 7*a* as the moving cloth and the rear cloth 7*b* as the stopper are stitched as separate bodies. However, the moving cloth 7*a* and the stopper 7*b* may be an integrated tubular fabric and the padding material may be stitched inside only at a portion of the moving cloth 7*a*. Moreover, while the rubber tape 8 as the elastic material is stitched on the rear cloth 3*b* of the neckband 3, it may be stitched on the front cloth 3*a* of the neckband 3. In this case, a stitching thread at the rubber tape 8 is hidden by the collar 2, so that it is not seen from the outside. These characteristics are similarly applicable to each of the embodiments described hereafter.

Under the padding 7*a*, a vertical tape 9 has upper and lower ends respectively stitched on the rear cloth 3*b* of the neckband 3. A horizontal tape 10 is passed between the vertical tape 9 and the rear cloth 3*b*. Opposite ends of the horizontal tape 10 are stitched respectively on rear sides of the padding 7*a* and the rear cloth 7*b*. Thus, the vertical tape 9 is held between the moving cloth and the stopper composed of the padding 7*a* and the rear cloth 7*b*. Consequently, when the uppermost button 4 is fastened in the second buttonhole 6 of the front cloth 3*a* and moved rightward as shown in FIG. 2*b* against a tensile force of the rubber tape 8 as the elastic material, the button 4 can be moved smoothly without swaying up and down.

Describing the above characteristics with respect to the neck-size-adjustable shirt 1 as a final product, all buttons are fastened up to the uppermost button 4, as shown FIG. 1*a*. Then, a tie (not shown) is knotted around the neckband 3 under the collar 2. When a person wearing the shirt 1 attends a formal ceremonial occasions such as a marriage or a burial, he or she may stay in one position for a long time. Then, if he or she may feel his or her neckline tight, he or she can casually pick and give force to right and left portions of the neckband 3 or the collar 2 with his or her both hands. Thus, the uppermost button 4 is pulled at the end of the normal buttonhole 5 and moves rightward in the second buttonhole 6 as shown in FIG. 2*b*. Consequently, the neckline is stretched and elongated, so that he or she feels easy and comfortable and can let in the air from the neck portion into the shirt 1.

When he or she looses his or her hold on the neck portions, if the rubber tape 8 as the elastic material has a strong tensile force, the neck portions return to an original state in which they are made tight by an urging force of the rubber tape 8. In case of using a rubber tape 8 having a weak tensile force such as a net rubber tape, the uppermost button 4 does not return to its original position immediately due to friction with a buttonhole sewing of the second buttonhole 6, since the urging force of the elastic material is weak. Then, the uppermost button 4 returns to its original position very slowly and taking a lot of time with such a motion as cannot be recognized or noticed. Consequently, a wearer can maintain his or her neckline comfortable for a while. As a result, even if the wearer must stay in one position for a long time while attending a funeral or the like, he or she can keep the neckline easy without conspicuous action.

If it is required to make the neckline return to its original tight position immediately by an urging force of the rubber tape 8, it is preferable to set the base winding, which is firmly wound and fixed around a thread base of the button, of the uppermost button 4 long. If it is required to make the neckline return to its original tight position after a long time without conspicuous movement, it is preferable to set friction large between the uppermost button 4 and the buttonhole sewing of the buttonhole 5, while making the base winding of the uppermost button 4 short.

A modified example of the first embodiment of the size-adjustable shirt 1 is described hereafter referring to FIG. 3. As shown in FIG. 3, the present modified example has the same structure as that of the neck-size-adjustable shirt 1 to a point that the vertical tape 9 is stitched to the rear cloth 3*b* of the neckband 3. the modified example is different from the above described embodiment in that it does not use a horizontal tape 10. In the modified example, the rubber tape 8 is passed between the vertical tape 9 and the rear cloth 3*b* and has two positions stitched on a rear side of the padding 7*a*, while making a space by a moving stroke of the uppermost button 4 or a length of the second buttonhole 6. Then, the vertical tape 9 is held between the padding 7*a* and the rubber tape 8. Thus, when the uppermost button 4 is moved rightward against the tensile force of the rubber tape 8, the uppermost button 4 is capable of moving smoothly without swaying up and down. Therefore, the structure can be more simple since it does not use the horizontal tape 10.

In FIG. 3, since the leading end of the neckband 3 has a square shape, the padding 7*a* as the moving cloth has a rectangular shape. However, the leading end of the neckband 3 often has a streamline shape. In such case, the padding 7*a* as the moving cloth is made into a round shape according to the shape of the leading end of the neckband 3.

As described above, according to the first embodiment of the neck-size-adjustable shirt, the neckline of the shirt including the formal shirt can be adjusted to a desired length without conspicuous action. If the urging force of the elastic material is selected, the neckline can be returned to the original tight position immediately or keep the loose state of the neckline for a while. There is no imprint or fading effect generated on the collar by the fitting parts or the like. Moreover, the collar does not go up or the fitting parts are not seen from outside. Consequently, the wearer can wear the shirt comfortably for a long time. Since the lining cloth 7*b* as the stopper is stitched on the padding 7 as the moving cloth, even if the uppermost button 4 is taken off, the padding 7*a* can be returned to the original position by pulling the lining cloth 7*b*. Thus, the uppermost button 4 can be sewn on again on the padding 7*a*.

Second Embodiment

Figure 4A:
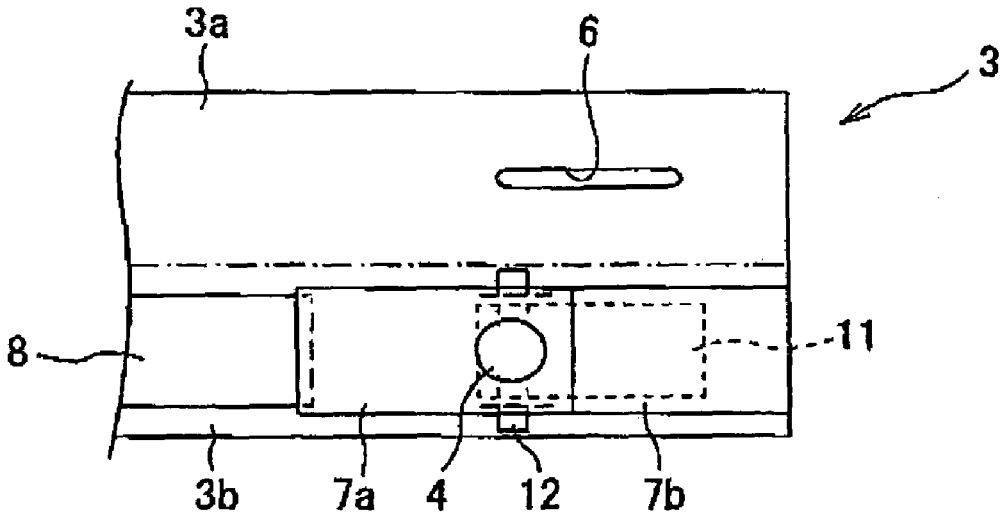
FIG. 4*a* is a drawing showing a neckband opened in a vertical direction, at which an uppermost button is attached, of a shirt having neck size adjusting function according to a second embodiment of the invention, while an elastic material is contracted.
Figure 4B:
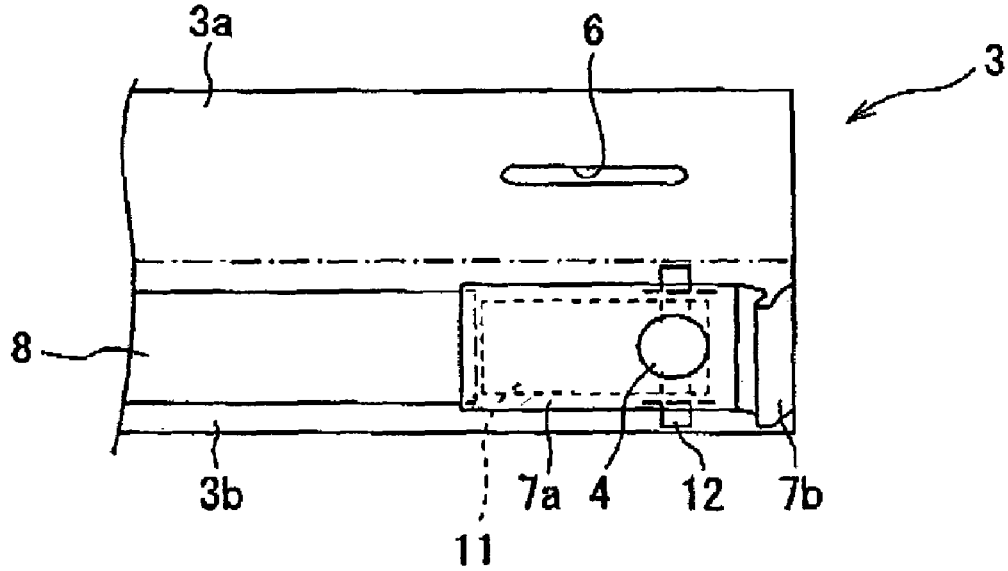
FIG. 4*b* is a drawing showing the neckband opened in the vertical direction, at which the uppermost button is attached, of the shirt having neck size adjusting function according to the second embodiment of the invention, while the elastic material is stretched and elongated.

A second embodiment of the invention is described hereafter referring to FIG. 4*a* and FIG. 4*b*.

FIG. 4*a* is a drawing showing a neckband opened in a vertical direction, at which an uppermost button is attached, of a shirt having neck size adjusting function according to a second embodiment of the invention, while an elastic material is contracted. FIG. 4*b* is a drawing showing the neckband opened in the vertical direction, at which the uppermost button is attached, of the shirt having neck size adjusting function according to the second embodiment of the invention, while the elastic material is stretched and elongated.

A mechanism for moving the uppermost button 4 in the second buttonhole 6 is described referring to FIG. 4*a* and FIG. 4*b*. As shown in FIG. 4*a*, if a leading end portion of the right-hand side of the neckband 3 is opened up and down, it is seen that the second buttonhole 6 is provided on the front cloth 3*a* of the neckband 3. The rubber tape 8 as the elastic material has its left end stitched on the rear cloth 3*b* of the neckband 3. As described above, the padding or lining is sewn on the entire surface of the front cloth 3*a* and the rear cloth 3 for reinforcement. On the other hand, the left end of the padding 7*a* as the moving cloth is stitched on the right end of the rubber tape 8. The lining cloth 7*b* as the stopper is stitched on the right end of the padding 7*a*. The right end of the lining cloth 7*b* is sewn inside the rear cloth 3*b* of the neckband. The uppermost button 4 is sewn firmly on the padding 7*a* with the base-winding, which is firmly wound and fixed around the thread base of the button, with a suitable length. While the button 4 is sewn with the base-winding in the second embodiment, the button 4 may be sewn with a suitable length of base thread.

A horizontal oblong tape 11 has right and left ends stitched on the rear cloth 3*b* of the neckband 3 at a position corresponding to the second buttonhole 6 under the padding 7*a*. A vertical oblong tape 12 is passed between the horizontal oblong tape 11 and the rear cloth 3*b*. Upper and lower ends of the vertical oblong tape 12 are stitched on the rear side of the padding 7*a*. Thus, there is provided a structure that the horizontal oblong tape 11 is held between the moving cloth made of the padding 7*a* and the vertical oblong tape 12. Therefore, the uppermost button 4 can be moved smoothly without swaying up and down when it is buttoned in the second buttonhole 6 of the front cloth 3*a* and moved rightward as shown in FIG. 4*b* against the tensile force of the rubber tape 8 as the elastic material. In FIG. 4*a* and FIG. 4*b*, since the leading end of the neckband 3 has a square shape, the padding 7*a* as the moving cloth has a rectangular shape. However, the leading end of the neckband 3 often has a streamline shape. Therefore, in such case, the padding 7*a* as the moving cloth is made into a round shape according to the shape of the leading end of the neckband 3.

In the second embodiment of the neck-size-adjustable shirt, when the wearer releases both hands from the neckline after loosening hold on the neck portions, if the rubber tape 8 has a strong tensile force, the neck portions return to an original state in which they are made tight by an urging force of the rubber tape 8. In case of using a rubber tape 8 having a weak tensile force such as a net rubber tape, the uppermost button 4 does not return to its original position immediately due to friction with a buttonhole sewing of the second buttonhole 6, since the urging force of the elastic material is weak. Then, the uppermost button 4 returns to its original position very slowly and taking a lot of time with such a motion as cannot be recognized or noticed. Consequently, a wearer can maintain his or her neckline comfortable for a while. As a result, even if the wearer must stay in one position for a long time while attending a funeral or the like, he or she can keep the neckline easy without conspicuous action.

If it is required to make the neckline return to its original tight position immediately by an urging force of the rubber tape 8, it is preferable to set the base winding, which is firmly wound and fixed around a thread base of the button, of the uppermost button 4 long. If it is required to make the neckline return to its original tight position after a long time without conspicuous movement, it is preferable to set friction large between the uppermost button 4 and the buttonhole sewing of the buttonhole 5, while making the base winding of the uppermost button 4 short.

As described above, according to the second embodiment of the neck-size-adjustable shirt, the neckline of the shirt including the formal shirt can be adjusted to a desired length without conspicuous action. If the urging force of the elastic material is selected, the neckline can be returned to the original tight position immediately or keep the loose state of the neckline for a while. There is no imprint or fading effect generated on the collar by the fitting parts or the like. Moreover, the collar does not go up or the fitting parts are not seen from outside. Consequently, the wearer can wear the shirt comfortably for a long time.

Third Embodiment

Figure 5:
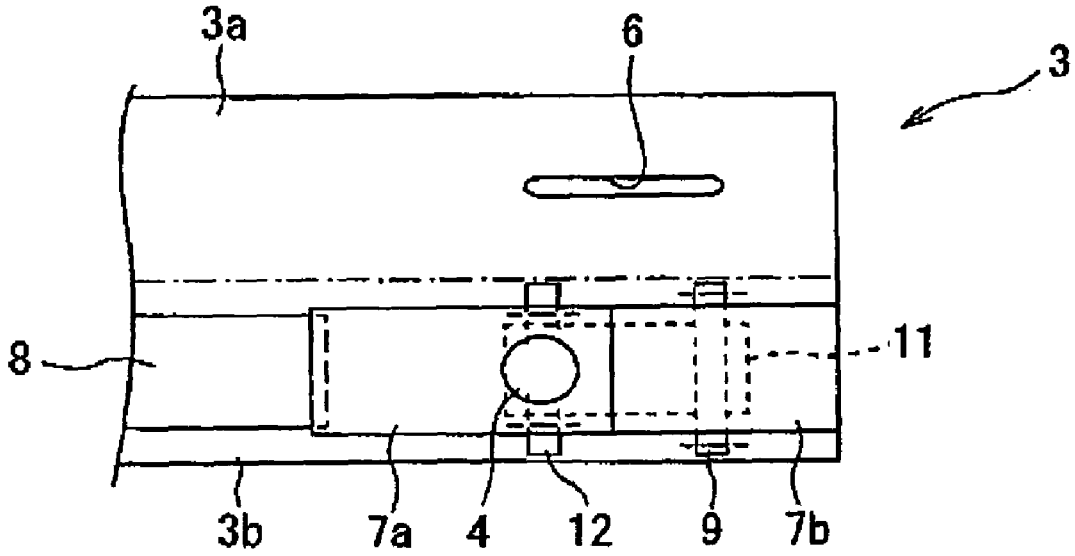
FIG. 5 is a drawing showing a neckband opened in a vertical direction, at which an uppermost button is attached, of a shirt having neck size adjusting function according to a third embodiment of the invention.

A third embodiment of the invention is described hereafter referring to FIG. 5.

FIG. 5 is a drawing showing a neckband opened in a vertical direction, at which an uppermost button is attached, of a shirt having neck size adjusting function according to a third embodiment of the invention.

A mechanism for moving the uppermost button 4 in the second buttonhole 6 is described referring to FIG. 5. The third embodiment has a structure combining the first embodiment and the second embodiment. That is, the horizontal oblong tape 11 has its left end stitched on the rear cloth 3*b*. The vertical oblong tape 12 has the upper and lower ends stitched on the rear side of the padding 7*a* constituting the moving cloth. The horizontal oblong tape 11 is held between the vertical oblong tape 12 and the padding 7*a*. On the other hand, the right end of the horizontal oblong tape 11 is stitched on the rear side of the lining cloth 7*b* constituting the stopper. The vertical tape 9 is passed above the horizontal oblong tape 11 and has the upper and lower ends stitched on the rear cloth 3*b* of the neckband 3. Thus, the vertical tape 9 is held between the horizontal oblong tape 11 and the lining cloth 7*b*.

Therefore, the uppermost button 4 can be moved straightly while more prevented from swaying when it is moved in the second buttonhole 6. Since the friction becomes large when the uppermost button 4 moves, the urging force of the rubber tape 8 is made relatively weak, and the base-winding is made relatively short when the uppermost button 4 is stitched on the padding 7*a* constituting the moving cloth. Thus, the third embodiment is suitable for keeping the state in which the uppermost button 4 is moved at a desired position in the second buttonhole 6 so as to make the neckline comfortable. Moreover, since the moving range of the uppermost button 4 is limited by the two vertical tapes, there is no excessive load applied on the rubber tape 8, so that the life of the rubber tape 8 has a long life.

In FIG. 5, since the leading end of the neckband 3 has a square shape, the padding 7*a* as the moving cloth has a rectangular shape. However, the leading end of the neckband 3 often has a streamline shape. Therefore, in such case, the padding 7*a* as the moving cloth is made into a round shape according to the shape of the leading end of the neckband 3.

As described above, according to the second embodiment of the neck-size-adjustable shirt, the neckline of the shirt including the dress or formal shirt can be adjusted to a desired length without conspicuous action. Moreover, the elastic material can be long lasting. Consequently, the wearer can wear the shirt comfortably for a long time.

Fourth Embodiment

A neck-size-adjustable shirt according to a fourth embodiment of the invention is described hereafter referring to FIG. 6*a*, FIG. 6*b*, FIG. 6*c* and FIG. 7.

Figure 6A:
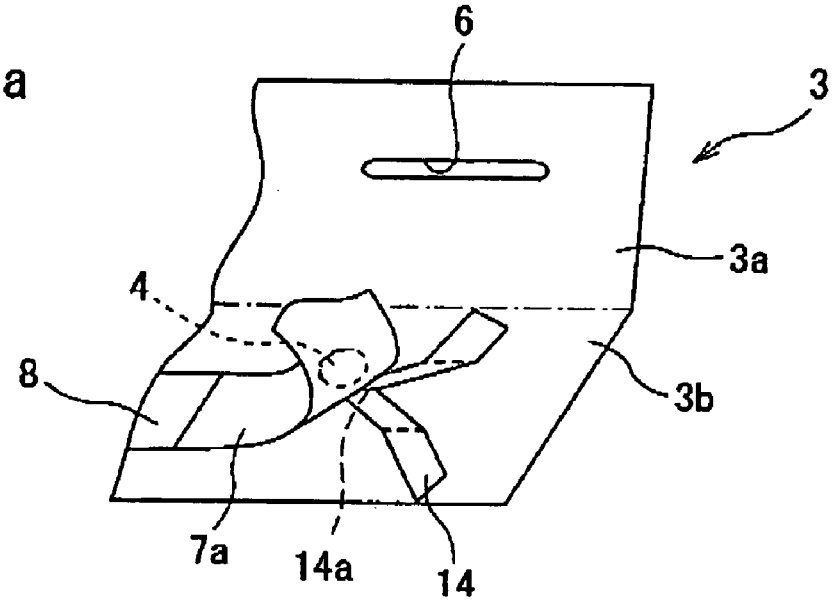
FIG. 6*a* is a drawing showing a neckband opened in a vertical direction, at which an uppermost button is attached, of a shirt having neck size adjusting function according to a fourth embodiment of the invention.
Figure 6B:
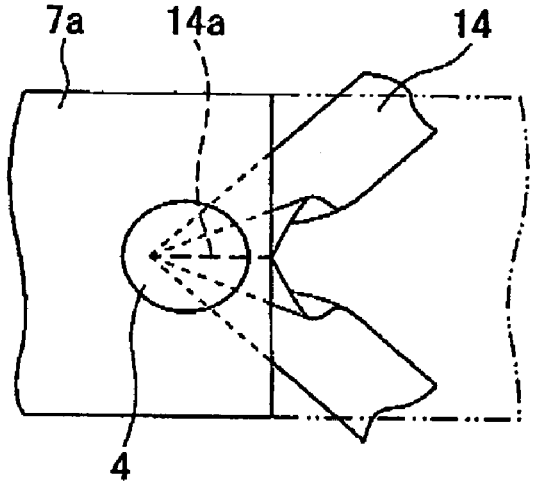
FIG. 6*b* is a drawing enlarging and showing a leading end portion of an angle-shaped tape.
Figure 6C:
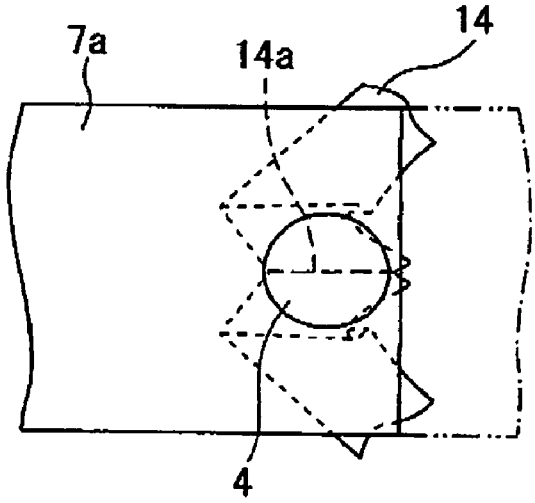
FIG. 6*c* is a drawing enlarging and showing the leading end portion of the angle-shaped tape when the uppermost button is moved.
Figure 7:
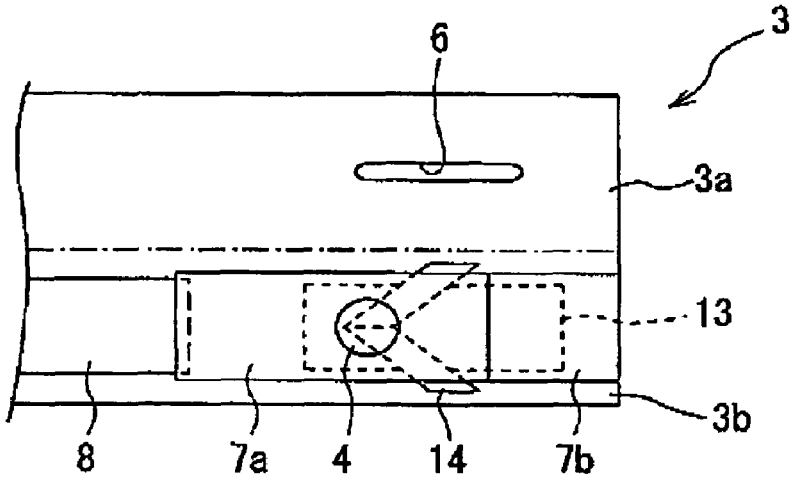
FIG. 7 is a drawing showing a neckband opened in a vertical direction, at which an uppermost button is attached, of a shirt having neck size adjusting function according to a modified example of the fourth embodiment of the invention.

FIG. 6*a* is a drawing showing a neckband opened in a vertical direction, at which an uppermost button is attached, of a shirt having neck size adjusting function according to a fourth embodiment of the invention. FIG. 6*b* is a drawing enlarging and showing a leading end portion of an angle-shaped tape. FIG. 6*c* is a drawing enlarging and showing the leading end portion of the angle-shaped tape when the uppermost button is moved. FIG. 7 is a drawing showing a neckband opened in a vertical direction, at which an uppermost button is attached, of a shirt having neck size adjusting function according to a modified example of the fourth embodiment of the invention.

As shown in FIG. 6*a*, the fourth embodiment of the neck-size-adjustable shirt has a tape 14. The tape 14 is folded into an angle shape with tucks at a center part. The upper and lower end of the tape 14 is stitched on the rear cloth 3*b* of the neckband 3. The padding 7*a* constituting the moving cloth is stitched along a center line of the tape 14. The uppermost button 4 is sewn on the padding 7*a*. The rubber tape 8 as the elastic material is stitched on the left end of the padding 7*a*. As shown by the enlarging view of FIG. 6*b*, the center part that is folded into the angle shape of the tape 14 defines the tucks. If the uppermost button 4 is pulled in such a direction as loosening the neckline, as shown in FIG. 6*c*, the central tucks are extended up and down so as to lessen a play of the tape 14. Therefore, if a force lifting the uppermost button upward is applied to the uppermost button 4, there is hardly generated a so-called "breaking-out" that contents such as the padding 7*a* to which the uppermost button 4 is attached, the tape 14, the rubber tape 8 and so on, go out of the second buttonhole 6.

In the first to the third embodiments described before, the padding 7*a* to which the uppermost button 4 is attached is pressed to the rear cloth 3*b* by the vertical tape or the horizontal tape. Therefore, even if the uppermost button 4 is pulled, the breaking-out hardly takes place. However, even if there is no element pressing the padding 7*a* as in the fourth embodiment, the padding 7*a* is attached on the rear cloth 3*b* by the tape 14 that is folded into the angle shape so as to define the tucks at the center part. Thus, it is possible to prevent the breaking-out from generating.

A structure of a neckband portion of a neck-size-adjustable shirt according to a modified example of the fourth embodiment is described hereafter referring to FIG. 7. As shown in FIG. 7, in the modified example, the padding 7*a* is attached to the rear cloth 3*b* by the tape 14 that is folded into an angle shape with a center part made into tucks. The horizontal oblong tape 13 is passed under the vertical oblong tape 14 and has its both ends stitched respectively on the rear sides of the padding 7*a* and the lining cloth 7*b* constituting the moving cloth and the stopper. Thereby, the tape 14 is held between the horizontal oblong tape 13 and the padding 7*a* and the lining cloth 7*b*. Thus, the uppermost button 4 stitched on the padding 7*a* moves rightward smoothly, while the breaking-out is prevented from taking place more.

In FIG. 7, since the leading end of the neckband 3 has a square shape, the padding 7*a* as the moving cloth has a rectangular shape. However, the leading end of the neckband 3 often has a streamline shape. Therefore, in such case, the padding 7*a* as the moving cloth is made into a round shape according to the shape of the leading end of the neckband 3.

Figure 8A:
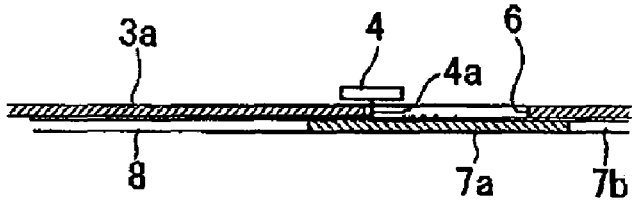
FIG. 8*a*, FIG. 8*b* and FIG. 8*c* show respectively a case in which a breaking out does not take place and a case in which the breaking out takes place.
Figure 8B:
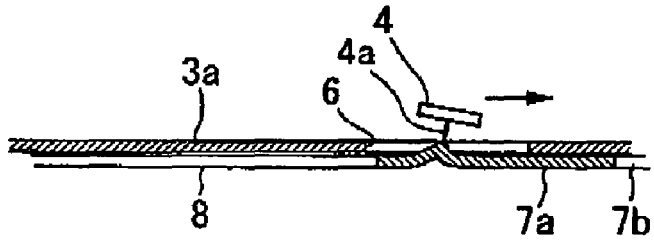
Figure 8C:
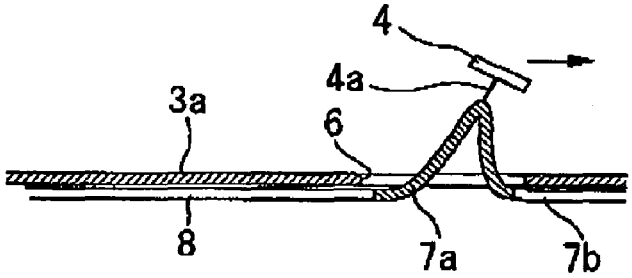

Described hereafter referring to FIG. 8*a*, FIG. 8*b* and FIG. 8*c* are a case in which the breaking-out is generated and a case in which the breaking-out is not generated. FIG. 8*a*, FIG. 8*b* and FIG. 8*c* show respectively a case in which a breaking out does not take place and a case in which the breaking out takes place. In FIG. 8*a*, no tensile force is applied to the elastic material 8 so that the uppermost button 4 is located at a left end of the second buttonhole 6. In FIG. 8*b*, the uppermost button 4 is applied with a tensile force in the right direction (a direction for loosening the neckline) and with a force that pull it upward. Then, even if the force as shown in FIG. 8*b* is applied to the uppermost button 4 from a state as shown in FIG. 8*a*, the padding 7*a* is pressed to the rear cloth 3*b* by the vertical tape or the horizontal tape in each of the above embodiments. Therefore, the breaking-out is hardly generated. In contrast, if there is no countermeasure taken, the breaking-out is generated such as the padding 7*a* is pulled out of the second buttonhole 6, while the elastic material 8 and the lining cloth 7*b* are pulled out, too, as shown in FIG. 8*c*.

Fifth Embodiment

In view of the above, a device is provided for preventing the breaking-out more effectively in a neck-size-adjustable shirt according to a fifth embodiment of the invention. The fifth embodiment is described referring to FIG. 9*a*, FIG. 9*b*, FIG. 9*c* and FIG. 9*d*.

Figure 9A:
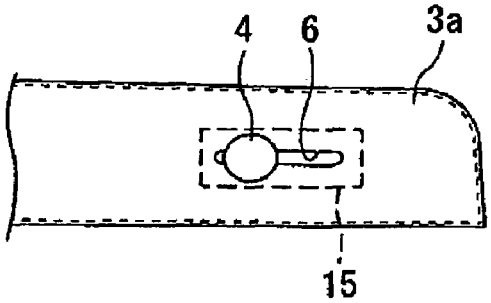
FIG. 9*a* is a drawing showing a leading end portion of a neckband, seen from an upper side, of a shirt having neck size adjusting function according to a fifth embodiment of the invention.
Figure 9B:
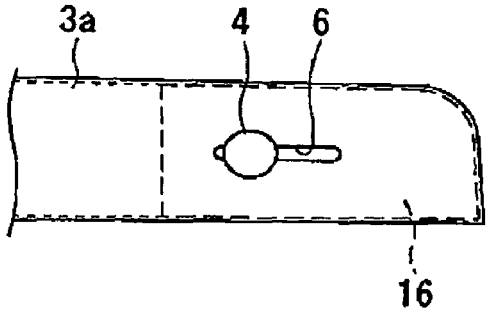
FIG. 9*b* is a drawing showing a leading end portion of a neckband, seen from an upper side, of a shirt having neck size adjusting function according to a first modified example of the fifth embodiment of the invention.
Figure 9C:
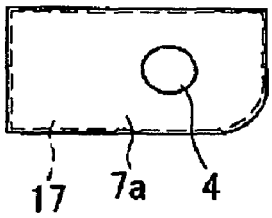
FIG. 9*c* is a drawing showing only a padding taken out from a neckband of a shirt having neck size adjusting function according to a second modified example of the fifth embodiment of the invention.
Figure 9D:
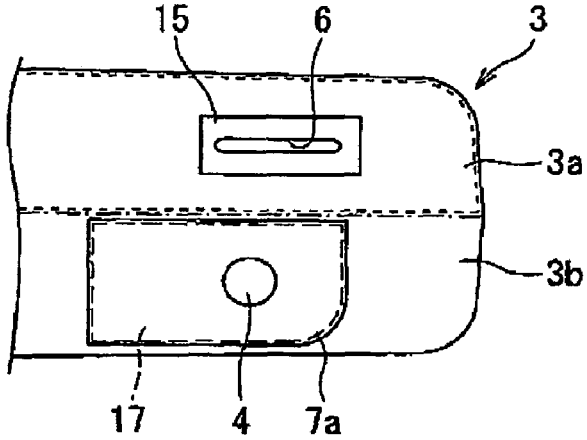
FIG. 9*d* is a drawing showing an opened state of a leading end portion of a neckband of a shirt having neck size adjusting function according to a third modified example of the fifth embodiment of the invention.

FIG. 9*a* is a drawing showing a leading end portion of a neckband, seen from an upper side, of a shirt having neck size adjusting function according to a fifth embodiment of the invention. FIG. 9*b* is a drawing showing a leading end portion of a neckband, seen from an upper side, of a shirt having neck size adjusting function according to a first modified example of the fifth embodiment of the invention. FIG. 9*c* is a drawing showing only a padding taken out from a neckband of a shirt having neck size adjusting function according to a second modified example of the fifth embodiment of the invention. FIG. 9*d* is a drawing showing an opened state of a leading end portion of a neckband of a shirt having neck size adjusting function according to a third modified example of the fifth embodiment of the invention.

As shown in FIG. 9*a*, in the fifth embodiment, a relatively stiff padding 15 is stuck around the second buttonhole 6 of the front cloth 3*a* of the neckband 3 from a rear side. The padding 15 has a slot opened at a portion corresponding to the second buttonhole 6. Thus, even if an upward pulling force is applied on the uppermost button 4, the second buttonhole 6 cannot be deformed freely. Therefore, the padding 7*a* cannot be projected outside from the second buttonhole 6. Consequently, the breaking-out can be prevented effectively.

In a first modified example, as shown in FIG. 9*b*, a relatively stiff padding 16 is stuck on an overall leading end part of the front cloth 3*a* of the neckband 3 from a rear side. The padding 16 has a slot opened at a portion corresponding to the second buttonhole 6. Thus, since the leading end part of the neckband 3 is reinforced by the relatively stiff padding 16 at a side of the second buttonhole 6 as a whole. Thus, the second buttonhole 6 cannot be deformed freely still more. Consequently, the breaking-out is harder to take place.

In a second modified example, as shown in FIG. 9*c*, a relatively stiff padding 17 is stuck on an overall rear side of the padding 7*a* on which the uppermost button 4 is sewn and which constitutes the moving cloth inside the neckband 3. Thus, since stiffness increases at a portion where the padding 7 as the moving cloth is provided. Consequently, the breaking-out is harder to take place. Moreover, the portion where the padding 7*a* as the moving cloth is provided can move more smoothly inside a leading end portion of the neckband 3. Therefore, there is provided an advantageous effect at the same time that the neckline can be adjusted with less force.

In a third modified example, as shown in FIG. 9*d*, the relatively stiff padding 15 is stuck around the second buttonhole 6 of the front cloth 3*a* of the neckband 3 from a rear side. The padding 15 has the slot opened at the portion corresponding to the second buttonhole 6. Moreover, the relatively stiff padding 17 is stuck on the overall rear side of the padding 7*a* on which the uppermost button 4 is sewn and which constitutes the moving cloth inside the neckband 3. In FIG. 9*d*, the left rubber tape 8 of the padding 7*a* and the right lining cloth 7*b* are omitted from illustration. Therefore, the breaking-out can be prevented perfectly by synergy of the fifth embodiment and the second modified example.

A thin heat-resistant plastic plate may be used in place of the relatively stiff padding 15, 16, 17 in the fifth embodiment and the modified examples. The heat-resistant plastic means a plastic material that is not softened up to about 200° C. in a narrow sense. Such material can be used instead of the relatively stiff padding 15, 16, 17 even for a dress shirt made of cotton that has a highest temperature (about 200° C.) for ironing.

Sixth Embodiment

Figure 10:
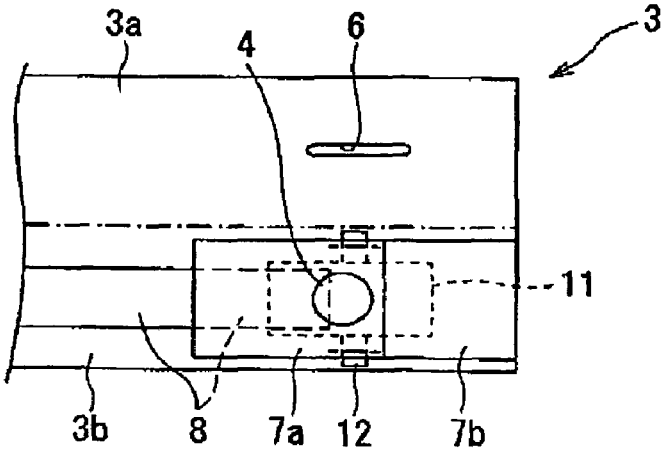
FIG. 10 is a drawing showing a neckband opened in a vertical direction, at which an uppermost button is attached, of a shirt having neck size adjusting function according to a sixth embodiment of the invention.

A neck-size-adjustable shirt according to a sixth embodiment of the invention is described hereafter referring to FIG. 10.

FIG. 10 is a drawing showing a neckband opened in a vertical direction, at which an uppermost button is attached, of a shirt having neck size adjusting function according to a sixth embodiment of the invention.

As shown in FIG. 10, in the neck-size-adjustable shirt according to the sixth embodiment, the rubber tape 8 as the elastic material is sewn on a deep side of the padding 7*a* constituting the moving cloth. The horizontal oblong tape 11 has the opposite ends stitched on the rear cloth 3*b* at a position of the second buttonhole 6 with an interval longer than the second buttonhole 6. The vertical oblong tape 12 is passed under the horizontal oblong tape 11. The vertical oblong tape 12 has the upper and lower ends stitched on the padding 7*a* so that the moving cloth 7*a* and the stopper 7*b* are capable of sliding in a horizontal direction.

As described above, the rubber tape 8 is inserted into the deep inside of the padding 7*a*, so that a mechanism for moving the uppermost button 4 is made shorter. Consequently, the mechanism becomes inconspicuous, thereby providing an advantageous effect that the shirt appears exactly the same as a normal dress shirt. In FIG. 10, since the leading end of the neckband 3 has a square shape, the padding 7*a* as the moving cloth has a rectangular shape. However, the leading end of the neckband 3 often has a streamline shape. Therefore, in such case, the padding 7*a* as the moving cloth is made into a round shape according to the shape of the leading end of the neckband 3.

As described above, according to the sixth embodiment of the neck-size-adjustable shirt, the neckline of the shirt including the dress shirt can be adjusted to a desired length without conspicuous action. Moreover, it has an appearance same as the normal shirt and the wearer can wear the shirt comfortably for a long time.

As described above, in the neck-size-adjustable shirt according to each of the embodiments, if the rubber tape 8 as the elastic material is a strong one and the base-winding, which is firmly wound and fixed around a thread base of the button, of the uppermost button 4 is made relatively long, the wearer can let the air in the shirt by loosening the neckline by fingers. Moreover, if the wearer lets his or her hands go of it, the neckline returns at once to its original state in which it fits tightly around the neckline. Furthermore, if the rubber tape 8 is made of one having a weak elasticity and the base-winding of the uppermost button 4 is made relatively short, the neckline does not return to it original position immediately if he or she moves the uppermost button 4 to a desired position and releases it. Thus, the wearer can keep the neckline comfortable.

Figure 11A:
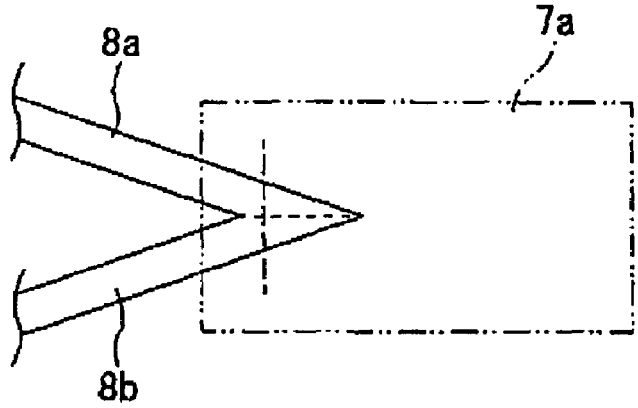
FIG. 11*a* and FIG. 11*b* are drawings respectively showing two elastic materials stitched to a padding 7*a* to which an uppermost button 4 is attached.
Figure 11B:
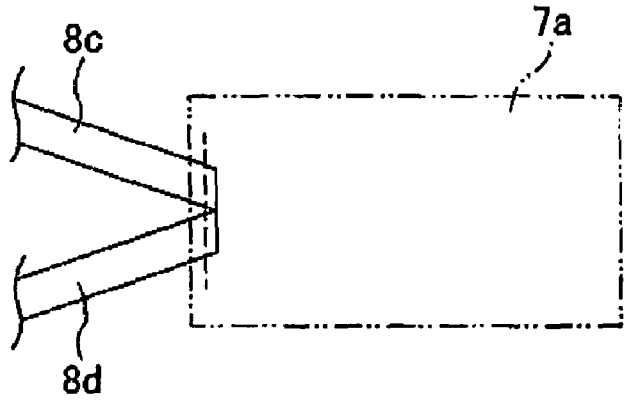

Described hereafter referring to FIG. 11*a* and 11*b* is a method of making the elastic material strong in order to enable the shirt to always keep a just-fit state. FIG. 11*a* and FIG. 11*b* are drawings respectively showing two elastic materials stitched to a padding 7*a* to which an uppermost button 4 is attached.

As shown in FIG. 11*a* and FIG. 11*b*, rubber tapes 8*a* and 8*b* or rubber tapes 8*c* and 8*d* are combined in a V-shape. The rubber tapes 8*a* and 8*b* or 8*c* and 8*d* are stitched on the left end of the padding 7*a* for attaching the uppermost button 4. Left ends (not shown) of the rubber tape 8*a* and 8*b* or 8*c* and 8*d* are stitched on the rear cloth 3*b*. Thus, the two rubber tapes 8*a* and 8*b* or 8*c* and 8*d* gives stronger elastic force. Consequently, the neckline returns immediately to the original state in which it fits around the neckline, when the wearer loosens the neckline and let the air in by the fingers and releases the neckline thereafter.

Seventh Embodiment

A neck-size-adjustable shirt according to a seventh embodiment of the invention is described hereafter referring to FIG. 12.

Figure 12A:
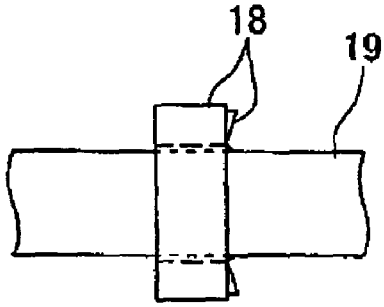
FIG. 12*a* is a drawing showing a mechanism for moving a uppermost button of a shirt having neck size adjusting function according to a seventh embodiment of the invention.
Figure 12B:
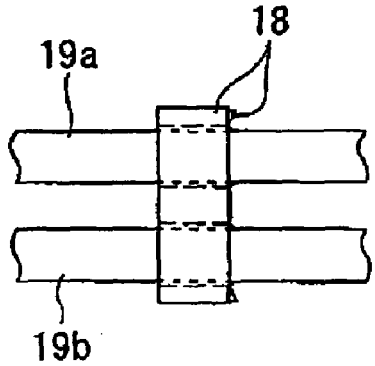
FIG. 12*b* is a drawing showing a mechanism for moving a uppermost button of a shirt having neck size adjusting function according to a modified example of the seventh embodiment of the invention.

FIG. 12*a* is a drawing showing a mechanism for moving a uppermost button of a shirt having neck size adjusting function according to a seventh embodiment of the invention. FIG. 12*b* is a drawing showing a mechanism for moving a uppermost button of a shirt having neck size adjusting function according to a modified example of the seventh embodiment of the invention.

As shown in FIG. 12*a*, the neck-size-adjustable shirt according to the seventh embodiment does not use an elastic material. A wide horizontal tape 19 has opposite ends stitched on the rear cloth 3*b* of the neckband 3 with an interval not less than a moving stroke, i.e. the length of the second buttonhole 6. Two vertical tapes 18 hold the horizontal tape 19 therebetween from its front and rear sides and are stitched at positions very near the upper and lower edge of the horizontal tape 19. Thus, the vertical tape 18 is movable along the horizontal tape 19. The uppermost button 4 is sewn on a front side one of the two vertical tapes 18 so as to be brought out from the second button hole 6 (not shown). Thereby, friction between the two vertical tapes 18 and the horizontal tape 19 becomes large, so that the uppermost button 4 is hard to be displaced from a position where it is moved just before. Moreover, since the elastic material is not used, the structure becomes simple thereby lowering costs.

In a neck-size-adjustable shirt according to a modified example of the seventh embodiment, as shown in FIG. 12*b*, two horizontal tapes 19*a* and 19*b* are used. They are extended parallel and have their opposite ends stitched on the rear cloth 3*b* of the neckband 3. The two vertical tapes 18 hold the horizontal tapes 19*a* and 19*b* therebetween from its front and rear sides and are stitched at positions very near the upper and lower edge of the horizontal tapes 19*a* and 19*b*. Thus, the vertical tapes 18 are movable along the two horizontal tapes 19*a* and 19*b*. The uppermost button 4 is sewn on a front side of one of the two vertical tapes 18 so as to be brought out from the second button hole 6 (not shown). Thereby, friction between the two vertical tapes and the two horizontal tapes becomes larger, so that the uppermost button 4 is harder to be displaced from a position where it is moved just before.

As described above, according to the seventh embodiment of the neck-size-adjustable shirt, the neckline of the shirt including the dress shirt can be adjusted to a desired length without conspicuous action. Moreover, the structure becomes simple thereby lowering costs and the wearer can wear the shirt comfortably for a long time.

In the seventh embodiment and the modified example thereof, the opposite ends of the horizontal tape 19, 19*a*, 19*b* are stitched on the rear cloth 3*b* of the neckband 3. However, they may be stitched only on a lining of the rear cloth 3*b*. In this case, a sewing thread is never shown at the front side of the rear cloth 3*b*. Consequently, the neck-size-adjustable shirt becomes exactly the same as the normal shirt in appearance and has very good appearance.

Eighth Embodiment

Figure 13A:
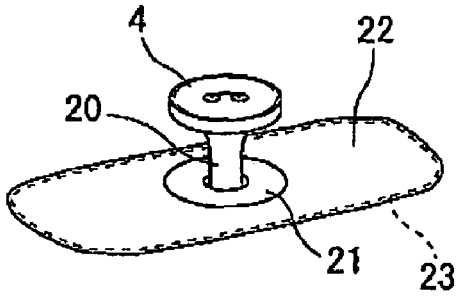
FIG. 13*a* is a drawing showing a mechanism for moving a uppermost button of a shirt having neck size adjusting function according to an eighth embodiment of the invention.
Figure 13B:
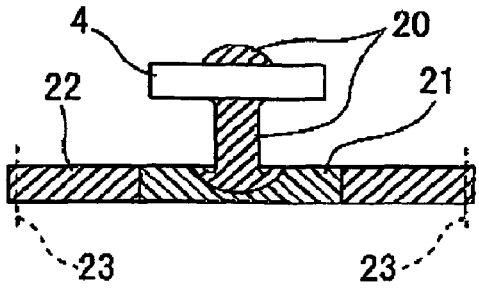
FIG. 13*b* is a cross sectional view of FIG. 13*a*.

A neck-size-adjustable shirt according to an eighth embodiment of the invention is described hereafter referring to FIG. 13*a* and FIG. 13*b*.

FIG. 13*a* is a drawing showing a mechanism for moving a uppermost button of a shirt having neck size adjusting function according to an eighth embodiment of the invention. FIG. 13*b* is a cross sectional view of FIG. 13*a*.

As shown in FIG. 13*a*, in the neck-size-adjustable shirt according to the eighth embodiment, the uppermost button 4 is not sewn on the padding by a thread but attached to a leading end of a bar-shaped elastomer 20. A lower end of the bar-shaped elastomer 20 is stuck by adhesion to a circular plastic plate 21. A circumference of the circular plastic plate 21 is covered by an elastomer plate 22 of substantially a rectangular shape corresponding to a length of the second buttonhole 6 (not shown). As shown in FIG. 13*b*, the elastomer plate 22 is stitched on the rear cloth 3*b* of the neckband 3 by a sewing thread 23 along the circumference thereof.

With such structure, the uppermost button 4 can be moved in a neckline direction inside the second buttonhole 6 by a force in deforming the elastomer plate 22. If the force is stopped from being applied, the uppermost button 4 returns to its original position at once by an elastic force of the elastomer plate 22.

As described above, according to the eighth embodiment of the neck-size-adjustable shirt, the neckline of the shirt including the dress shirt can be adjusted to a desired length without conspicuous action. Moreover, the neckline returns to its original tight state if the wearer releases it so as to keep just-fit state.

Ninth Embodiment

Figure 14:
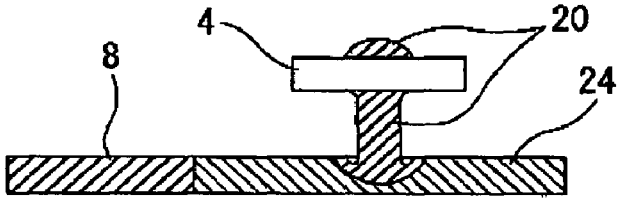
FIG. 14 is a cross sectional view showing a mechanism for moving a uppermost button of a shirt having neck size adjusting function according to a ninth embodiment of the invention.

A neck-size-adjustable shirt according to a ninth embodiment of the invention is described hereafter referring to FIG. 14.

FIG. 14 is a cross sectional view showing a mechanism for moving a uppermost button of a shirt having neck size adjusting function according to a ninth embodiment of the invention.

As shown in FIG. 14, in the neck-size-adjustable shirt according to the ninth embodiment, the uppermost button 4 is not sewn on the padding by a thread but attached to the leading end of the bar-shaped elastomer 20, too. The lower end of the bar-shaped elastomer 20 is stuck by adhesion to a substantially rectangular plastic plate 24. The rubber tape 8 as the elastic material is stuck by adhesion on a side surface of the substantially rectangular plastic plate 24. The left end of the rubber tape 8 is stitched on the rear cloth 3*b* of the neckband 3.

With such structure, the uppermost button 4 can be moved in a neckline direction inside the second buttonhole 6 by a stretching force of the rubber tape 8. If the force is stopped from being applied, the uppermost button 4 return to its original position by the stretching force of the rubber tape 8.

As described above, according to the ninth embodiment of the neck-size-adjustable shirt, the neckline of the shirt including the dress shirt can be adjusted to a desired length without conspicuous action. Moreover, the neckline returns to its original tight state if the wearer releases it so as to keep just-fit state.

Tenth Embodiment

Figure 15:
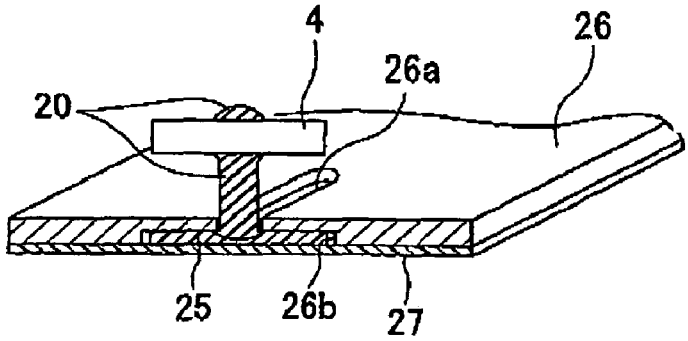
FIG. 15 is a perspective view with a cross section showing a mechanism for moving a uppermost button of a shirt having neck size adjusting function according to a tenth embodiment of the invention.

A neck-size-adjustable shirt according to a tenth embodiment of the invention is described hereafter referring to FIG. 15.

FIG. 15 is a perspective view with a cross section showing a mechanism for moving a uppermost button of a shirt having neck size adjusting function according to a tenth embodiment of the invention.

As shown in FIG. 15, in the neck-size-adjustable shirt according to the tenth embodiment, the uppermost button 4 is not sewn on the padding by a thread but attached to the leading end of the bar-shaped elastomer 20, too. The lower end of the bar-shaped elastomer 20 is stuck by adhesion to a small thin plastic plate 24 of substantially a square shape. The plastic plate 25 is covered by a guide plate 26. The guide plate 26 has a slot-shaped groove 26*a* along which the bar-shaped elastomer 20 is slidable and a rectangular groove 26*b* along which the small thin plastic plate 25 of substantially a square shape is slidable in the same direction as the bar-shaped elastomer 20. A thin and heavy-duty plastic plate 27 is stuck on a rear side of the guide plate 26.

With such structure, if it is fitted inside the neckband 3 while taking a sliding direction same as a longitudinal direction of the second buttonhole 6, the uppermost button 4 can slide inside the second buttonhole 6. Consequently, it can be stopped at a desired position by friction between a lower end portion of the short bar-shaped elastomer 20 and the slot-shaped groove 26*a*.

As described above, according to the tenth embodiment of the neck-size-adjustable shirt, the neckline of the shirt including the dress shirt can be adjusted to a desired length without conspicuous action, so that the shirt can be worn comfortably for a long time.

Eleventh Embodiment

A neck-size-adjustable shirt according to an eleventh embodiment of the invention is described hereafter. In the neck-size-adjustable shirt according to the eleventh embodiment, a heat-resistant plastic plate is used instead of the padding 7*a* as the moving cloth. Specifically, a polyethylene terephthalate (PET) plate is cut into substantially a same size as the padding 7*a*. Then, the uppermost button 4 is sewn on the plate. The rubber tape 8 is stitched on one end. The lining cloth 7*b* as the stopper is stitched on the other end. The other ends of the rubber tape 8 and the lining cloth 7*b* are stitched respectively in the same way as each of the above embodiments.

The polyethylene terephthalate has a softening point of about 260° C. and well endures ironing of about 200° C. Moreover, if it not a thick plate, it can be sewn by a sewing machine. Therefore, the uppermost button 4 can be sewn by a hand sewing needle or a button sewing machine. In consideration of mass production, it is preferable to form two or more small holes on the PET plate at a position for attaching the uppermost button 4. In this case, the hand sewing needle and the sewing machine needle can be passed easily, the needle is hard to be bent, the needlepoint is hard to be worn down and the needlepoint is hard to be broken.

The PET plate has a moderate stiffness, so that the breaking-out does not take place without any vertical tape or horizontal tape for preventing the breaking-out. If minute irregularities are formed on a front surface of the PET plate, the light is not reflected on the front surface of the PET plate even if the front surface of the PET plate is seen from the second buttonhole 6. Consequently, it does not give any uncomfortable feeling in appearance. Moreover, if the PET plate is covered by a cloth, the PET plate becomes hard to be bent even if it is thin. Furthermore, such PET plate does not reflect the light without any irregularities on the front surface. Consequently, it does not give any uncomfortable feeling in appearance.

As described above, in the neck-size-adjustable shirt according to the eleventh embodiment, the heat-resistant plastic plate is used in place of the moving cloth, so that the breaking-out can be prevented without special device. While the eleventh embodiment shows an example in which PET is used as the heat-resistant plastic, other plastic materials may be used such as polyvinylidene chloride having a softening point of 185° C. to 200° C., a copolymer of polyvinylidene chloride and polyvinyl chloride (PVC).

The heat-resistance plastic in a broad sense includes a plastic material having a lowest softening temperature such as about 100° C. to 180° C. The dress shirt or the like made of polyester is ironed at a low temperature such as about 160° C. to 180° C. Moreover, the heat-resistant plastic is not directly ironed but indirectly heated via a cloth. Therefore, the temperature applied to the heat-resistant plastic is thought to be much lower. Accordingly, the polyvinyl chloride (PVC) may be used depending on a kind or a thickness of the cloth of the shirt.

Twelfth Embodiment

Figure 16:
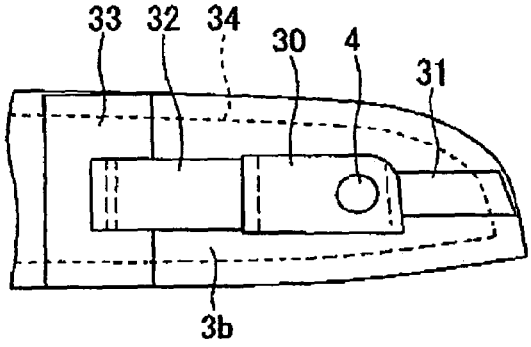
FIG. 16 is a drawing showing an internal structure of a neckband of a shirt having neck size adjusting function according to a twelfth embodiment of the invention.

A neck-size-adjustable shirt according to a twelfth embodiment of the invention is described hereafter referring to FIG. 16.

FIG. 16 is a drawing showing an internal structure of a neckband of a shirt having neck size adjusting function according to a twelfth embodiment of the invention. The neck-size-adjustable shirt according to the twelfth embodiment is structured such that a stitch for sewing an elastic material on a rear cloth of a neckband is not seen from outside.

Specifically, as shown in FIG. 16, the uppermost button 4 is firmly sewn on a moving cloth 30 with a moderate length of a base-winding. A cloth tape 31 as a stopper having no elasticity is stitched on a right end of the moving cloth 30. A rubber tape 32 as an elastic material is stitched on a left end of the moving cloth 30. While the button 4 is sewn with the base-winding in the twelfth embodiment, the button 4 may be sewn with a moderate length of a thread base. A left end of the rubber tape 32 is firmly sewn on a Vilene padding 33 (non-woven cloth) as a padding material having substantially a same length as a width of the rear cloth 3*b* of the neckband. The Vilene cloth 33 is stuck on the rear cloth 3*b* of the neckband via an adhesive.

The rear cloth 3*b* of the neckband is stitched together on a front cloth (not shown) by a stitching thread 34. Thus, a right end of the cloth tape 31 as the stopper having no elasticity and upper and lower ends of the Vilene padding as the padding material are both stitched so as to finish a moving mechanism of the uppermost button 4. The left end of the rubber tape 32 as the elastic material is stitched on the Vilene padding 33, so that no seam or stitch penetrates the rear cloth 3*b* of the neckband. Therefore, the seam of he rubber tape 32 is not seen from a front side of the neck-size-adjustable shirt in any way. Consequently, the appearance improves very much.

Thirteenth Embodiment

A neck-size-adjustable shirt according to a thirteenth embodiment of the invention is described hereafter referring to FIG. 17*a*, FIG. 17*b*, FIG. 17*c* and FIG. 17*d*.

Figure 17A:
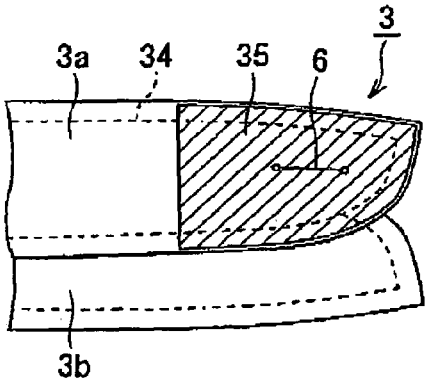
FIG. 17*a* is a drawing showing an internal structure of a neckband of a shirt having neck size adjusting function according to a thirteenth embodiment of the invention.
Figure 17B:
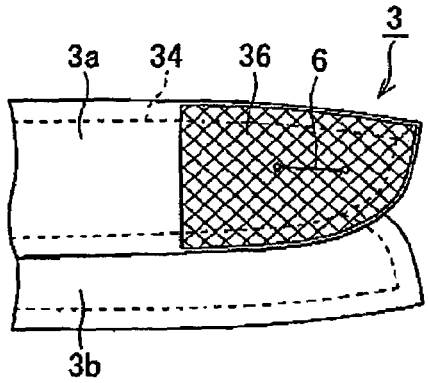
FIG. 17*b* is a drawing showing an internal structure of a neckband of a shirt having neck size adjusting function according to a first modified example of the thirteenth embodiment of the invention.
Figure 17C:
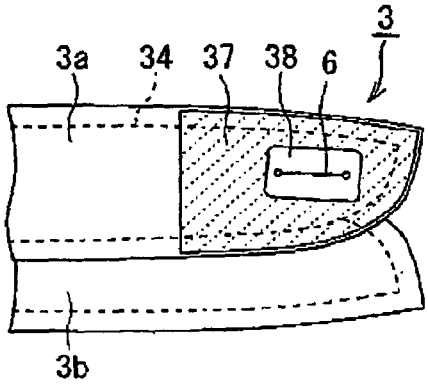
FIG. 17*c* is a drawing showing an internal structure of a neckband of a shirt having neck size adjusting function according to a second modified example of the thirteenth embodiment of the invention.
Figure 17D:
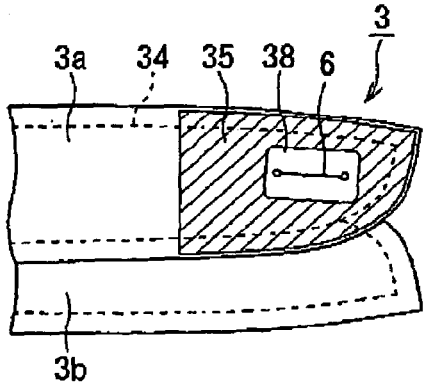
FIG. 17*d* is a drawing showing an internal structure of a neckband of a shirt having neck size adjusting function according to a third modified example of the thirteenth embodiment of the invention.

FIG. 17*a* is a drawing showing an internal structure of a neckband of a shirt having neck size adjusting function according to a thirteenth embodiment of the invention. FIG. 17*b* is a drawing showing an internal structure of a neckband of a shirt having neck size adjusting function according to a first modified example of the thirteenth embodiment of the invention. FIG. 17*c* is a drawing showing an internal structure of a neckband of a shirt having neck size adjusting function according to a second modified example of the thirteenth embodiment of the invention. FIG. 17*d* is a drawing showing an internal structure of a neckband of a shirt having neck size adjusting function according to a third modified example of the thirteenth embodiment of the invention.

As shown in FIG. 17*a*, in the neck-size-adjustable shirt according to the thirteenth embodiment, a soft padding 35 as a relatively stiff padding is stuck by an adhesive on an entire surface of a leading end portion of the front cloth 3*a* of the neckband 3. The second buttonhole 6 is provided on a center part of the soft padding 35 so as to penetrate even the front cloth 3*a* of the neckband 3. A moving mechanism of the uppermost button 4 (not shown) is provided on the rear cloth 3*b* of the neckband 3. The uppermost button 4 is firmly sewn on the moving cloth or the like with a moderate length of a base-winding or a thread base. The uppermost button 4 is put outside through the second buttonhole 6. The rear cloth 3*b* of the neckband 3 is stitched together on the front cloth 3*a* by the stitching thread 34. Thus, the soft padding 35 is also stitched thereon, so that the soft padding 35 is surely prevented from coming off and keeps its shape better for ever if it is washed repeatedly.

Thereby, the leading end portion of the neckband is reinforced at the side of the second buttonhole 6 as a whole by the soft padding 35 as the relatively stiff padding. Thus, the second buttonhole 6 cannot be deformed freely, so that breaking-out is harder to take place. Moreover, the leading end portion of the neckband 3 is given a tension so as to increase friction with the moving cloth or the like. Therefore, the uppermost button 4 can be buttoned or secured at a desired position in the second buttonhole 6. Moreover, there are no rucks or wrinkles or bend generated at a moving area of the moving cloth or the like. Consequently, the moving cloth or the like can be moved smoothly. The uppermost button 4 can be secured at a desired position in the second buttonhole 6. Instead, it is possible that the button 4 becomes harder to return to an original position. Therefore, it is necessary to make adjustment such that the uppermost button 4 is capable of being secured at a desired position and returning smoothly by selecting a kind of the moving cloth or the like and a strength of the elastic material. The moving cloth may be one which has a relatively stiff padding stitched on a rear side of the moving cloth. Alternately, it may be a heat-resistant plastic plate, a moving cloth made by laser cutting or heat cutting or the like.

If the neck-size-adjustable shirt according to the thirteenth embodiment is worn by buttoning the uppermost button 4 (not shown) in the second buttonhole 6 on a normal buttonhole 5 of an outer fold of the neckband (not shown), an inner fold side of the neckband is bent into an angle shape and given a round shape as shown in FIG. 1*b*. Then, as shown in FIG. 17*a*, a space formed by stitching together the front cloth 3*a* and the rear cloth 3*b* of the inner fold of the neckband becomes small. Thus, friction with the moving cloth or the like increases, so that the uppermost button 4 can be secured at a desired position when spreading the neck.

The "moving cloth made by laser cutting or heat cutting" means one that is made by sticking a cloth on a relatively stiff padding by adhesion and cutting it into a shape of the moving cloth by the laser cutting or the heat cutting. Thereby, the moving cloth has its circumference hardened by heat of the laser cutting or the heat cutting. Consequently, there are obtained advantages that the moving cloth never comes apart at the circumference, that a step for sewing by a sewing machine can be omitted for making a moving cloth and that a thickness of the moving cloth can be lessened.

A neck-size-adjustable shirt according to a first modified example of the thirteenth embodiment of the invention is described hereafter referring to FIG. 17*b*. As shown in FIG. 17*b*, the first modified example of the thirteenth embodiment is different in that it uses a hard padding 36 as a relatively stiff padding instead of the soft padding 35 in FIG. 17*a*. Other structure is the same. As such, it is possible to adjust a returning action of the uppermost button 4 by changing a kind of the relatively stiff padding.

If the neck-size-adjustable shirt according to the first modified example is worn by buttoning the uppermost button 4 (not shown) in the second buttonhole 6 on a normal buttonhole 5 of an outer fold of the neckband (not shown), an inner fold side of the neckband is bent into an angle shape and given a round shape as shown in FIG. 1*b*. Then, as shown in FIG. 17*b*, a space formed by stitching together the front cloth 3*a* and the rear cloth 3*b* of the inner fold of the neckband becomes small. Thus, friction with the moving cloth or the like increases, so that the uppermost button 4 can be secured at a desired position when spreading the neck.

A neck-size-adjustable shirt according to a second modified example of the thirteenth embodiment of the invention is described hereafter referring to FIG. 17*c*. As shown in FIG. 17*c*, the second modified example of the thirteenth embodiment uses a Vilene padding 37 as a relatively stiff padding instead of the soft padding 35. Moreover, a hard padding 38 is overlapped and stuck only around a circumference of the second buttonhole 6. The "Vilene padding" means a padding of a non-woven cloth such as a polyester or a nylon. There are Vilene paddings of various thicknesses. The second modified example of the thirteenth embodiment uses a thin and soft one so as to reinforce softly the leading end portion of the neckband 3 entirely at the side of the second buttonhole 6 by the Vilene padding 37 as the relatively stiff padding. On the other hand, it reinforces stiffly only a circumferential portion around the second buttonhole 6 by the hard padding 38. Thus, the returning action of the uppermost button 4 can be adjusted and the breaking-out can be surely prevented.

If the neck-size-adjustable shirt according to the second modified example is worn by buttoning the uppermost button 4 (not shown) in the second buttonhole 6 on a normal buttonhole 5 of an outer fold of the neckband (not shown), an inner fold side of the neckband is bent into an angle shape and given a round shape as shown in FIG. 1*b*. Then, as shown in FIG. 17*c*, a space formed by stitching together the front cloth 3*a* and the rear cloth 3*b* of the inner fold of the neckband becomes small. Thus, friction with the moving cloth or the like increases, so that the uppermost button 4 can be secured at a desired position when spreading the neck.

A neck-size-adjustable shirt according to a third modified example of the thirteenth embodiment of the invention is described hereafter referring to FIG. 17*d*. As shown in FIG.

17*d*, in the third modified example of the thirteenth embodiment, the hard padding 38 is overlapped and stuck only around a circumference of the second buttonhole 6 over the soft padding 35 shown in FIG. 17*a*. Thus, the leading end portion of the neckband 3 is reinforced entirely at the side of the second buttonhole 6 in a state stiffer than the Vilene padding 37 but softer than the hard padding 36. Moreover, only a circumferential portion around the second buttonhole 6 is reinforced relatively stiffly by the hard padding 38. Thus, the returning action of the uppermost button 4 can be adjusted and the breaking-out can be surely prevented.

If the neck-size-adjustable shirt according to the second modified example is worn by buttoning the uppermost button 4 (not shown) in the second buttonhole 6 on a normal buttonhole 5 of an outer fold of the neckband (not shown), an inner fold side of the neckband is bent into an angle shape and given a round shape as shown in FIG. 1*b*. Then, as shown in FIG. 17*c*, a space formed by stitching together the front cloth 3*a* and the rear cloth 3*b* of the inner fold of the neckband becomes small. Thus, friction with the moving cloth or the like increases, so that the uppermost button 4 can be secured at a desired position when spreading the neck.

Fourteenth Embodiment

A neck-size-adjustable shirt according to a fourteenth embodiment of the invention is described hereafter referring to FIG. 18 to FIG. 20.

Figure 18A:
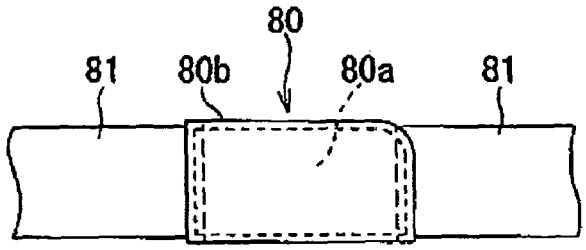
FIG. 18*a* is a drawing showing a structure of a moving cloth and a structure of an elastic body and a stopper of a shirt having neck adjusting function according to a fourteenth embodiment of the invention.
Figure 18B:
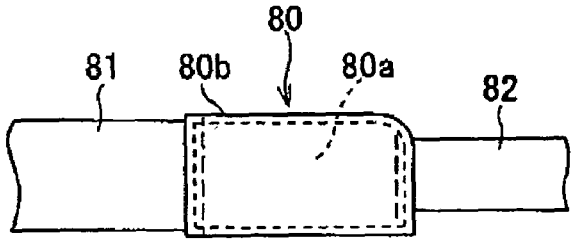
FIG. 18*b* is a drawing showing a structure of a moving cloth and a structure of an elastic body and a stopper of a shirt having neck adjusting function according to a first modified example of the fourteenth embodiment of the invention.
Figure 18C:
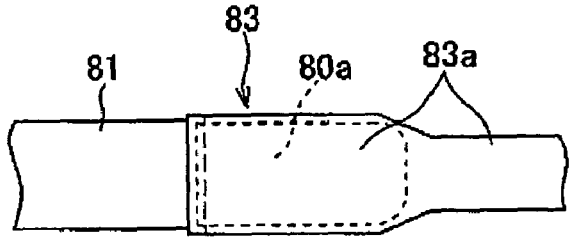
FIG. 18*c* is a drawing showing a structure of a moving cloth and a structure of an elastic body and a stopper of a shirt having neck adjusting function according to a second modified example of the fourteenth embodiment of the invention.

FIG. 18*a* is a drawing showing a structure of a moving cloth and a structure of an elastic body and a stopper of a shirt having neck adjusting function according to a fourteenth embodiment of the invention. FIG. 18*b* is a drawing showing a structure of a moving cloth and a structure of an elastic body and a stopper of a shirt having neck adjusting function according to a first modified example of the fourteenth embodiment of the invention. FIG. 18*c* is a drawing showing a structure of a moving cloth and a structure of an elastic body and a stopper of a shirt having neck adjusting function according to a second modified example of the fourteenth embodiment of the invention. FIG. 19*a*, FIG. 19*b*, FIG. 19*c* and FIG. 19*d* are drawings respectively showing a variety of methods for wrapping a padding of the moving cloth in a fabric of the shirt having neck size adjusting function according the fourteenth embodiment of the invention. FIG. 20*a*, FIG. 20*b* and FIG. 20*c* are drawings respectively showing steps for placing a padding on an elastic material and wrapping it in a fabric in a moving cloth of a shirt having neck size adjusting function according to a third modified example of the fourteenth embodiment of the invention.

As shown in FIG. 18*a*, in the neck-size-adjustable shirt according to the fourteenth embodiment, a moving cloth 80 has a padding 80*a* covered by a cloth 80*b* that is a same fabric as a fabric of the shirt, while having a circumference thereof stitched by a thread. The above described Vilene padding, an Inver padding or the like may be used as the padding 80*a*. In the fourteenth embodiment, power nets 81 as an elastic material are sewn respectively on opposite ends of the moving cloth 80. Thus, a right power net 81 serves as a stopper.

The moving cloth 80 is constituted by covering the padding 80*a* with the cloth 80*b* of the same fabric as the shirt. This is because, if the relatively stiff padding 35, 36 is stuck for reinforcement on the leading end portion of the neckband 3 at the side of the second buttonhole 6, these relatively stiff padding 35, 36 has large irregularities on the front surface. Therefore, if the one having the padding 80*a* covered with the cloth 80*b* is used as the moving cloth 80 that is in friction with the front surface of the relatively stiff padding 35, 36 according to a movement of the uppermost button, a right friction force is generated between small irregularities of the cloth 80*b* and the large irregularities at the front surface of the relatively stiff padding 35, 36. Consequently, the moving cloth can be stopped at or move to an appropriate position of the second buttonhole 6.

FIG. 18*b* shows a first modified example of a method of fitting the moving cloth 80 of the neck-size-adjustable shirt according to the fourteenth embodiment. The moving cloth 80 has the padding 80*a* covered by the cloth 80*b* that is the same fabric as the fabric of the shirt, while having the circumference thereof stitched by the thread. The power net 81 as the elastic material is attached to the left end of the moving cloth 80. A cloth tape 82 as a stopper having no elasticity is stitched on the right end of the moving cloth 80. FIG. 18*c* shows a second modified example of a method of fitting a moving cloth of the neck-size-adjustable shirt according to the fourteenth embodiment. The power net 81 as the elastic material is stitched on a left end of a moving cloth 83. The moving cloth 83 extends a cloth 83*a* made of the same fabric as the fabric of the shirt covering the padding 80*a* into a tubular shape toward the right end side. Thus, the right end side serves as a stopper. That is, in the second modified example, the fabric covering the padding 80*a* and the stopper are made into one body.

Figure 19A:
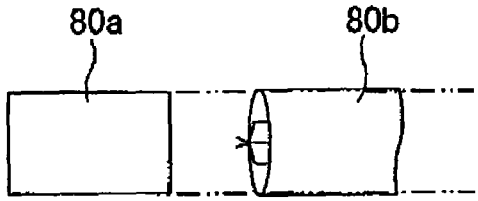
FIG. 19*a*, FIG. 19*b*, FIG. 19*c* and FIG. 19*d* are drawings respectively showing a variety of methods for wrapping a padding of the moving cloth in a fabric of the shirt having neck size adjusting function according the fourteenth embodiment of the invention.
Figure 19B:
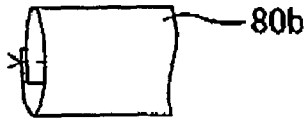
Figure 19C:
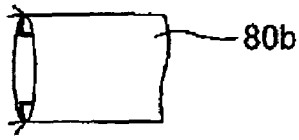
Figure 19D:
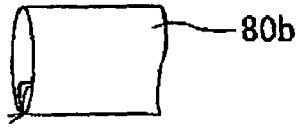
Figure 20A:
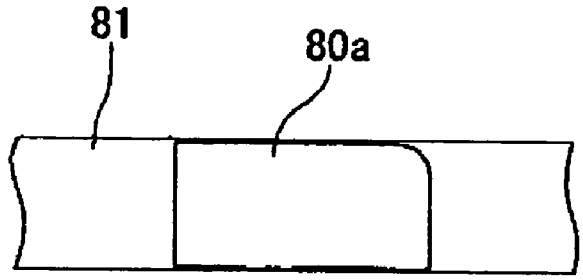
FIG. 20*a*, FIG. 20*b* and FIG. 20*c* are drawings respectively showing steps for placing a padding on an elastic material and wrapping it in a fabric in a moving cloth of a shirt having neck size adjusting function according to a third modified example of the fourteenth embodiment of the invention.
Figure 20B:
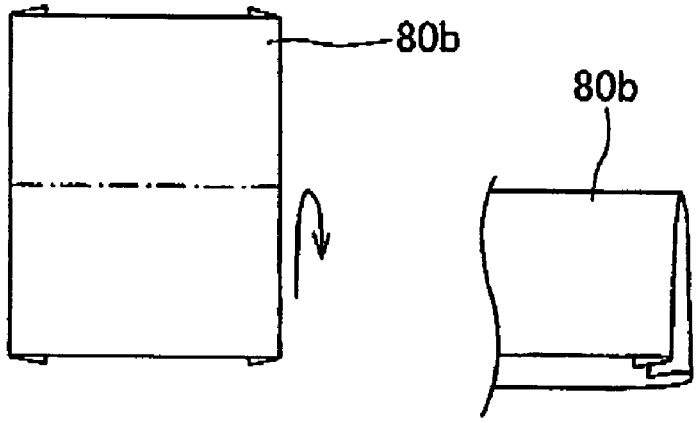
Figure 20C:
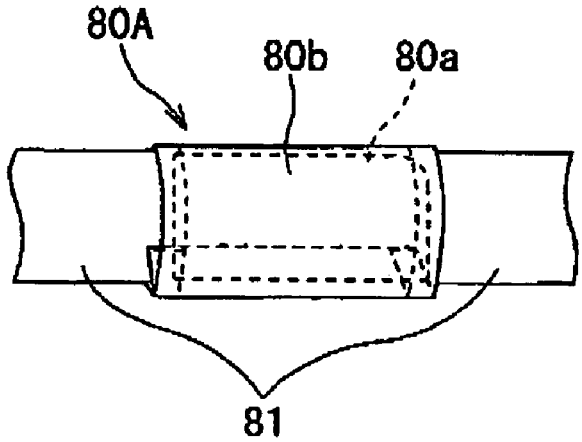

Methods of covering the padding 80*a* by the cloth 80*b* is described referring to FIG. 19*a*, FIG. 19*b*, FIG. 19*c* and FIG. 19*d*. FIG. 19*a* shows a method in which the cloth 80*b* has its center separated and sewn so as to cover the padding 80*a*. There are various methods. For example, FIG. 19*b* shows a method in which the cloth 80*b* has its center cut apart and overlapped and sewn. FIG. 19*c* shows a method in which two cloths 80*b* are overlapped and have their upper and lower ends stitched to each other, thereafter being reversed and letting the padding 80*a* enter therein. FIG. 19*d* shows a method in which a seam is placed at one side and only one of them is stitched. In any method, the front surface of the moving cloth 80, 83 can be smooth by covering the padding 80*a* with the cloth 80*b* of the same fabric as the fabric of the shirt or other cloths.

A third modified example of a moving cloth of a neck-size-adjustable shirt according to the fourteenth embodiment is described hereafter referring to FIG. 20*a*, FIG. 20*b* and FIG. 20*c*. In the third modified example, as shown in FIG. 20*c*, after the padding 80*a* is laid on the power net 81 as the elastic material, the cloth 80*b* of the same fabric covers the padding 80*a* in such state. Thus, a moving cloth element 80A is constituted. First, as shown in FIG. 20*a*, the padding 80 is laid on one power net 81. On the other hand, as shown in FIG. 20*b*, seam allowances at the opposite ends of the cloth 80*b* are folded. Then, as shown in FIG. 20*c*, the cloth 80*b* is wound around the padding 80*a* and bent at a lower side, thereafter being stitched at the circumference of the padding 80*a*.

As described above, according to the moving cloth 80, 80*a*, 83 of the fourteenth embodiment, the neck-size-adjustable shirt is realized such that a moderate friction can be obtained and the neckline of the shirt including the dress shirt can be adjusted to a desired length without conspicuous action, that the breaking-out is hard to take place and that the wearer can wear comfortably for a long time.

Fifteenth Embodiment

Figure 21A:
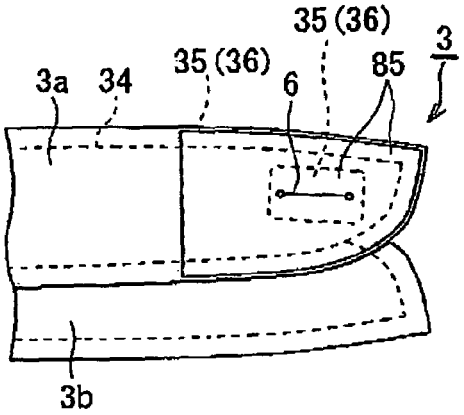
FIG. 21*a* is a drawing showing an example in which a fabric is stuck to a relatively stiff padding which a padding as the moving cloth contacts of a shirt having neck size adjusting function according to a fifteenth embodiment of the invention.

A neck-size-adjustable shirt according to a fifteenth embodiment of the invention is described hereafter referring to FIG. 20*a*, FIG. 20*b*, FIG. 20*c*, FIG. 20*d*, FIG. 20*e* and FIG. 20*f*. FIG. 21*a* is a drawing showing an example in which a fabric is stuck to a relatively stiff padding which a padding as the moving cloth contacts of a shirt having neck size adjusting function according to a fifteenth embodiment of the invention. FIG. 21*b*, FIG. 21*c*, FIG. 21*d*, FIG. 21*e* and FIG. 21*f* are drawings respectively showing a first, a second, a third, a fourth and a fifth modified example of the fifteenth embodiment.

The fifteenth embodiment uses only a padding as a moving cloth. The uppermost button 4 is stitched on the padding with a moderate length of a thread base or a base-winding. The uppermost button 4 is put out of the second buttonhole 6 and moved along it. At this time, a relatively stiff padding 35 (soft padding) or 36 (hard padding) is stuck on an inside of the front cloth 3*a* of the inner fold of the neckband so as to prevent the breaking-out. As such, the friction becomes large because the padding as the moving cloth having large irregularities on the front surface is in friction with the relatively hard padding 35, 36. In view of this, according to a reversed way of thinking, the cloth is not attached at the moving cloth side but attached over the relatively stiff padding inside the front cloth 3*a* of the inner fold of the neckband. Thereby, the same moderate friction is obtainable as in the fourteenth embodiment.

Specifically, as shown in FIG. 21*a*, a soft padding 35 or a hard padding 36 as a relatively large and stiff padding is stitched on the inside of the front cloth 3*a* of the inner fold of the neckband 3 so as to cover an entire leading end of the front cloth 3*a*. Moreover, a soft padding 35 or a hard padding 36 as a relatively small and stiff padding, which is cut into nearly a same length as the second buttonhole 6, is stitched at a portion where the second buttonhole 6 is formed. A cloth 85 of the same fabric (shirt fabric) has a size covering the relatively large and stiff padding 35 or 36 as a whole. The cloth 85 is stitched on the padding 35 or 36. A through hole of the second buttonhole 6 is opened. A buttonholing is performed on the above elements including the cloth 85 so as to form the second buttonhole 6. an uppermost button (not shown) is sewn on a padding as a moving cloth (not shown) and is put out of the second buttonhole 6.

As described above, a center part of the cloth 85 is fixed through the buttonholing in forming the second buttonhole 6. Then, when the uppermost button moves together with the padding as the moving cloth in the second buttonhole 6, the padding having large irregularities and the cloth 85 are in friction with each other. Thus, a moderate friction can be obtained.

Figure 21D:
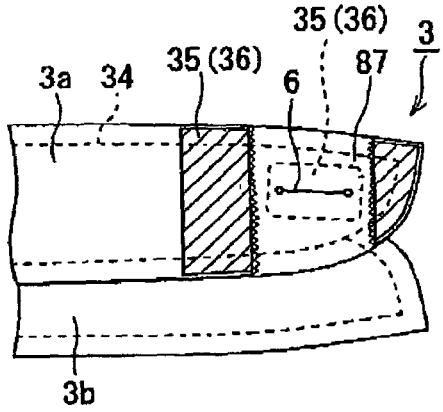
FIG. 21*b*, FIG. 21*c*, FIG. 21*d*, FIG. 21*e* and FIG. 21*f* are drawings respectively showing a first, a second, a third, a fourth and a fifth modified example of the fifteenth embodiment.
Figure 21B:
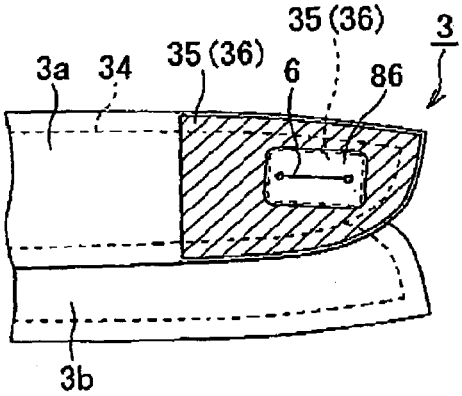

In a first modified example shown in FIG. 21*b*, a soft padding 35 or a hard padding 36 as a relatively large and stiff padding is sewn. On the other hand, a soft padding 35 or a hard padding 36 as a relatively small and stiff padding is cut into substantially a same length as that of the second buttonhole 6. Then, the small padding 35 or 36 is stitched on the large padding 35 or 36 after being covered with a cloth 86 of the same cloth. Thereafter, the second buttonhole 6 is formed.

Figure 21E:
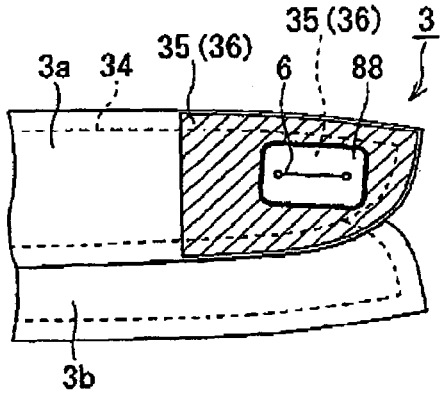
Figure 21C:
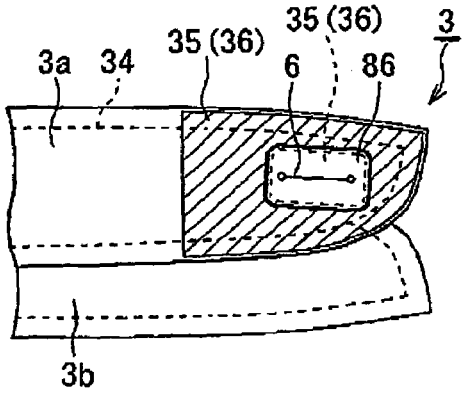

In a second modified example shown in FIG. 21*c*, a soft padding 35 or a hard padding 36 as a relatively large and stiff padding is sewn. On the other hand, a soft padding 35 or a hard padding 36 as a relatively small and stiff padding is cut into substantially a same length as that of the second buttonhole 6. Then, the small padding 35 or 36 is stitched on the large padding 35 or 36. Moreover, a cloth 86 of the same fabric is cut into substantially a same length as the relatively small and stiff padding 35 or 36. Thereafter, the cloth 86 has its overall circumference stitched on the padding 35 or 36. Then, the second buttonhole 6 is formed on such structure. Thus, a center part of the cloth 86 is fixed by the buttonholing.

In a third modified example shown in FIG. 21*d*, a soft padding 35 or a hard padding 36 as a relatively large and stiff padding is sewn. On the other hand, a soft padding 35 or a hard padding 36 as a relatively small and stiff padding is cut into substantially a same length as that of the second buttonhole 6. Then, the small padding 35 or 36 is stitched on the large padding 35. Moreover, a cloth 87 has a length extending from an upper end to a lower end of the front cloth 3*a* of the neckband 3. Then, the cloth 87 is stitched on the padding 35, or 36. Right and left edge of the cloth 87 is overlocked. Thereafter, the second buttonhole 6 is formed.

In a fourth modified example shown in FIG. 21*e*, a soft padding 35 or a hard padding 36 as a relatively large and stiff padding is sewn. On the other hand, a soft padding 35 or a hard padding 36 as a relatively small and stiff padding is cut into substantially a same length as that of the second buttonhole 6. Then, the small padding 35 or 36 is stitched on the large padding 35. Moreover, a cloth 88 of the same fabric is stuck on the padding 35 or 36. Then, they are heat-cut along an outline of the relatively small and stiff padding. Thereafter, the second buttonhole 6 is formed.

Figure 21F:
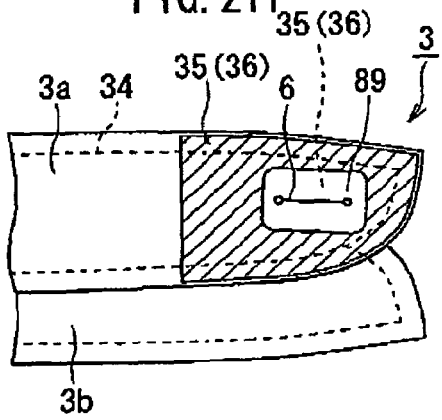

In a fifth modified example shown in FIG. 21*f*, a soft padding 35 or a hard padding 36 as a relatively large and stiff padding is sewn. On the other hand, a soft padding 35 or a hard padding 36 as a relatively small and stiff padding is cut into substantially a same length as that of the second buttonhole 6. Then, the small padding 35 or 36 is stitched on the large padding 35. Moreover, a cloth 89 of the same fabric is stuck by an adhesive or a two-sided tape on the padding 35 or 36. Thereafter, the second buttonhole 6 is formed so as to fix a center part of the cloth 89 by buttonholing.

As described above, in the fifteenth embodiment and the first to the fifth modified examples, a soft padding 35 or a hard padding 36 as a relatively large and stiff padding is sewn. On the other hand, a soft padding 35 or a hard padding 36 as a relatively small and stiff padding is cut into substantially a same length as that of the second buttonhole 6. Then, the small padding 35 or 36 is stitched on the large padding 35. However, in some cases, only the relatively large and stiff padding 35 or 36 is stitched according to a material of the shirt or the like. Then, the cloth 85, 86, 87, 88, 89 of the same fabric may be directly attached without stitching the relatively small and stiff padding. While, in the above described cases, the same fabric as the shirt is used as the cloth 85, 86, 87, 88, 89, other fabrics may be used.

Sixteenth Embodiment

Figure 22A:
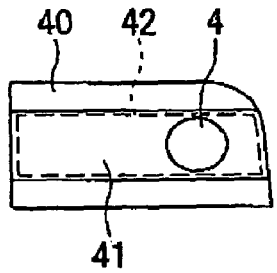
FIG. 22*a* is a plan view showing a heat-resistant plastic plate used instead of a moving cloth of a shirt having neck size adjusting function according to a sixteenth embodiment of the invention.
Figure 22B:
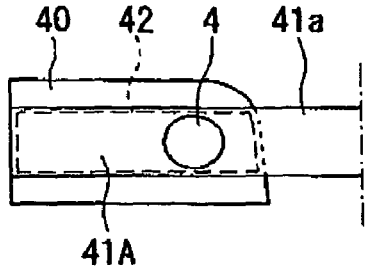
FIG. 22*b* is a plan view showing a state in which a stopper is attached to the heat-resistant plastic plate.
Figure 22C:
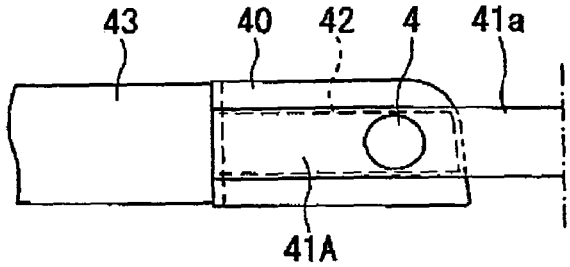
FIG. 22*c* is a plan view showing a state in which an elastic material is further attached to the heat-resistant plastic plate.

A neck-size-adjustable shirt according to a sixteenth embodiment of the invention is described hereafter referring to FIG. 22*a*, FIG. 22*b* and FIG. 22*c*. FIG. 22*a* is a plan view showing a heat-resistant plastic plate used instead of a moving cloth of a shirt having neck size adjusting function according to a sixteenth embodiment of the invention. FIG. 22*b* is a plan view showing a state in which a stopper is attached to the heat-resistant plastic plate. FIG. 22*c* is a plan view showing a state in which an elastic material is further attached to the heat-resistant plastic plate.

As described in the eleventh embodiment, if the heat-resistant plastic is used instead of the moving cloth, various advantages are obtained. Still, in case the uppermost button 4 comes off, it is hard for a consumer to sew the button back on the shirt. Therefore, as shown in FIG. 22*a*, a cloth tape 41 is stitched on a heat-resistant plastic (PET) plate 40. Thus, in case the uppermost button 4 comes off, even the consumer can reattach it easily. It is possible that the cloth tape 41 has only opposite ends thereof stitched on the heat-resistant plastic plate 40 instead of the moving cloth, while making its center spaced from the heat-resistant plastic plate 40. In this case, the uppermost button 4 is sewn only on the cloth tape 41. Alternatively, in the sixteenth embodiment, the cloth tape 41 may have its circumference stitched on the heat-resistance plastic plate 41 by a stitching thread 42 so as to be in close contact with the heat-resistant plastic plate. In this case, the uppermost button 4 is sewn while making the thread passing through the cloth tape 41 and the heat-resistant plastic plate 40.

In the former case, if the uppermost button 4 comes off, it is easy for the consumer to reattach the uppermost button 4 only on the cloth tape 41. However, a breaking-out may occur by a space made at the center part of the cloth tape 41. On the other hand, in case of the sixteenth embodiment, the cloth tape 41 is in close contact with the heat-resistant plastic plate 40. Therefore, it seems that it is hard for the consumer to reattach the uppermost button 4 only on the cloth tape 41. However, since a needlepoint slides on the heat-resistant plastic plate 40, so that the consumer can reattach the uppermost button 4 only on the cloth tape 41 more easily than expected.

As shown in FIG. 22*b*, if a relatively long cloth tape 41A is stitched so as to run over a right end of the heat-resistant plastic plate 40, a protruded portion 41*a* serves as a stopper. Therefore, it is possible to decrease a number of parts, thereby shortening a process and reducing costs.

As shown in FIG. 22*c*, if a net rubber tape 43 as an elastic material is stitched on a left end of the heat-resistant plastic plate 40, a structure is completed so as to move the uppermost button 4 in the second buttonhole 6 (not shown). In the sixteenth embodiment, a net rubber tape 43 having not so much strong tensile force is used as the elastic material so as to move the uppermost button 4 to a desired position and fix it there.

As described above, the neckline of the shirt including the dress shirt can be adjusted to a desired length without conspicuous action. Moreover, the uppermost button can be easily reattached even if it comes off. Furthermore, a stopper can be attached at the same time. Thus, the neck-size-adjustable shirt can be worn comfortably for a long time.

Seventeenth Embodiment

Figure 23A:
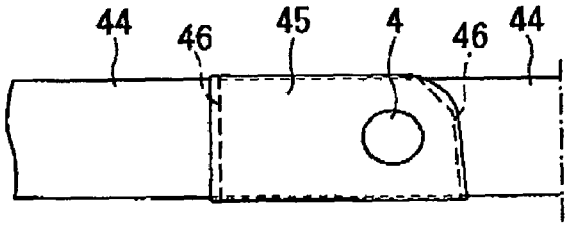
FIG. 23*a* is a plan view showing a state in which a moving cloth is attached to a long elastic material of a shirt having neck size adjusting function according to a seventeenth embodiment of the invention.
Figure 23B:
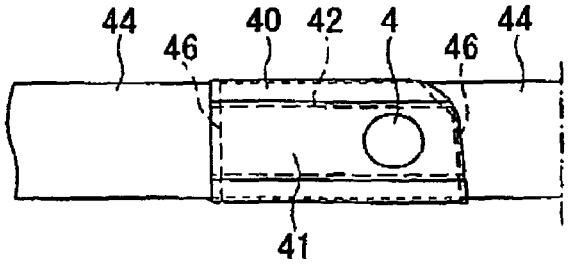
FIG. 23*b* is a plan view showing a state in which a heat-resistant plastic plate used instead of the moving cloth is attached to the long elastic material of the shirt having neck size adjusting function according to the seventeenth embodiment of the invention.

A neck-size-adjustable shirt according to a seventeenth embodiment of the invention is described hereafter referring to FIG. 23*a* and FIG. 23*b*. FIG. 23*a* is a plan view showing a state in which a moving cloth is attached to a long elastic material of a shirt having neck size adjusting function according to a seventeenth embodiment of the invention. FIG. 23*b* is a plan view showing a state in which a heat-resistant plastic plate used instead of the moving cloth is attached to the long elastic material of the shirt having neck size adjusting function according to the seventeenth embodiment of the invention.

As shown in FIG. 23*a*, in the seventeenth embodiment, a moving cloth 45 has opposite ends stitched on a net rubber tape 44 as a long elastic material via a stitching thread 46. An uppermost button 4 is sewn with a thread passing through the moving cloth 45 and the net rubber tape 44. Thus, a right side of the net rubber tape 44 as the long elastic material serves same as a stopper. Consequently, its sewing is easy and similar function and effects are obtained as if the stopper is attached.

Similarly, as shown in FIG. 23*b*, in a modified example of the seventeenth embodiment, a cloth tape 41 is stitched on a heat-resistant plastic plate 40 as in the sixteenth embodiment. They have opposite ends stitched on a net rubber tape 44 as a long elastic material via a stitching thread 46. An uppermost button 4 is sewn with a thread passing through the cloth tape 41, the heat-resistant plastic plate 40 and the net rubber tape 44. Thus, a right side of the net rubber tape 44 as the long elastic material serves same as a stopper. Consequently, its sewing is easy and similar function and effects are obtained as if the stopper is attached.

Eighteenth Embodiment

Figure 24A:
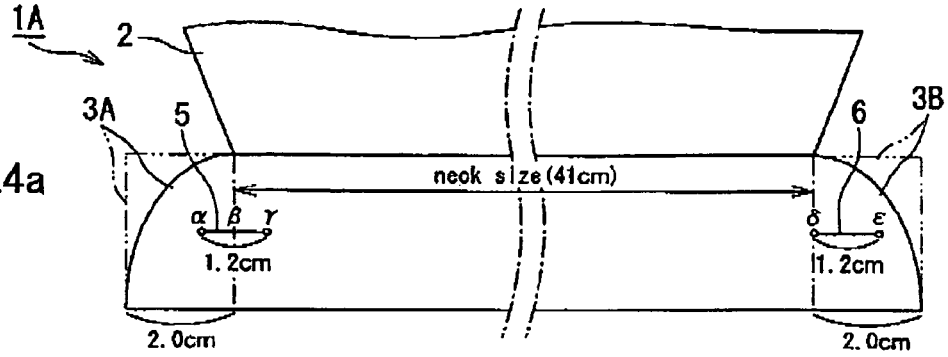
FIG. 24*a* is a drawing showing a positional relationship between a normal buttonhole and a second buttonhole of a neckband, while opening a collar of a shirt having neck size adjusting function according to an eighteenth embodiment of the invention.
Figure 24B:
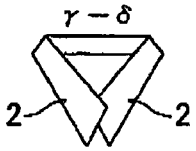
FIG. 24*b* is a drawing showing a state in which a neck size is made a smallest in the eighteenth embodiment.
Figure 24C:
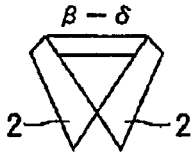
FIG. 24*c* is a drawing showing a state in which the neck size is made a little larger so that opposite ends of the collar matches exactly in the eighteenth embodiment.
Figure 24D:
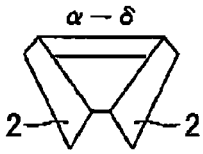
FIG. 24*d* is a drawing showing a state in which the neck size is made still larger so that the opposite ends of the collar is separated a little in the eighteenth embodiment.
Figure 24E:
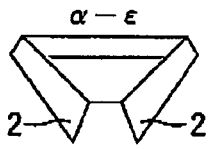
FIG. 24*e* is a drawing showing a state in which the neck size is made still further larger so that the opposite ends of the collar is separated more in the eighteenth embodiment.
Figure 24F:
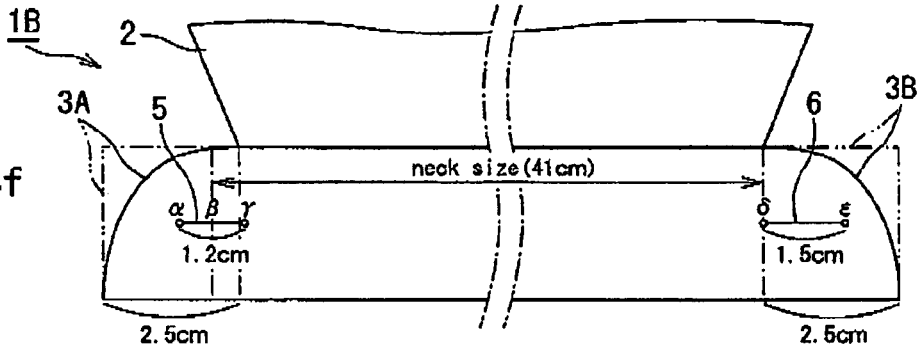
FIG. 24*f* is a drawing showing a positional relationship between a normal buttonhole and a second buttonhole of a neckband, while opening a collar of a shirt having neck size adjusting function according to a first modified example of the eighteenth embodiment of the invention.
Figure 24G:
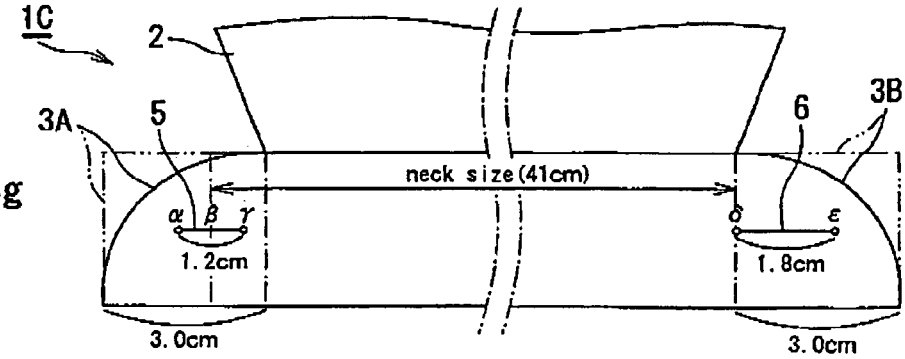
FIG. 24*g* is a drawing showing a positional relationship between a normal buttonhole and a second buttonhole of a neckband, while opening a collar of a shirt having neck size adjusting function according to a second modified example of the eighteenth embodiment of the invention.

A neck-size-adjustable shirt according to an eighteenth embodiment of the invention is described hereafter referring to FIG. 24*a*, FIG. 24*b*, FIG. 24*c*, FIG. 24*d*, FIG. 24*e*, FIG. 24*f* and FIG. 24*g*. FIG. 24*a* is a drawing showing a positional relationship between a normal buttonhole and a second buttonhole of a neckband, while opening a collar of a shirt having neck size adjusting function according to an eighteenth embodiment of the invention. FIG. 24*b* is a drawing showing a state in which a neck size is made a smallest in the eighteenth embodiment. FIG. 24*c* is a drawing showing a state in which the neck size is made a little larger so that opposite ends of the collar matches exactly in the eighteenth embodiment. FIG. 24*d* is a drawing showing a state in which the neck size is made still larger so that the opposite ends of the collar is separated a little in the eighteenth embodiment. FIG. 24*e* is a drawing showing a state in which the neck size is made still further larger so that the opposite ends of the collar is separated more in the eighteenth embodiment. FIG. 24*f* is a drawing showing a positional relationship between a normal buttonhole and a second buttonhole of a neckband, while opening a collar of a shirt having neck size adjusting function according to a first modified example of the eighteenth embodiment of the invention. FIG. 24*g* is a drawing showing a positional relationship between a normal buttonhole and a second buttonhole of a neckband, while opening a collar of a shirt having neck size adjusting function according to a second modified example of the eighteenth embodiment of the invention.

As shown in FIG. 24*a*, in the neck-size-adjustable shirt according to the eighteenth embodiment, an end of a neckband 3 is rounded as shown by a solid line. Still, even if it is angular as shown by an imaginary line, function and effects described hereafter are exactly the same. In case a neck-size-adjustable shirt 1A is sold in a shop, a neck size and a sleeve length is indicated in every one centimeter such as "39 (cm)-78 (cm)". A consumer buys a shirt in his or her size while making an estimate from these numbers. The neck size is represented by a length from a middle point β of a normal buttonhole 5 provided on an outer fold of a neckband 3 to an inner end δ of a second buttonhole 6 provided on an inner fold of the neckband 3, as shown in FIG. 24*a*, FIG. 24*f* and FIG. 24*g*.

The second buttonhole 6 is depicted in FIG. 24*a* such that it is provided horizontally. Actually, it has a side of the inner end δ lower by 2 mm so as to make its right side up. Thereby, an uppermost button (not shown) becomes easy to return after moving to a side of an outer end ε. In contrast, if the second buttonhole 6 is provided horizontally, the uppermost button becomes hard to return.

The neck-size-adjustable shirt according to the eighteenth embodiment has a neck size of 41 cm. If the uppermost button (not shown) is buttoned, the neck size becomes the smallest when the uppermost button is hooked onto an inner end γ of the normal buttonhole 5, while the uppermost button is located at the inner end δ of the second buttonhole 6, as shown in FIG. 24*b*. At this time, the neck size becomes 40.4 cm. A collar 2 just fits when the uppermost button is hooked onto a middle point β of the normal buttonhole 5, while the uppermost button is located at the inner end δ of the second buttonhole 6, as shown in FIG. 24*c*. At this time, the neck size becomes 41 cm.

In case the uppermost button is hooked onto an outer end α of the normal buttonhole 5, while the uppermost button is located at the inner end δ of the second buttonhole 6, as shown in FIG. 24*d*, the collar 2 is opened a little and the neck size becomes 41 cm. The neck size of the neck-size-adjustable shirt according to the eighteenth embodiment becomes the largest when the uppermost button is hooked onto the outer end α of the normal buttonhole 5, while the uppermost button is moved to the outer end ϵ of the second buttonhole 6, as shown in FIG. 24*e*. At this time, the neck size becomes 42.8 cm.

As described above, in the eighteenth embodiment of the neck-size-adjustable shirt 1A, the neck size changes from the smallest of 40.4 cm to the largest of 42.8 cm within a range of 2.4.cm. Therefore, the neckline can be tightened when it is cold, while it can be opened when it is hot. Thus, it can deal with a temperature change of circumstances. Moreover, the shirt can rapidly switch from a rough state of FIG. 24*e* in which there is a large space between facing ends of the collar 2 to a formal state of FIG. 24*c* in which the collar 2 just fits.

A neck-size-adjustable shirt according to a first modified example of the eighteenth embodiment is described hereafter referring to FIG. 24*f*. As shown in FIG. 24*f*, in a first modified example of a neck-size-adjustable shirt 1B, a neckband 3 has a protrusion length of 2.5 cm of each of right and left ends from right and left base ends of a collar 2, and it is larger by 0.5 cm than a protrusion length in FIG. 24*a*. Thus, a position of a normal buttonhole 5 is shifted outward by just such much. Moreover, a length of the second buttonhole 6 is prolonged to 1.5 cm. In the first modified example of the neck-size-adjustable shirt 1B, if an uppermost button (not shown) is buttoned, a neck size becomes the smallest when the uppermost button is hooked onto an inner end γ of the normal buttonhole 5, while the uppermost button is located at the inner end δ of the second buttonhole 6. At this time, the neck size becomes 40.4 cm.

If the uppermost button is hooked onto a middle point β of the normal buttonhole 5, while the uppermost button is located at the inner end δ of the second buttonhole 6, the neck size becomes 41 cm. At this time, the collar 2 is opened a little. The neck size of the neck-size-adjustable shirt according to the first modified example becomes the largest when the uppermost button is hooked onto an outer end α of the normal buttonhole 5, while the uppermost button is moved to an outer end ϵ of the second buttonhole 6. At this time, the neck size becomes 43.1 cm. As described above, in the first modified example of the neck-size-adjustable shirt 1B, the neck size changes from the smallest of 40.4 cm to the largest of 43.1 cm within a range of 2.7.cm.

The second buttonhole 6 is depicted in FIG. 24*f* such that it is provided horizontally, too. Actually, it has a side of the inner end δ lower by 2 mm so as to make its right side up. Thereby, an uppermost button (not shown) becomes easy to return after moving to a side of an outer end ϵ.

A neck-size-adjustable shirt according to a second modified example of the eighteenth embodiment is described hereafter referring to FIG. 24*g*. As shown in FIG. 24*g*, in a second modified example of a neck-size-adjustable shirt 1C, a neckband 3 has a protrusion length of 3.0 cm of each of right and left ends from right and left base ends of a collar 2, and it is still larger by 0.5 cm than a protrusion length in FIG. 24*b*. Thus, a position of a normal buttonhole 5 is shifted outward by just such much. Moreover, a length of the second buttonhole 6 is prolonged to 1.8 cm. In the second modified example of the neck-size-adjustable shirt 1C, if an uppermost button (not shown) is buttoned, a neck size becomes the smallest when the uppermost button is hooked onto an inner end γ of the normal buttonhole 5, while the uppermost button is located at the inner end δ of the second buttonhole 6. At this time, the neck size becomes 40.4 cm.

If the uppermost button is hooked onto a middle point β of the normal buttonhole 5, while the uppermost button is located at the inner end δ of the second buttonhole 6, the neck size becomes 41 cm. At this time, the collar 2 is opened a little. The neck size of the neck-size-adjustable shirt according to the second modified example becomes the largest when the uppermost button is hooked onto an outer end α of the normal buttonhole 5, while the uppermost button is moved to an outer end ϵ of the second buttonhole 6. At this time, the neck size becomes 43.4 cm. As described above, in the second modified example of the neck-size-adjustable shirt 1C, the neck size changes from the smallest of 40.4 cm to the largest of 43.4 cm within a range of 3.0.cm.

The second buttonhole 6 is depicted in FIG. 24*g* such that it is provided horizontally, too. Actually, it has a side of the inner end δ lower by 2 mm so as to make its right side up. Thereby, an uppermost button (not shown) becomes easy to return after moving to a side of an outer end ϵ.

As described above, in the neck-size-adjustable shirt 1A, 1B, 1C according to the eighteenth embodiment, the neck size changes within a range of 2.4 cm to 3.0 cm. Therefore, the neckline can be tightened when it is cold, while it can be opened when it is hot. Thus, it can deal with a temperature change of circumstances. Moreover, the shirt can rapidly switch from a rough state in which there is a large space between facing ends of the collar 2 to a formal state in which the collar 2 just fits.

Nineteenth Embodiment

Figure 25A:
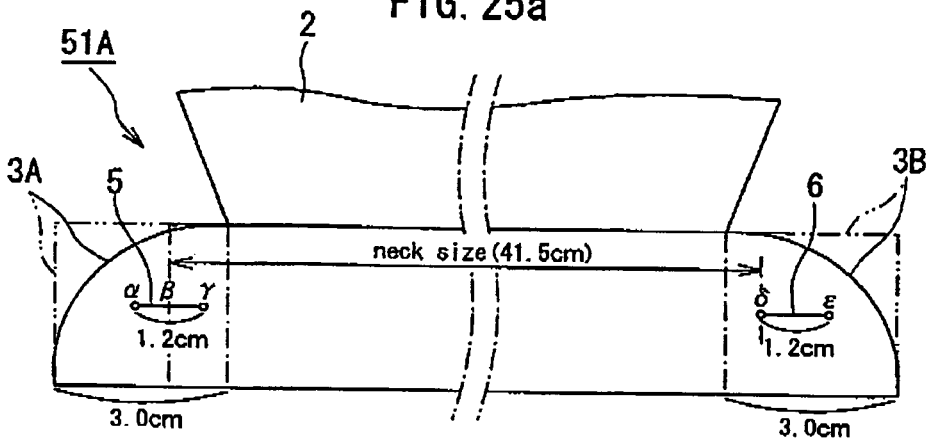
FIG. 25*a* is a drawing showing a positional relationship between a normal buttonhole and a second buttonhole of a neckband, while opening a collar of a shirt having neck size adjusting function according to a nineteenth embodiment of the invention.
Figure 25B:
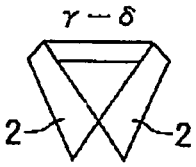
FIG. 25*b* is a drawing showing a state in which a neck size is made a smallest in the nineteenth embodiment.
Figure 25C:
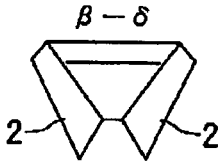
FIG. 25*c* is a drawing showing a state in which the neck size is made a little larger so that opposite ends of the collar matches exactly in the nineteenth embodiment.
Figure 25D:
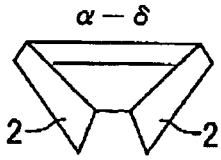
FIG. 25*d* is a drawing showing a state in which the neck size is made still larger so that the opposite ends of the collar is separated a little in the nineteenth embodiment.
Figure 25E:
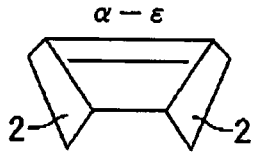
FIG. 25*e* is a drawing showing a state in which the neck size is made still further larger so that the opposite ends of the collar is separated more in the nineteenth embodiment.
Figure 25F:
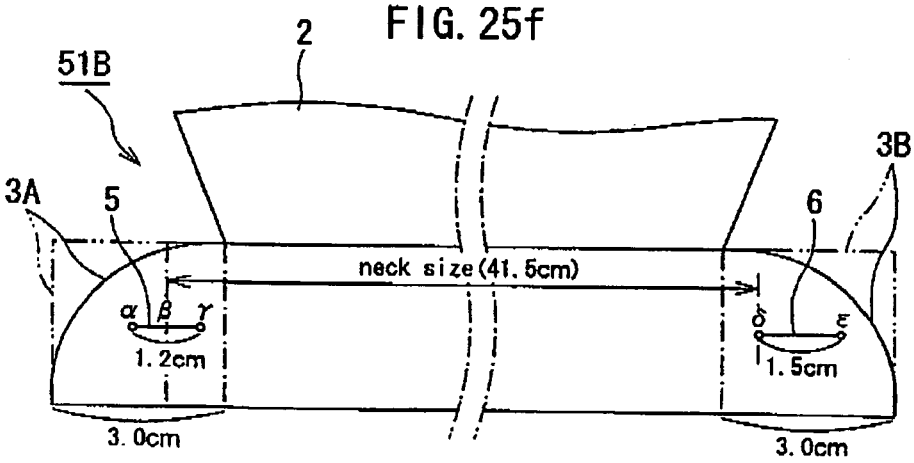
FIG. 25*f* is a drawing showing a positional relationship between a normal buttonhole and a second buttonhole of a neckband, while opening a collar of a shirt having neck size adjusting function according to a first modified example of the nineteenth embodiment of the invention.

A neck-size-adjustable shirt according to a nineteenth embodiment of the invention is described hereafter referring to FIG. 25*a*, FIG. 25*b*, FIG. 25*c*, FIG. 25*d*, FIG. 25*e*, FIG. 25*f*, FIG. 26*a*, FIG. 26*b*, FIG. 26*c*, FIG. 26*d*, FIG. 26*e*, FIG. 26*f* and FIG. 26*g*. FIG. 25*a* is a drawing showing a positional relationship between a normal buttonhole and a second buttonhole of a neckband, while opening a collar of a shirt having neck size adjusting function according to a nineteenth embodiment of the invention. FIG. 25*b* is a drawing showing a state in which a neck size is made a smallest in the nineteenth embodiment. FIG. 25*c* is a drawing showing a state in which the neck size is made a little larger so that opposite ends of the collar matches exactly in the nineteenth embodiment. FIG. 25*d* is a drawing showing a state in which the neck size is made still larger so that the opposite ends of the collar is separated a little in the nineteenth embodiment. FIG. 25*e* is a drawing showing a state in which the neck size is made still further larger so that the opposite ends of the collar is separated more in the nineteenth embodiment. FIG. 25*f* is a drawing showing a positional relationship between a normal buttonhole and a second buttonhole of a neckband, while opening a collar of a shirt having neck size adjusting function according to a first modified example of the nineteenth embodiment of the invention.

Figure 26A:
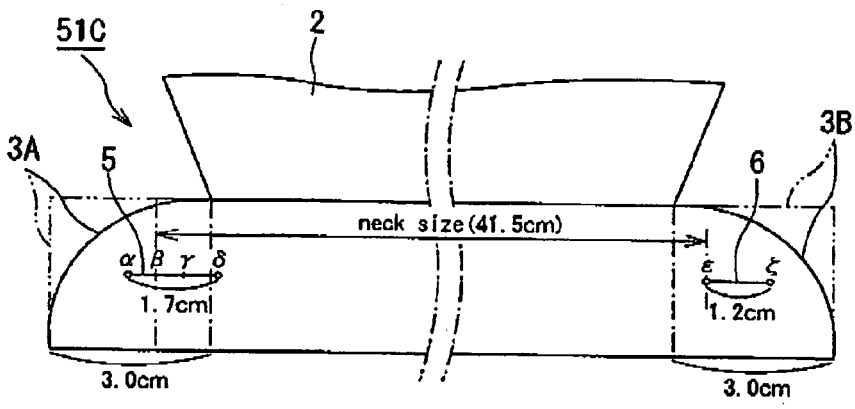
FIG. 26*a* is a drawing showing a positional relationship between a normal buttonhole and a second buttonhole of a neckband, while opening a collar of a shirt having neck size adjusting function according to a second modified example of the nineteenth embodiment of the invention.
Figures 26B, 26C, 26D, 26E, 26F:
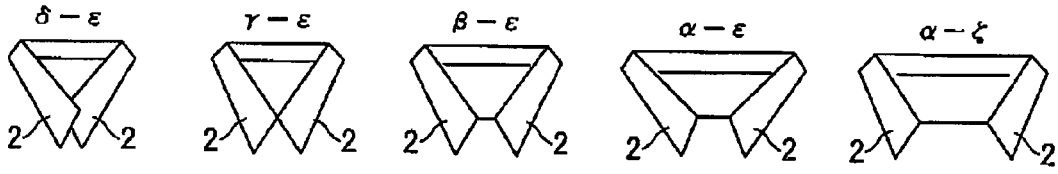
FIG. 26*b* is a drawing showing a state in which a neck size is made a smallest in the second modified example of the nineteenth embodiment.
FIG. 26*c* is a drawing showing a state in which the neck size is made a little larger so that opposite ends of the collar matches exactly in the second modified example of the nineteenth embodiment.
FIG. 26*d* is a drawing showing a state in which the neck size is made still larger so that the opposite ends of the collar is separated a little in the second modified example of the nineteenth embodiment.
FIG. 26*e* is a drawing showing a state in which the neck size is made still further larger so that the opposite ends of the collar is separated more in the second modified example of the nineteenth embodiment.
FIG. 26*f* is a drawing showing a state in which the neck size is made the largest so that the opposite ends of the collar are separated the most in the second modified example of the nineteenth embodiment.
Figure 26G:
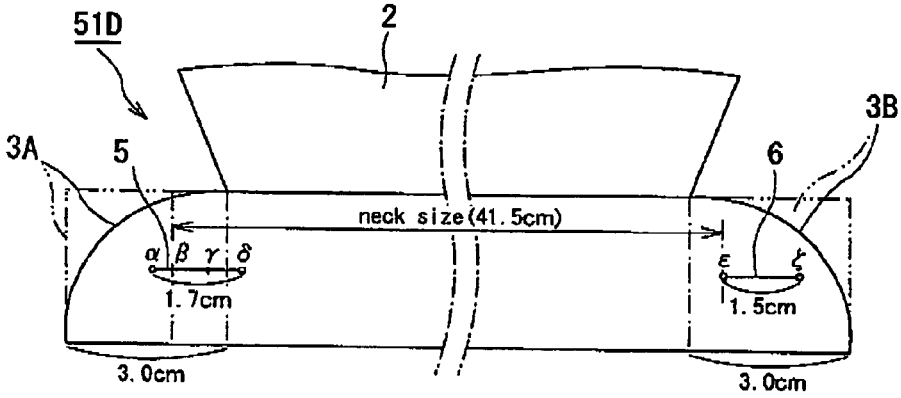
FIG. 26*g* is a drawing showing a positional relationship between a normal buttonhole and a second buttonhole of a neckband, while opening a collar of a shirt having neck size adjusting function according to a third modified example of the nineteenth embodiment of the invention.

FIG. 26*a* is a drawing showing a positional relationship between a normal buttonhole and a second buttonhole of a neckband, while opening a collar of a shirt having neck size adjusting function according to a second modified example of the nineteenth embodiment of the invention. FIG. 26*b* is a drawing showing a state in which a neck size is made a smallest in the second modified example of the nineteenth embodiment. FIG. 25*c* is a drawing showing a state in which the neck size is made a little larger so that opposite ends of the collar matches exactly in the second modified example of the nineteenth embodiment. FIG. 25*d* is a drawing showing a state in which the neck size is made still larger so that the opposite ends of the collar is separated a little in the second modified example of the nineteenth embodiment. FIG. 25*e* is a drawing showing a state in which the neck size is made still further larger so that the opposite ends of the collar is separated more in the second modified example of the nineteenth embodiment. FIG. 26*g* is a drawing showing a positional relationship between a normal buttonhole and a second buttonhole of a neckband, while opening a collar of a shirt having neck size adjusting function according to a third modified example of the nineteenth embodiment of the invention.

A second buttonhole 6 is depicted in FIG. 25*a*, FIG. 25*f*, FIG. 26*a* and FIG. 26*g* such that it is provided horizontally, too. Actually, it has a side of an inner end δ or a side of an inner end ϵ lower by 2 mm so as to make its right side up. Thereby, an uppermost button (not shown) becomes easy to return after moving to a side of an outer end ϵ or a side of an outer end ζ.

As shown in FIG. 25, a neck-size-adjustable shirt 51A according to the nineteenth embodiment has a neck size of 41.5 cm. If the uppermost button (not shown) is buttoned, the neck size becomes the smallest when the uppermost button is hooked onto an inner end γ of the normal buttonhole 5, while the uppermost button is located at the inner end δ of the second buttonhole 6, as shown in FIG. 25*b*. At this time, the neck size becomes 40.9 cm and a collar 2 just fits. Consequently, a person who has a neck measurement of 41 cm can wear it. When it is sold in a shop, it may be sold as a shirt of "neck size 41 cm".

When the uppermost button is hooked onto a middle point β of the normal buttonhole 5, while the uppermost button is located at the inner end δ of the second buttonhole 6, as shown in FIG. 25*c*, the neck size becomes 41.5 cm (neckline measurement), so that the collar 2 is opened a little. In case the uppermost button is hooked onto an outer end α of the normal buttonhole 5, while the uppermost button is located at the inner end δ of the second buttonhole 6, as shown in FIG. 25*d*, the neck size becomes 42.1 cm and the collar 2 is opened more. The neck size becomes the largest or 43.3 cm when the uppermost button is hooked onto the outer end α of the normal buttonhole 5, while the uppermost button is moved to the outer end ϵ of the second buttonhole 6, as shown in FIG. 25*e*. At this time, the collar 2 is opened widely.

As described above, in the nineteenth embodiment of the neck-size-adjustable shirt 51A, the neck size changes from the smallest of 40.9 cm to the largest of 43.3 cm within a range of 2.4.cm. Therefore, the neckline can be tightened when it is cold, while it can be opened when it is hot. Thus, it can deal with a temperature change of circumstances. Moreover, the shirt can rapidly switch from a rough state of FIG. 25*e* in which there is a large space between facing ends of the collar 2 to a formal state of FIG. 25*b* in which the collar 2 just fits. Furthermore, if it is normally worn or in a state of FIG. 25*c*, its neck is opened 0.5 cm in space, so that it is easy to knot a tie and make a feeling of moderate fit in a dress shirt or the like.

In the neck-size-adjustable shirt 1A according to the eighteenth embodiment, the largest opening width of the collar 2 is 1.8 cm. In contrast, in the neck-size-adjustable shirt 51A according to the nineteenth embodiment, the second buttonhole 6 is shifted outward by 0.5 cm. Thereby, though a length of a buttonhole 5 of an outer fold and a length of the second buttonhole 6 are both 1.2 cm and the same, the largest opening width of the collar 2 becomes 2.3 cm and larger. If the length of the second buttonhole 6 is made longer, the largest opening width can be larger. However, if the length of the second buttonhole 6 is made too long, the shirt becomes silly-looking. Moreover, the second buttonhole 6 becomes easy to be opened, so that a breaking-out is easy to take place. In contrast, if the largest opening width is made large by shifting the second buttonhole 6 outward, the length of the second buttonhole 6 is kept short. Consequently, the shirt is pleasing to eye and no breaking-out occurs.

A neck-size-adjustable shirt according to a first modified example of the nineteenth embodiment is described hereafter referring to FIG. 25*f*. As shown in FIG. 25*f*, in a first modified example of a neck-size-adjustable shirt 51B, a second buttonhole 6 is shifted outward by 0.5 cm as in the neck-size-adjustable shirt 51A. Moreover, a length of the second buttonhole 6 is made a little longer, i.e. 1.5 cm long. The neck-size-adjustable shirt 51B according to the first embodiment has a neck measurement of 41.5 cm, too. If an uppermost button (not shown) is buttoned, a neck size becomes the smallest when the uppermost button is hooked onto an inner end γ of the normal buttonhole 5, while the uppermost button is located at the inner end δ of the second buttonhole 6. At this time, the neck size becomes 40.9 cm so that the collar 2 becomes in a state of just-fit.

If the uppermost button is hooked onto a middle point β of the normal buttonhole 5, while the uppermost button is located at the inner end δ of the second buttonhole 6, the neck size becomes 41.5 cm (neck measurement). At this time, the collar 2 is opened a little. The neck size becomes the largest when the uppermost button is hooked onto an outer end α of the normal buttonhole 5, while the uppermost button is moved to an outer end ϵ of the second buttonhole 6. At this time, the neck size becomes 43.6 cm, while front ends of the collar 2 are opened largely or 2.6 cm in space.

A neck-size-adjustable shirt according to a second modified example of the nineteenth embodiment is described hereafter referring to FIG. 26*a*, FIG. 26*b*, FIG. 26*c*, FIG. 26*d*, FIG. 26*e*, FIG. 26*f* and FIG. 26*g*. As shown in FIG. 26*a*, in a second modified example of a neck-size-adjustable shirt 51C, a second buttonhole 6 is shifted outward by 0.5 cm as in the neck-size-adjustable shirt 51A. Moreover, a normal buttonhole 5 is elongated inward by 0.5 cm so as to be 1.7 cm long. The neck-size-adjustable shirt 51C according to the second embodiment has a neck measurement of 41.5 cm, too. If an uppermost button (not shown) is buttoned, a neck size becomes the smallest when the uppermost button is hooked onto an inner end δ of the normal buttonhole 5, while the uppermost button is located at an inner end ϵ of the second buttonhole 6, as shown in FIG. 26*b*. At this time, the neck size becomes 40.4 cm so that front ends or leading ends of the collar 2 are overlapped a little.

If the uppermost button is hooked onto a middle right-hand point γ of the normal buttonhole 5, while the uppermost button is located at the inner end ϵ of the second buttonhole 6, the neck size becomes 41.0 cm. At this time, the leading ends of the collar 2 exactly match as shown in FIG. 26*c*. If the uppermost button is hooked onto a middle left-hand point β of the normal buttonhole 5, while the uppermost button is located at the inner end ϵ of the second buttonhole 6, the neck size becomes 41.5 cm (neck measurement). At this time, the leading ends of the collar 2 are opened or spaced a little as shown in FIG. 26*d*.

If the uppermost button is hooked onto an outer end α of the normal buttonhole 5, while the uppermost button is located at the inner end ϵ of the second buttonhole 6, the neck size becomes 42.1 cm. At this time, the leading ends of the collar 2 are opened or spaced more as shown in FIG. 26*e*. The neck size becomes the largest when the uppermost button is hooked onto the outer end α of the normal buttonhole 5, while the uppermost button is moved to an outer end ζ of the second buttonhole 6. At this time, the neck size becomes 43.3 cm, while the leading ends of the collar 2 are opened or spaced largely, i.e. 2.3 cm in space.

A neck-size-adjustable shirt according to a third modified example of the nineteenth embodiment is described hereafter referring to FIG. 26*g*. As shown in FIG. 26*g*, in a third modified example of a neck-size-adjustable shirt 51D, a second buttonhole 6 is shifted outward by 0.5 cm as in the neck-size-adjustable shirt 51A. Moreover, a length of the second buttonhole 6 is made a little longer, i.e. 1.5 cm long. The neck-size-adjustable shirt 51D according to the third embodiment has a neck measurement of 41.5 cm, too. If an uppermost button (not shown) is buttoned, a neck size becomes the smallest when the uppermost button is hooked onto an inner end δ of a normal buttonhole 5, while the uppermost button is located at an inner end ϵ of the second buttonhole 6. At this time, the neck size becomes 40.4 cm so that the leading ends of the collar 2 are overlapped a little.

If the uppermost button is hooked onto a middle right-hand point γ of the normal buttonhole 5, while the uppermost button is located at the inner end ϵ of the second buttonhole 6, the neck size becomes 41.0 cm. At this time, the leading ends of the collar 2 exactly match. If the uppermost button is hooked onto a middle left-hand point β of the normal buttonhole 5, while the uppermost button is located at the inner end ϵ of the second buttonhole 6, the neck size becomes 41.5 cm (neck measurement). At this time, the leading ends of the collar 2 are opened or spaced a little. The neck size becomes the largest when the uppermost button is hooked onto the outer end ϵ of the normal buttonhole 5, while the uppermost button is moved to an outer end ζ of the second buttonhole 6. At this time, the neck size becomes 43.6 cm, while the leading ends of the collar 2 are opened or spaced largely.

As described above, in the nineteenth embodiment of the neck-size-adjustable shirt 51A, 51B, 51C and 51D, the neck size changes from the smallest to the largest cm within a range of 2.4.cm to 3.2 cm. Therefore, the neckline can be tightened when it is cold, while it can be opened when it is hot. Thus, it can deal with a temperature change of circumstances. Moreover, the shirt can rapidly switch from a rough state in which there is a large space between the leading ends of the collar 2 to a formal state in which the leading ends of the collar 2 match exactly. Furthermore, the leading ends of the collar are spaced 0.5 cm when the shirt is worn normally, so that it is easy to knot a tie and make a feeling of moderate fit in a dress shirt or the like.

In the neck-size-adjustable shirt 1A according to the eighteenth embodiment, the largest opening width of the collar 2 is 1.8 cm. In contrast, in the neck-size-adjustable shirt 51A, 51B, 51C and 51D according to the nineteenth embodiment, the second buttonhole 6 is shifted outward by 0.5 cm. Thereby, the largest opening width of the collar 2 becomes 2.3 cm or 2.6 cm and larger. If the length of the second buttonhole 6 is made longer, the largest opening width can be larger. However, if the length of the second buttonhole 6 is made too long, the shirt becomes silly-looking. Moreover, the second buttonhole 6 becomes easy to be opened, so that a breaking-out is easy to take place. In contrast, if the largest opening width is made large by shifting the second buttonhole 6 outward, the length of the second buttonhole 6 is kept short. Consequently, the shirt is pleasing to eye and no breaking-out occurs.

Twentieth Embodiment

Figure 27A:
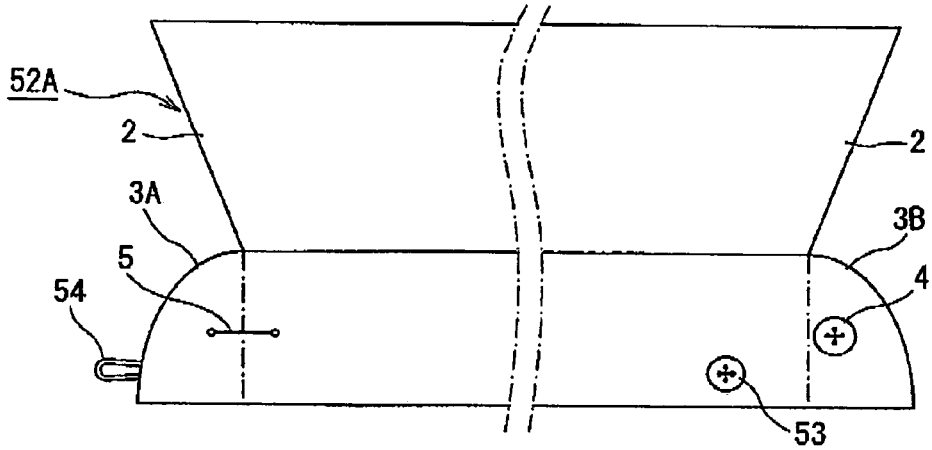
FIG. 27*a* is a drawing showing a positional relationship between a normal buttonhole and a loop made of an elastic material and an engagement member of a neckband, while opening a collar of a shirt having neck size adjusting function according to a twentieth embodiment of the invention.
Figure 27B:
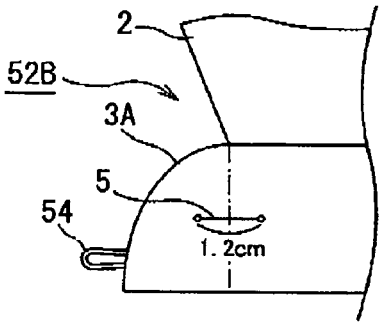
FIG. 27*b* is a drawing showing a positional relationship between a normal buttonhole and a loop made of an elastic material of an outer front end portion of a neckband, while opening a collar of a shirt having neck size adjusting function according to a first modified example of the twentieth embodiment of the invention.
Figure 27C:
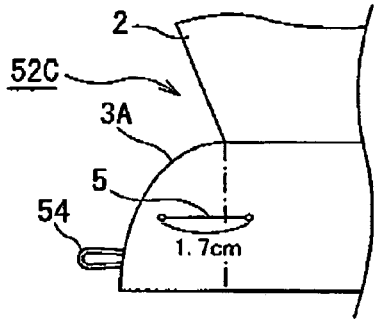
FIG. 27*c* is a drawing showing a positional relationship between a normal buttonhole and a loop made of an elastic material of an outer front end portion of a neckband, while opening a collar of a shirt having neck size adjusting function according to a second modified example of the twentieth embodiment of the invention.
Figure 27D:
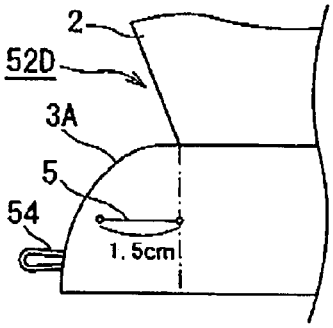
FIG. 27*d* is a drawing showing a positional relationship between a normal buttonhole and a loop made of an elastic material of an outer front end portion of a neckband, while opening a collar of a shirt having neck size adjusting function according to a third modified example of the twentieth embodiment of the invention.
Figure 27E:
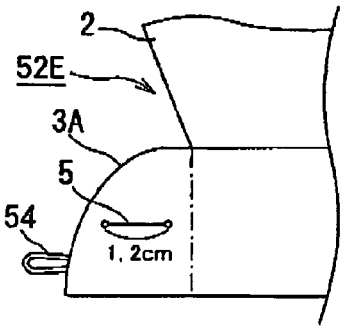
FIG. 27*e* is a drawing showing a positional relationship between a normal buttonhole and a loop made of an elastic material of an outer front end portion of a neckband, while opening a collar of a shirt having neck size adjusting function according to a fourth modified example of the twentieth embodiment of the invention.
Figure 27F:
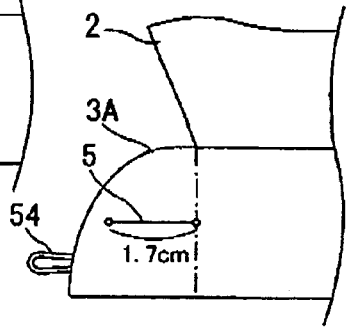
FIG. 27*f* is a drawing showing a positional relationship between a normal buttonhole and a loop made of an elastic material of an outer front end portion of a neckband, while opening a collar of a shirt having neck size adjusting function according to a fifth modified example of the twentieth embodiment of the invention.

A neck-size-adjustable shirt according to a twentieth embodiment of the invention is described hereafter referring to FIG. 27*a*, FIG. 27*b*, FIG. 27*c*, FIG. 27*d*, FIG. 27*e* and FIG. 27*f*. FIG. 27*a* is a drawing showing a positional relationship between a normal buttonhole and a loop made of an elastic material and an engagement member of a neckband, while opening a collar of a shirt having neck size adjusting function according to a twentieth embodiment of the invention. FIG. 27*b* is a drawing showing a positional relationship between a normal buttonhole and a loop made of an elastic material of an outer front end portion of a neckband, while opening a collar of a shirt having neck size adjusting function according to a first modified example of the twentieth embodiment of the invention. FIG. 27*c* is a drawing showing a positional relationship between a normal buttonhole and a loop made of an elastic material of an outer front end portion of a neckband, while opening a collar of a shirt having neck size adjusting function according to a second modified example of the twentieth embodiment of the invention. FIG. 27*d* is a drawing showing a positional relationship between a normal buttonhole and a loop made of an elastic material of an outer front end portion of a neckband, while opening a collar of a shirt having neck size adjusting function according to a third modified example of the twentieth embodiment of the invention. FIG. 27*e* is a drawing showing a positional relationship between a normal buttonhole and a loop made of an elastic material of an outer front end portion of a neckband, while opening a collar of a shirt having neck size adjusting function according to a fourth modified example of the twentieth embodiment of the invention. FIG. 27*f* is a drawing showing a positional relationship between a normal buttonhole and a loop made of an elastic material of an outer front end portion of a neckband, while opening a collar of a shirt having neck size adjusting function according to a fifth modified example of the twentieth embodiment of the invention.

As shown in FIG. 27*a*. the neck-size-adjustable shirt according to the twentieth embodiment is different from the first to the nineteenth embodiments in that no second buttonhole is provided on an inner fold 3B of a neckband. An uppermost button 4 is fixed by stitching on a leading end of a protruded portion of an outer fold 3A of the neckband. Instead, a loop 54 made of a rubber cord as an elastic material is stitched on the leading end of the protruded portion of the outer fold 3A of the neckband. A button 53 as an engaging member is stitched on a position corresponding to the loop made of the rubber cord of the inner fold 3B of the neckband.

Then, the uppermost button 4 is buttoned on the normal buttonhole 5 of the outer fold 3A of the neckband and the loop 54 made of the rubber cord is hooked on the button 53 of the inner fold of the neckband. Thus, where a collar is opened or its leading ends are spaced within a range of a length of the normal buttonhole 5, the collar returns in itself to its tight position when a wearer releases his or her hold, if an elastic force of the loop 54 is set strong. Otherwise, if a friction force between the normal buttonhole 5 and the uppermost button 4 is stronger than the elastic force of the loop 54, the collar stops at a desired position when the wearer opens it within the range of the length of the normal buttonhole 5. Then, the collar returns to the tight position if the wearer picks it up with his or her fingertips.

In the twentieth embodiment, a thread base is short and 0.2 cm long, so that the friction force between the normal buttonhole 5 and the uppermost button 4 is stronger than the elastic force of the loop 54. Therefore, in case the collar is opened within the range of the length of the normal buttonhole 5, it stops at a desired position. The collar returns to the tight position when it is picked up with the fingertips.

As shown in FIG. 27*b*, in a neck-size-adjustable shirt 52B according to a first modified example of the twentieth embodiment, a normal buttonhole 5 is 1.5 cm in length and its thread base is made short and 0.2 cm long. Therefore, a collar stops at a desired position when it is opened within a range of 1.2 cm. The collar returns to a tight position when it is picked up with fingertips.

As shown in FIG. 27*c*, in a neck-size-adjustable shirt 52C according to a second modified example of the twentieth embodiment, a normal buttonhole 5 is 1.7 cm in length so as to cross a base end line (shown by one-dot-chain line) of a collar 2. Moreover, its thread base is made short and 0.2 cm long, too. Therefore, a collar stops at a desired position when it is opened within a wider range of 1.7 cm. The collar returns to a tight position when it is picked up with fingertips.

As shown in FIG. 27*d*, in a neck-size-adjustable shirt 52D according to a third modified example of the twentieth embodiment, a normal buttonhole 5 is 1.5 cm in length, while extending outward from a base end line of a collar 2 and its base-winding is made short and 0.2 cm long. Therefore, a collar stops at a desired position when it is opened within a range of 1.5 cm. The collar returns to a tight position when it is picked up with fingertips.

As shown in FIG. 27*e*, in a neck-size-adjustable shirt 52E according to a fourth modified example of the twentieth embodiment, a normal buttonhole 5 is 1.2 cm in length, while located outside away from a base end line of a collar 2 and its base-winding is made short and 0.2 cm long. Therefore, a collar stops at a desired position when it is opened within a range of 1.2 cm. The collar returns to a tight position when it is picked up with fingertips.

As shown in FIG. 27*g*, in a neck-size-adjustable shirt 52F according to a fifth modified example of the twentieth embodiment, a normal buttonhole 5 is 1.7 cm in length, while extending outward from a base end line of a collar 2 and its base-winding is made short and 0.2 cm long. Therefore, a collar stops at a desired position when it is opened within a wider range of 1.7 cm. The collar returns to a tight position when it is picked up with fingertips.

A rubber, a rubber cord, a shirred rubber or the like may be used the "elastic material". A button, a hook or the like may be used as the "engaging member".

As described above, according to the twentieth embodiment of the neck-size-adjustable shirt 52, 52A, 52B, 52C, 52D, 52E, 52F, the neckline of the shirt including the dress shirt can be adjusted to a desired length without conspicuous action even if neither second buttonhole 6 nor buttonhole penetrating a neckband described later is provided. Moreover, the loop 54 made of the rubber cord and the button 53 of the inner fold of the neckband are hidden under the collar 2. Thus, the shirt is not disfigured and can be worn comfortably for a long time.

Twenty-First Embodiment

Figure 28:
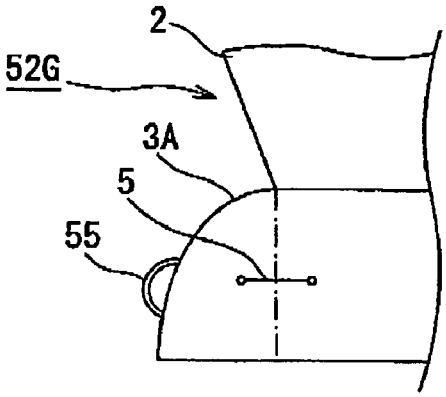
FIG. 28 is a drawing showing a positional relationship between a normal buttonhole and a loop made of an elastic material of a neckband, while opening a collar of a shirt having neck size adjusting function according to a twenty-first embodiment of the invention.

A neck-size-adjustable shirt according to a twenty-first embodiment of the invention is described hereafter referring to FIG. 28. FIG. 28 is a drawing showing a positional relationship between a normal buttonhole and a loop made of an elastic material of a neckband, while opening a collar of a shirt having neck size adjusting function according to a twenty-first embodiment of the invention. Though not shown in the drawings, a button 53 as an engaging member is stitched on an inner fold side of a neckband same as in FIG. 27*a*. It is the same that an uppermost button 4 is stitched on the inner fold of the neckband.

As shown in FIG. 28, the neck-size-adjustable shirt 52G according to the twenty-first embodiment is different from the twentieth embodiment shown in FIG. 27*a* to FIG. 27*f* in that a loop 55 is vertically long. The loop 55 is made of a rubber code as an elastic material and stitched on a leading end of a protruded portion of an outer fold 3A of the neckband. Accordingly, an urging force thereof is stronger. Then, the uppermost button 4 is buttoned on the normal buttonhole 5 and the loop 55 made of the rubber cord is hooked on the button 53 of the inner fold of the neckband. Thus, where a collar is opened or its leading ends are spaced within a range of a length of the normal buttonhole 5, the neck part returns in itself to its tight position when a wearer releases his or her hold, since an elastic force of the loop 55 is set strong.

As described above, according to the twenty-first embodiment of the neck-size-adjustable shirt 52G, the collar of the shirt including the dress shirt can be opened without conspicuous action even if neither second buttonhole 6 nor buttonhole penetrating a neckband described later is provided. Moreover, the collar returns to the tight position if the wearer releases his or her hand. Furthermore, the loop 55 made of the rubber cord and the button 53 of the inner fold of the neckband are hidden under the collar 2. Thus, the shirt is not disfigured and can be worn comfortably for a long time.

Twenty-Second Embodiment

Figure 29:
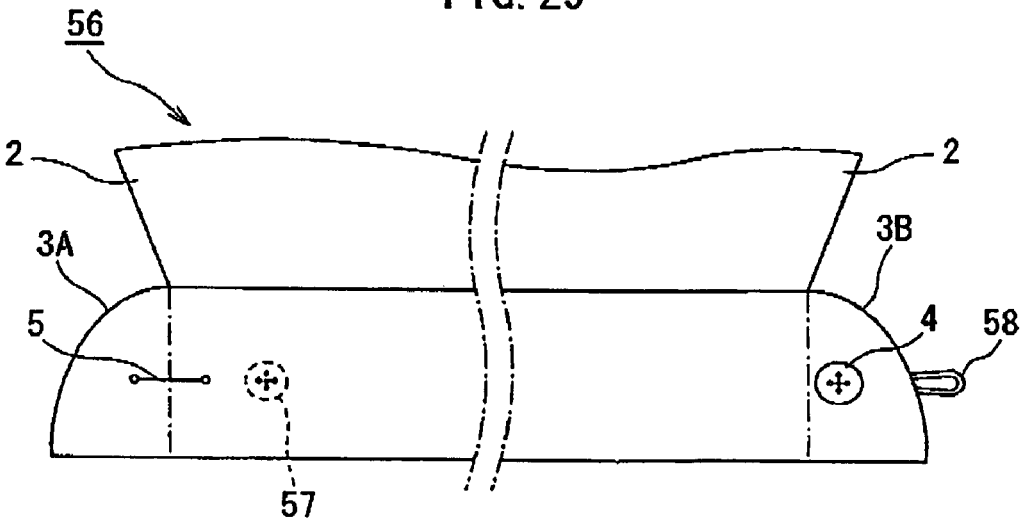
FIG. 29 is a drawing showing a positional relationship between a normal buttonhole and a loop made of an elastic material of a neckband, while opening a collar of a shirt having neck size adjusting function according to a twenty-second embodiment of the invention.

A neck-size-adjustable shirt according to a twenty-second embodiment of the invention is described hereafter referring to FIG. 29. FIG. 29 is a drawing showing a positional relationship between a normal buttonhole and a loop made of an elastic material of a neckband, while opening a collar of a shirt having neck size adjusting function according to a twenty-second embodiment of the invention.

As shown in FIG. 29, the neck-size-adjustable shirt 56 according to the twenty-second embodiment is different from the twentieth embodiment shown in FIG. 27*a* to FIG. 27*f* in that a loop 58 made of a rubber code as an elastic material is stitched on a leading end of a protruded portion of an inner fold 3B of a neckband. Moreover, a button 57 as an engaging member is stitched at a position corresponding to the loop 58 made of the rubber code on a rear side (inside) of an outer fold 3A of the neckband.

Then, the loop 58 made of the rubber cord is hooked on the button 57 at the rear side of the outer fold of the neckband, while the uppermost button 4 is buttoned on the normal buttonhole 5 of the outer fold 3A of the neckband. Thus, where a collar is opened or its leading ends are spaced within a range of a length of the normal buttonhole 5, the collar returns in itself to its tight position when a wearer releases his or her hold, if an elastic force of the loop 54 is set strong. Otherwise, if a friction force between the normal buttonhole 5 and the uppermost button 4 is stronger than the elastic force of the loop 58, the collar stops at a desired position when the wearer opens it within the range of the length of the normal buttonhole 5. Then, the collar returns to the tight position if the wearer picks it up with his or her fingertips.

In the twenty-second embodiment, a thread base is short and 0.2 cm long, so that the friction force between the normal buttonhole 5 and the uppermost button 4 is stronger than the elastic force of the loop 58. Therefore, in case the collar is opened within the range of the length of the normal buttonhole 5, it stops at a desired position. The collar returns to the tight position when it is picked up with the fingertips. The loop 58 made of the rubber cord and the button 57 at the rear side of the outer fold of the neckband are hidden at the rear side of the outer fold 3A of the neckband. Thus, the shirt is not disfigured and can be worn comfortably for a long time.

As described above, according to the twenty-second embodiment of the neck-size-adjustable shirt 56, the neckline of the shirt including the dress shirt can be adjusted to a desired length without conspicuous action even if neither second buttonhole 6 nor buttonhole penetrating a neckband described later is provided. Moreover, the loop 58 made of the rubber cord and the button 53 at the rear side of the outer fold of the neckband are hidden, so that the shirt is not disfigured and can be worn comfortably for a long time.

Twenty-Third Embodiment

Figure 30A:
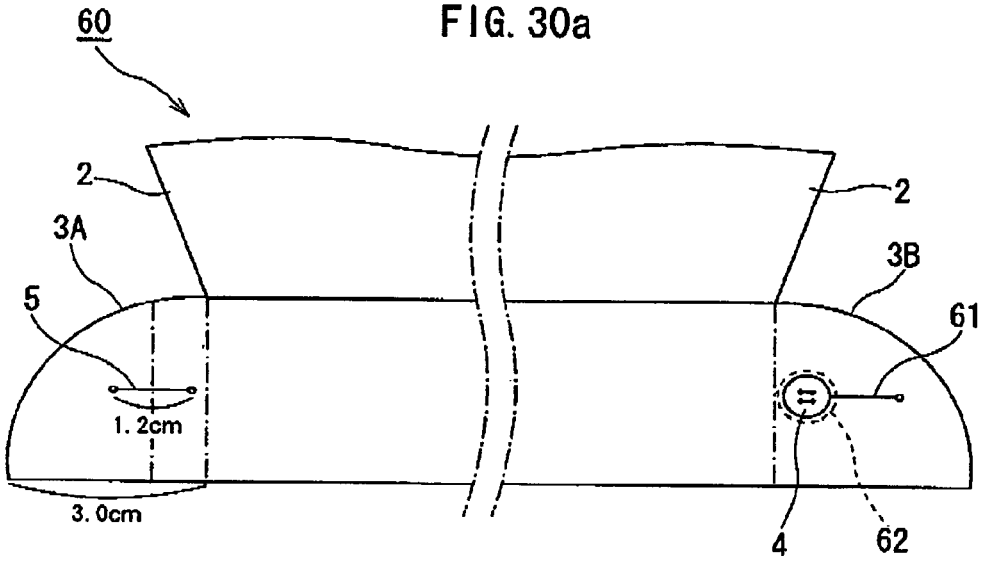
FIG. 30*a* is a drawing showing a normal buttonhole of an outer front end portion of a neckband and a neckband-penetrating buttonhole of a inner front end portion of the neckband that is provided so as to pass through the inner front end portion, while opening a collar of a shirt having neck size adjusting function according to a twenty-third embodiment of the invention.
Figure 30B:
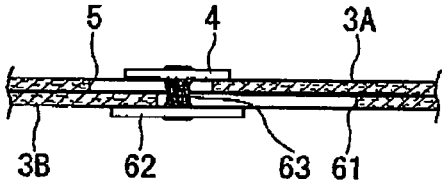
FIG. 30*b* is a drawing showing a state in which the outer front end portion and the inner front end portion of the neckband are overlapped and an uppermost button is fastened into a normal buttonhole in the twenty-third embodiment.

A neck-size-adjustable shirt according to a twenty-third embodiment of the invention is described hereafter referring to FIG. 30*a*, FIG. 30*b*, FIG. 31*a*, FIG. 31*b*, FIG. 31*c*, FIG. 31*d*, FIG. 31*e* and FIG. 31*f* FIG. 30*a* is a drawing showing a normal buttonhole of an outer front end portion of a neckband and a neckband-penetrating buttonhole of a inner front end portion of the neckband that is provided so as to pass through the inner front end portion, while opening a collar of a shirt having neck size adjusting function according to a twenty-third embodiment of the invention. FIG. 30*b* is a drawing showing a state in which the outer front end portion and the inner front end portion of the neckband are overlapped and an uppermost button is fastened into a normal buttonhole in the twenty-third embodiment.

Figure 31A:
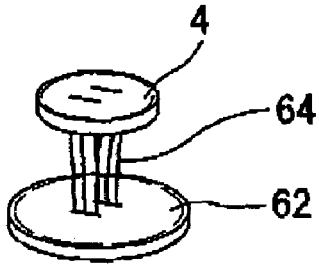
FIG. 31*a* is a perspective view showing a connecting structure of an uppermost button and a stopper of a shirt having neck size adjusting function according to a first modified example of the twenty-third embodiment of the invention.
Figure 31B:
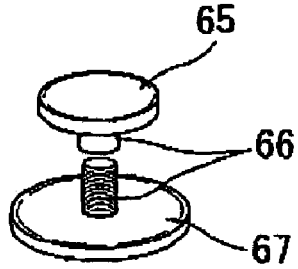
FIG. 31*b* is a perspective view showing a connecting structure of a member acting as an uppermost button and a stopper of a shirt having neck size adjusting function according to a second modified example of the twenty-third embodiment of the invention.
Figure 31C:
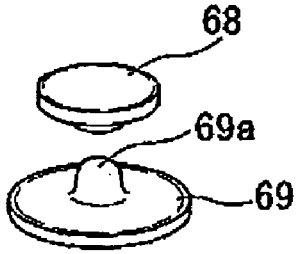
FIG. 31*c* is a perspective view showing a connecting structure of a member acting as an uppermost button and a stopper of a shirt having neck size adjusting function according to a third modified example of the twenty-third embodiment of the invention.
Figure 31D:
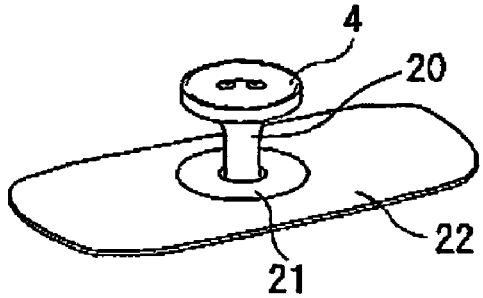
FIG. 31*d* is a perspective view showing a connecting structure of a member acting as an uppermost button and a stopper of a shirt having neck size adjusting function according to a fourth modified example of the twenty-third embodiment of the invention.
Figure 31E:
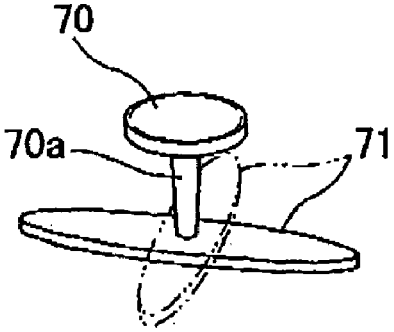
FIG. 31*e* is a perspective view showing a connecting structure of a member acting as an uppermost button and a stopper of a shirt having neck size adjusting function according to a fifth modified example of the twenty-third embodiment of the invention.
Figure 31F:
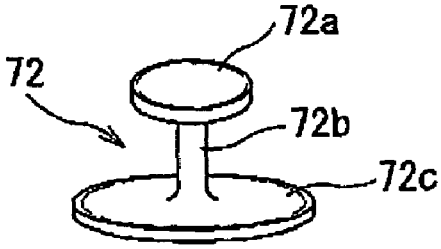
FIG. 31*f* is a perspective view showing a connecting structure of a member acting as an uppermost button and a stopper of a shirt having neck size adjusting function according to a sixth modified example of the twenty-third embodiment of the invention.

FIG. 31*a* is a perspective view showing a connecting structure of an uppermost button and a stopper of a shirt having neck size adjusting function according to a first modified example of the twenty-third embodiment of the invention. FIG. 31*b* is a perspective view showing a connecting structure of a member acting as an uppermost button and a stopper of a shirt having neck size adjusting function according to a second modified example of the twenty-third embodiment of the invention. FIG. 31*c* is a perspective view showing a connecting structure of a member acting as an uppermost button and a stopper of a shirt having neck size adjusting function according to a third modified example of the twenty-third embodiment of the invention. FIG. 31*d* is a perspective view showing a connecting structure of a member acting as an uppermost button and a stopper of a shirt having neck size adjusting function according to a fourth modified example of the twenty-third embodiment of the invention. FIG. 31*e* is a perspective view showing a connecting structure of a member acting as an uppermost button and a stopper of a shirt having neck size adjusting function according to a fifth modified example of the twenty-third embodiment of the invention. FIG. 31*f* is a perspective view showing a connecting structure of a member acting as an uppermost button and a stopper of a shirt having neck size adjusting function according to a sixth modified example of the twenty-third embodiment of the invention.

In each of the above described embodiments, it is described that the second buttonhole 6 has a structure that does not penetrate the rear cloth 3*b* but penetrates only the front cloth 3*a* of the inner fold of the neckband, as shown in FIG. 2 to FIG. 10 and FIG. 16 to FIG. 26. That is, each second buttonhole 6 described heretofore is provided on the front cloth 3*a* of the inner fold 3B of the neckband. The second buttonhole 6 does not pass through the rear cloth 3*b* of the inner fold 3B of the neckband. Therefore, a work inside the inner fold 3B of the neckband is required, so that it is hard for a consumer to easily change an internal structure.

However, as shown in FIG. 30, in the neck-size-adjustable shirt 60 according to the twenty-third embodiment, a neckband-penetrating buttonhole 61 is provided so as to pass through a rear cloth 3*b* of an inner fold 3B of a neckband. An uppermost button 4 and a button 62 as a retainer are connected with a base-winding 63 that passes through the neckband-penetrating buttonhole 61. The button 62 is one size larger than the uppermost button 4. Accordingly, any work is not required inside the inner fold 3B of the neckband, so that a manufacture becomes easier with a resultant cost reduction. Moreover, it is easy to change the uppermost button 4 or the retainer 62 according to a taste of a consumer.

As described above, according to the twenty-third embodiment of the neck-size-adjustable shirt 60, the neckline of the shirt including the dress shirt can be adjusted to a desired length without conspicuous action. Moreover, the shirt can be manufactured easily and at low costs. Furthermore, the shirt can be worn comfortably for a long time. In the twenty-third embodiment of the neck-size-adjustable shirt 60, the uppermost button 4 and the button 62 of a slightly larger size as the stopper are connected with the base-winding 63 that passes through the neckband-penetrating buttonhole 61. However, other modifications are possible.

As shown in FIG. 31*a*, in a neck-size-adjustable shirt according to a first modified example of the twenty-third embodiment, the uppermost button 4 and the button 62 of a slightly larger size as the stopper are connected with a rubber thread base 64. The rubber thread base 64 as a leg portion passes through the neckband-penetrating buttonhole 61. As shown in FIG. 31*b*, in a second modified example, a metal disc 65 serves as an uppermost button. A metal disc 67 as a retainer is one size larger than the metal disc 65. The metal disc 65 and the metal disc 67 are connected with a pair of a male screw and a female screw 66. The pair of the male screw and the female screw 66 as a leg portion passes through the neckband-penetrating buttonhole 61.

As shown in FIG. 31*c*, in a third modified example, a concave-side snap fastener 68 serves as an uppermost button. A convex-side snap fastener 69 as a retainer is one size larger than the concave-side hook 68. The concave-side snap fastener 68 and the convex-side snap fastener 69 are connected with a convex-side snap fastener protrusion 69*a*. The convex-side snap fastener protrusion 69*a* as a leg portion passes through the neckband-penetrating buttonhole 61.

As shown in FIG. 31*d*, in a fourth modified example, an uppermost button 4 is attached to a leading end of a bar elastomer 20 as a leg portion. A lower end of the bar elastomer 20 is stuck by adhesion to a disc plastic plate 21. A circumference of the disc plastic plate 21 is covered with an elastomer plate 22 that has a rectangular shape corresponding to a length of the neckband-penetrating buttonhole 61. The elastomer 22 is stitched on a rear side of the rear cloth 3*b* of the inner fold 3B of the neckband with a stitching thread along an outer circumference thereof. With such structure, the uppermost button 4 is capable of moving in a neckline direction inside the neckband-penetrating buttonhole 61 by a deforming force of the elastomer plate 22. If a force is stopped to apply, the uppermost button 4 immediately returns to its original position by an elastic force of the elastomer plate 22.

As shown in FIG. 31*e*, in a fifth modified example, a metal disc 70, a metal leg portion 70*b* and a metal oblong elliptic plate 71 are formed in one body. The metal disc 70 serves as an uppermost button. The oblong elliptic plate 71 as a retainer is fitted to the metal leg portion 70*a* so as to be rotatable. The oblong elliptic plate 71 is passed through the neckband-penetrating buttonhole 61 in a parallel direction therewith and then rotated 90 degrees as shown by an imaginary line (two-dot chain line). Thus, the oblong elliptic plate 71 is blocked from dropping out of the neckband-penetrating buttonhole 61. As shown in FIG. 31*f*, in a sixth modified example, a disc portion 72*a*, a leg portion 72*b* and a large disc portion 72*c* as a retainer are formed in one body so as to define a plastic part 72. The disc portion 72*a* serves as an uppermost button. Thus, a mass-production is possible, thereby leading to a large cost reduction.

If a tie is knotted on the neck-size-adjustable shirt, the uppermost button 4 is not seen. Therefore, an element other than a button may be used. Even if a tie is not knotted, in case a bright material such as a metal, a wood, a ceramic, a glass or the like is used instead of the button, the shirt becomes beautiful in appearance and excellent in view of decoration. Moreover, any material may be used as a leg portion connecting the uppermost button or its substitute with the stopper, as long as it has a suitable length and strength. Furthermore, if the leg portion is made of an elastomer or a rubber, it is capable of expanding and contracting. In addition, since such structure does not use any stopper or elastic material, it can be manufactured easily and at low costs.

As described above, in the twenty-third embodiment of the neck-size-adjustable shirt, the neckline of the shirt including the dress shirt can be adjusted to a desired length without conspicuous action. Moreover, the shirt can be manufactured easily and at low costs. Furthermore, the shirt can be excellent in terms of ornament and can be worn comfortably for a long time.

The twenty-third embodiment is described only about a case in which a sliding mechanism composed only of the stoppers as shown in FIG. 30*a*, FIG. 30*b*, FIG. 31*a* to FIG. 31*f* is used for the neckband-penetrating buttonhole 6. However, these stoppers may be applied to the neck-size-adjustable shirt having the second buttonhole 6 as described in each of the above embodiments. That is, the stopper is held between the front cloth 3*a* and the rear cloth 3*b* of the inner fold of the neckband so that the uppermost button 4 or its substitute slides along the second buttonhole 6. Thus, the shirt has a simple structure that does not use any stopper or elastic material, so that it can be manufactured easily and at low costs.

Twenty-Fourth Embodiment

A neck-size-adjustable shirt according to a twenty-fourth embodiment of the invention is described hereafter referring to FIG. 32*a*, FIG. 32*b*, FIG. 32*c*, FIG. 33*a*, FIG. 33*b* and FIG. 33*c*.

Figure 32A:
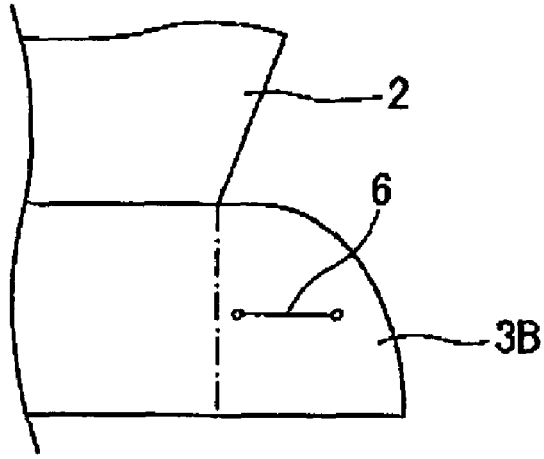
FIG. 32*a* is a drawing showing a second buttonhole provided on an front cloth of an inner front end portion of a neckband while opening a collar of a shirt having neck size adjusting function according to a twenty-fourth embodiment of the invention.
Figure 32B:
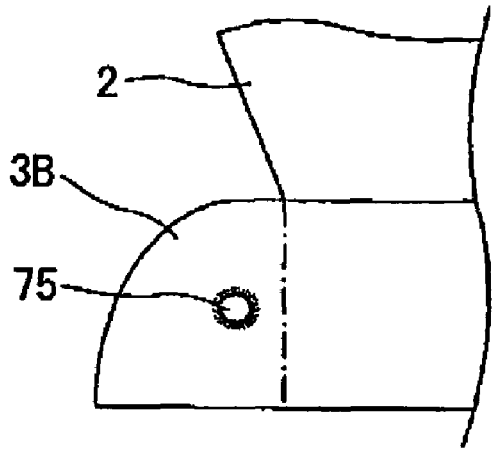
FIG. 32*b* is a reversed view of FIG. 32*a* and shows a through hole provided on a rear cloth of the inner front end portion of the neckband.
Figure 32C:
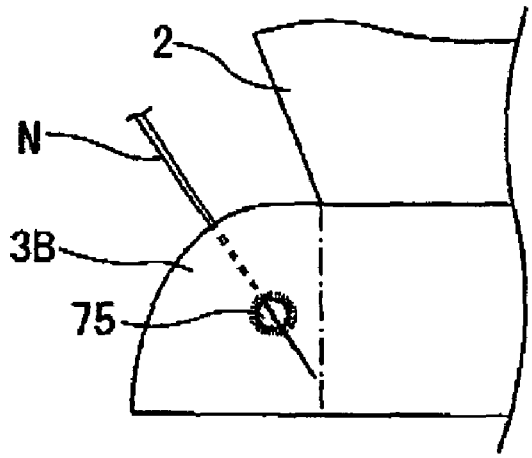
FIG. 32*c* is a drawing showing a way of stitching when an uppermost button is off in the twenty-fourth embodiment.
Figure 33A:
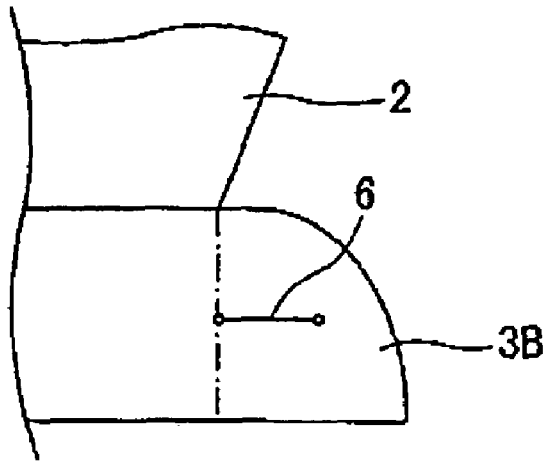
FIG. 33*a* is a drawing showing a second buttonhole provided on an front cloth of an inner front end portion of a neckband while opening a collar of a shirt having neck size adjusting function according to a modified example of the twenty-fourth embodiment of the invention.
Figure 33B:
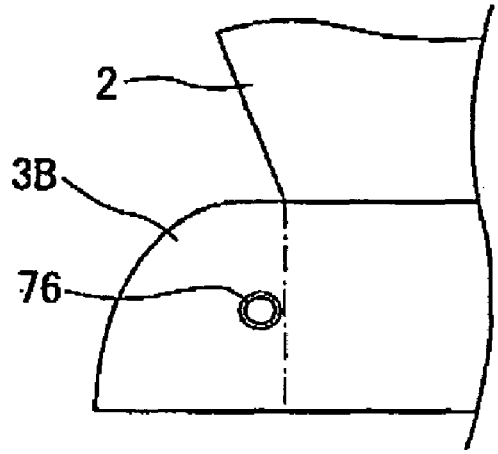
FIG. 33*b* is a reversed view of FIG. 33*a* and shows a through hole provided on a rear cloth of the inner front end portion of the neckband according to a modified example.
Figure 33C:
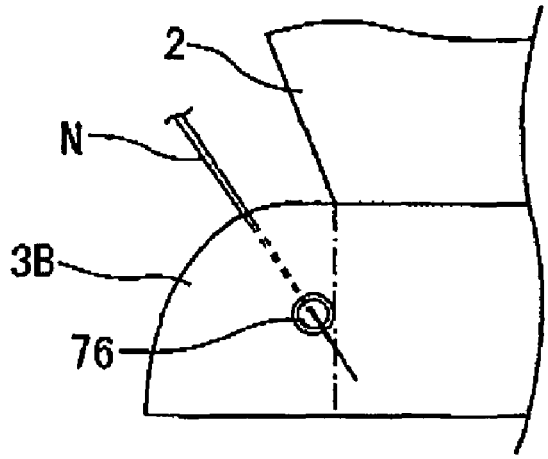
FIG. 33*c* is a drawing showing a way of stitching when an uppermost button is off in the modified example of the twenty-fourth embodiment.

FIG. 32*a* is a drawing showing a second buttonhole provided on an front cloth of an inner front end portion of a neckband while opening a collar of a shirt having neck size adjusting function according to a twenty-fourth embodiment of the invention. FIG. 32*b* is a reversed view of FIG. 32*a* and shows a through hole provided on a rear cloth of the inner front end portion of the neckband. FIG. 32*c* is a drawing showing a way of stitching when an uppermost button is off in the twenty-fourth embodiment. FIG. 33*a* is a drawing showing a second buttonhole provided on an front cloth of an inner front end portion of a neckband while opening a collar of a shirt having neck size adjusting function according to a modified example of the twenty-fourth embodiment of the invention. FIG. 33*b* is a reversed view of FIG. 33*a* and shows a through hole provided on a rear cloth of the inner front end portion of the neckband according to a modified example. FIG. 33*c* is a drawing showing a way of stitching when an uppermost button is off in the modified example of the twenty-fourth embodiment.

As shown in FIG. 32*c*, in the neck-size-adjustable shirt according to the twenty-fourth embodiment, a buttonholed eyelet 75 as a through hole having an appearance like chrysanthemum is provided for a case in which an uppermost button (not shown) is taken off. In case a consumer reattaches the uppermost button to a moving cloth or its substitute by himself or herself, a second buttonhole 6 is slightly broadened as shown in FIG. 32*a*. Then, a position at which the uppermost button is to be located is scooped by a needle N with a stitching thread. At this time, if it is scooped too deeply, it is possible that the needle N scoops up to a rear cloth of an inner fold 3B of a neckband thereby sewing the uppermost button on the rear cloth of the inner fold 3B of the neckband.

Therefore, the buttonholed eyelet 75 as the through hole that is not frayed is provided on the rear cloth at a rear side of the inner fold 3B of the neckband. Then, a consumer passes the needle N through the buttonholed eyelet 75 while checking it without scooping from the beginning so as not to scoop the rear cloth. The consumer repeats such action several times so as to stitch the uppermost button on the moving cloth or its substitute. Thereby, the consumer can reattach the uppermost button easily and without fail.

As shown in FIG. 33*a*, in a neck-size-adjustable shirt according to a modified example of the twenty-fourth embodiment, a left end of the second buttonhole 6 is positioned at a base end line of the collar 2. Then, a position where an uppermost button is to be located is moved to the base end line of the collar 2 in a state in which no force is applied to a moving cloth or its substitute. Therefore, as shown in FIG. 33*b*, a metal ring hole 76 as a through hole that is not frayed is provided at the base end line of the collar 2. As shown in FIG. 33*c*, a consumer passes the needle N through the ring hole 76 while checking it. The consumer repeats such action several times so as to stitch the uppermost button on the moving cloth or its substitute. Thereby, the consumer can reattach the uppermost button easily and without fail As described above, in the neck-size-adjustable shirt according to the twenty-fourth embodiment, even if the uppermost button is taken off, the consumer can reattach the uppermost button easily and for sure. Moreover, the neckline of the shirt including the dress shirt can be adjusted to a desired length without conspicuous action.

Twenty-Fifth Embodiment

Figure 34A:
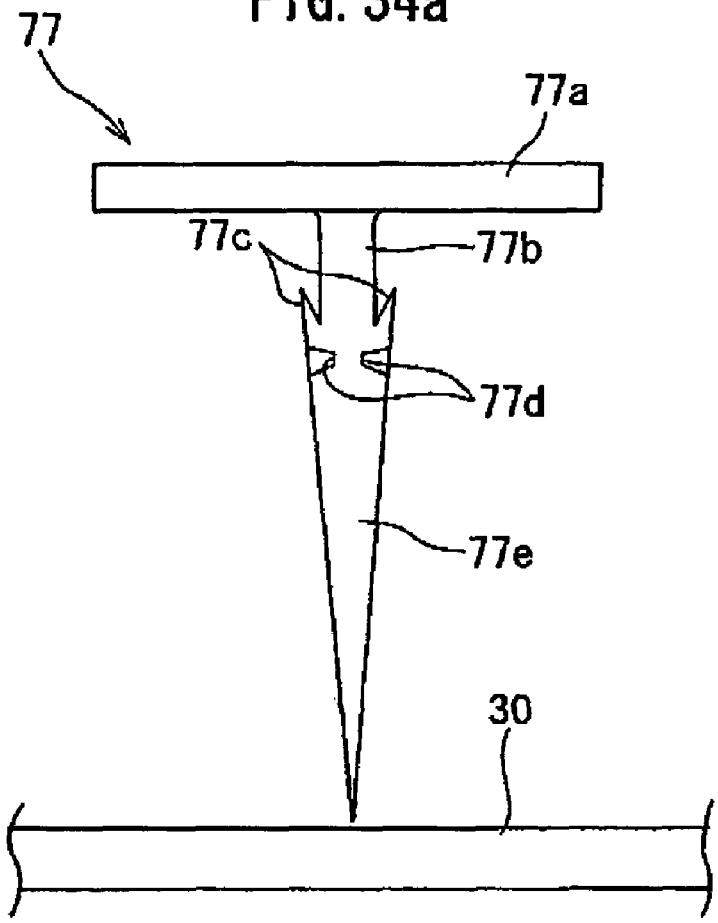
FIG. 34*a* is an enlarged front view showing a state in which a moving cloth is pierced with a plastic button with a piercing needle as an uppermost button used in a shirt having neck size adjusting function according to a twenty-fifth embodiment of the invention.
Figure 34B:
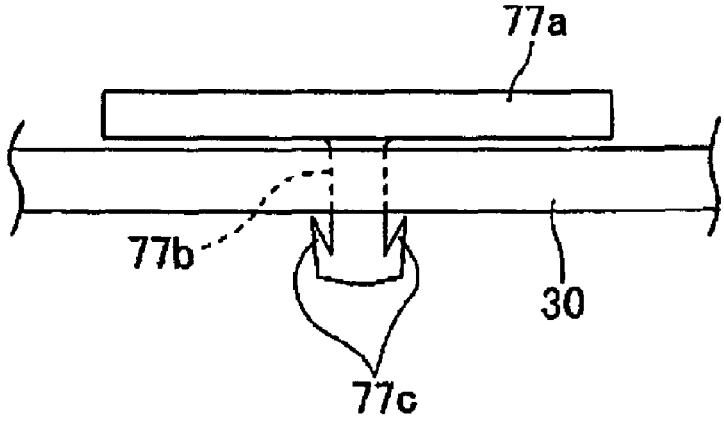
FIG. 34*b* is an enlarged front view showing a state in which a piercing needle is broken off after piercing the plastic button with the piercing needle.

A neck-size-adjustable shirt according to a twenty-fifth embodiment of the invention is described hereafter referring to FIG. 34*a* and FIG. 34*b*. FIG. 34*a* is an enlarged front view showing a state in which a moving cloth is pierced with a plastic button with a piercing needle as an uppermost button used in a shirt having neck size adjusting function according to a twenty-fifth embodiment of the invention. FIG. 34*b* is an enlarged front view showing a state in which a piercing needle is broken off after piercing the plastic button with the piercing needle.

As shown in FIG. 34*a*, in the neck-size-adjustable shirt according to the twenty-fifth embodiment uses as an uppermost button a plastic button 77 with a penetrating needle. The plastic button 77 is composed of a button part 77*a*, an shaft part 77*b*, a pair of retainers 77*c*, a narrow part 77*d* and a penetrating needle part 77*e*. A leading end of the penetrating needle part 77*e* is sharply pointed. Thus, the needle part 77*e* can be penetrated up to a position of the pair of the retainers 77*c*. Thereafter, if the penetrating needle part 77*e* is broken off at the narrow part 77*d*, the button part 77*a* as the uppermost button is firmly attached to the moving cloth 30 by the pair of the retainers 77*c*, as shown in FIG. 34*b*.

As described above, in the neck-size-adjustable shirt according to the twenty-fifth embodiment, even if the uppermost button 77*a* can be attached to the moving cloth very easily. Moreover, the plastic button 77 with the penetrating needle is manufactured by an integral molding at low costs. Therefore, it can reduce costs very much. Furthermore, the neckline of the shirt including the dress shirt can be adjusted to a desired length without conspicuous action.

Each of the embodiments is described while assuming a case of applying the neck-size-adjustable shirt of the invention mainly to the dress shirt. However, the inventive neck-size-adjustable shirt can be applied to shirts in general that has a button on a neckband. It is applicable to a casual shirt, a blouse, a shirt without a collar or the like.

Each of the above embodiments describes a case in which the width of the neckband is normal dimension. However, in case a width of a neckband is large and special, a normal buttonhole 5 and a second buttonhole 6 may be provided in two rows up and down.

In each of the above embodiments, the vertical tape 9, the horizontal tape 10, the horizontal oblong tape 11, the vertical tape 12 and the like are sewn on the rear cloth 3*b* of the neckband 3. However, if these tapes are sewn only on a back fabric of the rear cloth 3*b* of the neckband 3, only a seam of a thread stitching the rubber tape 8 is shown at a front side of the rear cloth 3*b*. Therefore, its appearance improves very much.

In each of the above embodiments, the second buttonhole is buttonholed with a normal thread. However, a buttonholing thread may be impregnated with a thermosetting resin and heat-cured. Alternatively, a buttonholing may be made with a thread made of a synthetic resin. Thus, the second buttonhole becomes hard to be deformed, thereby preventing a breaking-out.

In each of the above embodiments, the lining cloth 7*b* of the same width as the moving cloth 7*a* is used as the stopper. However, a material of the stopper can be selected variously from a cloth, a cloth tape or the like. Moreover, the width may be smaller than the moving cloth 7*a*.

A cross-sectional shape of the short bar-like elastomer 20 to which the button 4 is attached and which passes through the buttonhole 6 may be a column shape of an oblong ellipse or an ellipse.

The preferred embodiments described herein are illustrative and not restrictive, the scope of the invention being indicated in the appended claims and all variations which come within the meaning of the claims are intended to be embraced therein.

The invention claimed is:

1. A shirt having a neck size adjusting function comprising:

a neckband having a first buttonhole and a second buttonhole, the first buttonhole being formed at one end part in a neckline direction of the neckband, while the second buttonhole being formed at another end part thereof so as to extend in substantially a same direction as the neckline direction;

a moving cloth disposed in a concealed manner at an area corresponding to the second buttonhole at an inside of the other end part of the neckband and communicated with an outside of the neckband through the second buttonhole, the moving cloth being movable in the neckline direction while being kept concealed at the inside of the other end part of the neckband;

an uppermost button secured on the moving cloth at a position facing the second buttonhole thereof via a thread base or a base-winding or a substitute thereof, the uppermost button being capable of moving to a desired position in the second buttonhole in the neckline direction within a range of a length of the second buttonhole via the thread base or the base winding or the substitute; and a break-out prevention structure, operatively coupled with the moving cloth in the area corresponding to the second buttonhole in the other end part of the neckband, for preventing the moving cloth from being pulled out of the second buttonhole and exposed therefrom by a force applied to the moving cloth via the thread base or the base-winding or the substitute when the uppermost button is moved in the neckline direction in the second buttonhole, wherein said break-out prevention structure includes at least one of a stiff padding and rubber tape, said shirt further comprising: as the break-out prevention structure, a relatively stiff padding stuck on an inside of the neckband so as to surround the second buttonhole, the relatively stiff padding having a slot opened at a portion corresponding to the second buttonhole, the moving cloth being provided at the inside of the neckband so as to move separately from the neckband, and the uppermost button being stitched on the moving cloth with a suitable length of a thread base or a base-winding so as to be taken out of the second buttonhole.

2. A shirt having a neck size adjusting function according claim 1, in which the moving cloth includes a padding inserted at the inside of the neckband and a fabric covering the padding, the fabric being a same fabric as the shirt.

3. A shirt having a neck size adjusting function according to claim 1, in which the moving cloth is made by joining a fabric to a relatively stiff padding as the break-out prevention structure and cutting -the relatively stiff padding into a shape of the moving cloth by a laser cutting or a heat cutting.

4. A shirt having a neck size adjusting function according to claim 1, further comprising, as the break-out prevention structure, a relatively stiff padding sewn on a rear side of the moving cloth.

5. A shirt having a neck size adjusting function according to claim 1, in which an elastic material that is capable of expanding and contracting is sewn on one of the moving cloth, the moving cloth with the relatively stiff padding sewn on a rear side, the moving cloth with a heat-resistant plastic- plate sewn on the rear side and the heat-resistant plastic plate, and an other end of the elastic material is sewn on the rear cloth of the neckband.

6. A shirt having a neck size adjusting function according to claim 1, in which one of the moving cloth, the moving cloth with the relatively stiff padding sewn on a rear side, the moving cloth with a heat-resistant plastic plate sewn on the rear side and the heat-resistant plastic plate is sewn on a long elastic material that is capable of expanding and contracting, and opposite ends of the elastic material is sewn respectively on the rear cloth of the neckband.

7. A shirt having a neck size adjusting function according to claim 1, in which the uppermost button is stitched on an elastic material or the moving cloth via the thread base or the base-winding taken out of the second buttonhole, and the second buttonhole is impregnated with a thermosetting resin and heat-cured so as to provide the break-out prevention structure.

8. A shirt having a neck size adjusting function according to claim 1, in which the uppermost button is stitched on the an elastic material or the moving cloth via the thread base or the base-winding, and the uppermost button is taken out of the second buttonhole that has been buttonholed with a thread made of a synthetic resin so as to provide the break-out prevention structure.

9. A shirt having a neck size adjusting function according to claim 1, in which a stopper is sewn on one end of the moving cloth or the heat-resistant plastic plate so as not to impede normal movement of the moving cloth or the heat-resistant plastic plate, and an other end of the stopper is sewn on an end of the neckband.

10. A shirt having a neck size adjusting function according to claim 1, in which a through hole that is prevented from fraying is provided on the rear cloth at a rear side of the neckband and at a place where the uppermost button is located when no force is applied to the moving cloth or its substitute, the through hole being communicated with the inside of the neckband so as to serve as a hole for passing a needle for sewing the uppermost button on the moving cloth or the substitute.

11. A shirt having a neck size adjusting function according to claim 1, in which one or all of the uppermost button or a substitute thereof, the moving cloth or a substitute thereof and the thread base, the base-winding or a substitute thereof connecting both the uppermost button or the substitute thereof and the moving cloth or the substitute thereof is made of a plastic, an elastomer, a rubber, a wood, a ceramic or a glass.

12. A shirt having a neck size adjusting function according to claim 1, in which the second buttonhole is inclined to a neckline direction, while an inner end of the second buttonhole being slightly lower than an other end thereof.

13. A shirt having a neck size adjusting function according to claim 1, in which the second buttonhole is provided such that an inner end of the second buttonhole is located away from the neckband toward an outside of the neckband from a position just under a base end portion of the neckband and a collar joined together.

14. A shirt having a neck size adjusting function comprising:

a neckband having a first buttonhole and a second buttonhole, the first buttonhole being formed at one end part in a neckline direction of the neckband, while the second buttonhole being formed at another end part thereof so as to extend in substantially a same direction as the neckline direction;

a moving cloth disposed in a concealed manner at an area corresponding to the second buttonhole at an inside of the other end part of the neckband and communicated with an outside of the neckband through the second buttonhole, the moving cloth being movable in the neckline direction while being kept concealed at the inside of the other end part of the neckband;

an uppermost button secured on the moving cloth at a position facing the second buttonhole thereof via a thread base or a base-winding or a substitute thereof, the uppermost button being capable of moving to a desired position in the second buttonhole in the neckline direction within a range of a length of the second buttonhole via the thread base or the base winding or the substitute;

a break-out prevention structure, operatively coupled with the moving cloth in the area corresponding to the second buttonhole in the other end part of the neckband, for preventing the moving cloth from being pulled out of the second buttonhole and exposed therefrom by a force applied to the moving cloth via the thread base or the base-winding or the substitute when the uppermost button is moved in the neckline direction in the second buttonhole, wherein said break-out prevention structure includes at least one of a stiff padding and rubber tape, wherein the moving cloth is made of a padding alone that is provided at the inside of the neckband so as to move separately from the neckband, the uppermost button being stitched on the moving cloth with one of the thread base and the base-winding each having a suitable length;

the break-out prevention structure is composed of at least one of a relatively large and stiff padding attached around the second buttonhole from an inside of a front cloth of the neckband and a relatively small and stiff padding is attached at a portion where the second buttonhole is formed from above the relatively large and stiff padding, while the relatively small and stiff padding having a length corresponding to a length of the second buttonhole;

a fabric of a same fabric as one of the shirt and other fabric is connected by one of sticking and sewing on one of a first place, a second place and a third place, the first place being the relatively large and stiff padding, while the fabric having such a dimension as to cover the relatively large and stiff padding as a whole, the second place being on a portion where the second buttonhole is formed, while the fabric having a dimension corresponding to the length of the second buttonhole and the third place being the relatively small and stiff padding, while the fabric having one of a first dimension and a second dimension, the first dimension covering the relatively large and stiff padding as a whole and the second dimension covering the relatively small and stiff padding as a whole, the second button hole is formed thereafter; and the uppermost button is taken out of the second buttonhole.

15. A shirt having a neck size adjusting function comprising:

a neckband having a first buttonhole and a second buttonhole, the first buttonhole being formed at one end part in a neckline direction of the neckband, while the second buttonhole being formed at another end part thereof so as to extend in substantially a same direction as the neckline direction;

a moving cloth disposed in a concealed manner at an area corresponding to the second buttonhole at an inside of the other end part of the neckband and communicated with an outside of the neckband through the second buttonhole, the moving cloth being movable in the neckline direction while being kept concealed at the inside of the other end part of the neckband;

an uppermost button secured on the moving cloth at a position facing the second buttonhole thereof via a thread base or a base-winding or a substitute thereof, the uppermost button being capable of moving to a desired position in the second buttonhole in the neckline direction within a range of a length of the second buttonhole via the thread base or the base winding or the substitute;

a break-out prevention structure, operatively coupled with the moving cloth in the area corresponding to the second buttonhole in the other end part of the neckband, for preventing the moving cloth from being pulled out of the second buttonhole and exposed therefrom by a force applied to the moving cloth via the thread base or the base-winding or the substitute when the uppermost button is moved in the neckline direction in the second buttonhole, wherein said break-out prevention structure includes at least one of a stiff padding and rubber tape, further comprising, as the break-out prevention structure, a relatively stiff padding stuck at the inside of the one end part of the neckband so as to cover the second buttonhole as a whole, except the relatively stiff padding having a slot opened at a portion corresponding to the second buttonhole.

* * * * *